US007784125B2

(12) United States Patent
Morin et al.

(10) Patent No.: US 7,784,125 B2
(45) Date of Patent: Aug. 31, 2010

(54) MOVABLE SIDERAIL APPARATUS FOR USE WITH A PATIENT SUPPORT APPARATUS

(75) Inventors: Marco Morin, Breakeyville (CA); Pascal Castonguay, Levis (CA); Guy Lemire, Beaumont (CA); Jean-Paul Dionne, Levis (CA)

(73) Assignee: Stryker Canadian Management, Inc., L'Islet, Quebec (CA)

( * ) Notice: Subject to any disclaimer, the term of this patent is extended or adjusted under 35 U.S.C. 154(b) by 0 days.

(21) Appl. No.: 12/063,970

(22) PCT Filed: Aug. 16, 2006

(86) PCT No.: PCT/CA2006/001341

§ 371 (c)(1),
(2), (4) Date: Sep. 19, 2008

(87) PCT Pub. No.: WO2007/019692

PCT Pub. Date: Feb. 22, 2007

(65) Prior Publication Data

US 2009/0139028 A1 Jun. 4, 2009

(30) Foreign Application Priority Data

Aug. 16, 2005 (CA) ..... 2516050

(51) Int. Cl.
*A47C 21/08* (2006.01)

(52) U.S. Cl. ..... 5/430; 5/425; 5/424

(58) Field of Classification Search ..... 5/425, 5/428, 430, 424, 426, 427, 662
See application file for complete search history.

(56) References Cited

U.S. PATENT DOCUMENTS

| | | | | |
|---|---|---|---|---|
| 6,938,289 | B2 * | 9/2005 | Morin | 5/425 |
| 6,951,036 | B2 * | 10/2005 | Lemire | 5/425 |
| 7,107,637 | B2 * | 9/2006 | Kuek et al. | 5/430 |
| 2003/0106151 | A1 * | 6/2003 | Nanahara | 5/430 |
| 2004/0177443 | A1 * | 9/2004 | Simmonds et al. | 5/428 |
| 2005/0160527 | A1 * | 7/2005 | Morin | 5/430 |
| 2005/0166322 | A1 * | 8/2005 | Kramer et al. | 5/430 |

(Continued)

*Primary Examiner*—Peter M Cuomo
*Assistant Examiner*—Brittany M Wilson
(74) *Attorney, Agent, or Firm*—Van Dyke, Gardner, Linn & Burkhart, LLP

(57) ABSTRACT

The present invention provides a movable siderail apparatus (5) for use with a patient support apparatus. The siderail apparatus (5) is configured to move the siderail body (14) associated therewith in a clock-type swing movement relative to the patient support apparatus. Two or more support arms (20) are disposed between the intermediate frame or the deck support of the patient support apparatus and the siderail body (14), each support arm (20) having two pivots (30, 40), a first (40) rotatably connecting it to the intermediate frame or deck support and a second (30) rotatably connecting it to the siderail body (14), thereby enabling the siderail body (14) to be raised or lowered vertically by a rotation substantially parallel to the longitudinal direction of the patient support apparatus. In a first preferred embodiment, the angles defined between each support arm (20) and a lower edge of the siderail (9) are substantially obtuse during rotational movement of the siderail (9). In a second preferred embodiment, a guiding mechanism (110) is operatively connected to the cross-member (70) and two or more lower pivots (40), such that the guiding mechanism (110) provides means for lateral movement of the siderail (9) toward and away from the support apparatus.

21 Claims, 61 Drawing Sheets

U.S. PATENT DOCUMENTS

2006/0085912 A1* 4/2006 Kuek et al. ..... 5/430
2006/0090259 A1* 5/2006 Castonguay et al. ..... 5/430
2006/0117481 A1* 6/2006 Stryker et al. ..... 5/430
2006/0179569 A1* 8/2006 Vrzalik et al. ..... 5/430
2006/0277683 A1* 12/2006 Lamire et al. ..... 5/600

* cited by examiner

MOVABLE SIDERAIL APPARATUS FOR USE WITH A PATIENT SUPPORT APPARATUS

FIELD OF THE INVENTION

The present invention pertains to the field of siderail apparatuses and in particular to a siderail apparatus for use with a patient support apparatus.

BACKGROUND OF THE INVENTION

Siderail apparatuses have been widely used in various applications such as with hospital beds, stretchers and other lying surfaces used in medical applications. One of the main purposes of a siderail apparatus in such applications is to secure the patient on the lying surface by diminishing the possibility of the patient accidentally falling off of the lying surface or in some case to prevent the patient from intentionally leaving the lying surface.

Most siderail apparatuses are moveable in one-way or another. This characteristic improves the flexibility and the ease of use of a siderail apparatus in various ways. The main moving feature of a siderail apparatus is the ability to move the siderail to a deployed position when patient security is needed and to a stowed position when needed for administering patient care or to permit the patient to get on or off the lying surface.

There are several prior art references that disclose the use of siderail apparatuses used with lying surfaces as beds. For example, U.S. Pat. Nos. 6,389,622, 6,564,404, 6,691,345 and 5,715,548 disclose different moveable siderail apparatuses used with hospital or medical type beds.

U.S. Pat. No. 6,389,622 to Yu et al. discloses a hospital bed having siderails using a clock-type swing mechanism wherein the siderails have two arms connecting them to the bed frame with hinges so that the siderails can be raised or lowered by a rotation of about 180° from the lowered or raised position respectively. The rotation of the siderails is provided in a vertical plane parallel to the length of the bed. The arms connecting the siderail to the bed are configured as straight bars.

The outer side of the siderail is designed including inner concave grooves. If the patient wants to get on or off the bed, he may insert his fingers into the inner concave grooves to push the siderails inward and then to rotate the siderail counterclockwise or clockwise for lifting or lowering the siderail. This configuration can prevent fingers from being clamped between the siderails and the bed platform when used as intended by the patient.

This design however, has pinch points between the siderails and the arms when the siderails are moved from the raised position to the lowered position, especially when operated by a caregiver or someone located on the side of the bed. The siderail as disclosed by Yu et al. is configured to move in a single vertical plane when raised or lowered.

U.S. Pat. No. 6,564,404 to Nanahara discloses a liftable siderail for a bed. The siderail is moved in a clock-type rotational movement when it is raised or lowered and this movement is in a single vertical plane parallel to the length of the bed. The arms of the liftable siderail have a parallelogrammic frame provided on the upper side, and the ends of the shorter diagonal of the frame can correspond to the connection point with the side rail and the installation point, while the ends of the longer diagonal of the frame can define protrusions.

A liftable siderail is provided which can be lifted and lowered by the pivotal rotation of support arms along the pivots, characterized by allowing the standard values of respective dimensions of the siderail to be satisfied, while allowing the bed deck height to be low and allowing the distance between the bottom of the siderail and the floor surface to remain large when the siderail is in the stored position.

This siderail design however creates pinch points between the siderails and the arms when the siderails are moved from the raised position to the lowered position, especially when operated by a caregiver or someone located on the side of the bed.

U.S. Pat. No. 6,691,345 to Nanahara discloses a lifting mechanism for liftable siderails for a bed. The invention disclosed uses a clock-type rotational movement when the siderail is raised or lowered, the movement being in a vertical plane parallel to the length of the bed. The arms of the liftable siderail are made of two straight bars connected together through hinges, to form an "elbow-type" element.

Similarly to the siderail designs discussed above, this mechanism can create several pinch points between the siderails and the arms when the siderails are moved from the raised position to the lowered position, creating a safety problem for the patient or other person operating the siderail.

U.S. Pat. No. 5,715,548 to Weismiller et al. discloses a moveable siderail mechanism for a bed. The siderail is designed so that when the siderail is lowered from a higher position, it is moved closer to the centre of the bed having the top of the siderail beneath the sleeping surface. This operation is achieved with by two separate and distinct movements, namely the vertical movement of the siderail and the transverse movement of the siderail. The siderails are moved from the raised position to the lowered position, and vice-versa, through a pivotal movement in a vertical plane that is substantially perpendicular to the length of the bed, resulting in a "wing-type" movement. Each siderail requires a relatively wide lateral space on each side of the bed during operation.

Based on the current state of the art, there are several problems with the siderail apparatuses used in beds or the like.

For example, a problem arising from the existing siderail mechanisms used in medical beds which allow any lateral movement is that typically there is a multiple step operation of the siderail to move it from a raised position to a lowered position. Such an operation requires for example, three distinct actions. The user has to unlock the siderail, to engage in a movement to lower the siderail and then to engage in a movement to push the siderail towards the centre of the bed. This process requires time, effort and is inefficient. Some of the actions associated with the operation of such a device often require actions that are not ergonomic for the exertion of a significant level of effort.

Another problem arising out of the prior art related to a bed siderail is the space required for the operation of the siderail. Various existing products require significant lateral space to operate the siderail. Several of these siderail use a "wing-type" mechanism to raise and lower the siderail, using a pivotal rotation in a plane that is perpendicular to the length of the bed, therefore requiring extra lateral space. Furthermore, the operation may require the user of the siderail mechanism to move away from the bed in order to raise or lower the siderail and in some cases the user has to move the entire bed to an area with sufficient space before operating the siderail. This is a significant problem since the space in medical facilities is often limited, there are unnecessary efforts and unnecessary movement of the patient involved and requires more time to accomplish the desired function, thereby diminishing time for a health worker to dispense medical services.

A further problem with the existing siderail mechanisms and the prior art using a "clock-type" movement in a vertical plane parallel to the length of the bed is the creation of pinch points during the operation of the siderail. When such siderails are moved, angles between the support arms and the bottom-most edge of the siderail become acute thereby creating a pinch point where fingers, hands, clothing or bed sheets can get caught and cause injuries to the user and/or patient or create malfunctions of the siderail mechanism.

The size, particularly the width, of the bed is an important element for medical bed since, as mentioned previously, the room in medical facilities is often limited. To diminish this problem, it is therefore an important component in designing a siderail mechanism to minimize the width of the bed when not in use and conversely maximize the patient surface when in use.

There is therefore a need for a siderail mechanism which can overcome the deficiencies identified in the prior art. There is a need for a siderail mechanism that can reduce or eliminate pinch points between the siderail body and the support arms during movement thereof. In addition, there is a need for a siderail mechanism that can reduce the width of the overall bed when in the siderail mechanism is in a lowered or stowed position, wherein this can be provided in a single movement.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a movable siderail apparatus for use with a patient support apparatus. In accordance with one aspect of the present invention, there is provided a movable siderail apparatus for use with a patient support apparatus, the siderail apparatus comprising: a siderail having two or more upper pivots in a longitudinally spaced apart relationship; a cross-member having two or more lower pivots in a longitudinally spaced apart relationship, the cross-member being coupled to an intermediate frame or deck support of the patient support apparatus; two or more support arms, a first end of each support arm pivotally connected to one of the two or more upper pivots of the siderail, a second end of each support arm pivotally connected to one of the two or more lower pivots of the cross-member in a longitudinally spaced apart relationship; wherein the siderail is movable between a deployed position and a stowed position through rotational movement in a plane substantially vertical and substantially parallel to the longitudinal length of the patient support apparatus and wherein the angles defined between each support arm and a lower edge of the siderail are substantially obtuse during rotational movement of the siderail.

In accordance with another aspect of the invention, there is provided a movable siderail apparatus for use with a patient support apparatus, the siderail apparatus comprising: a siderail having two or more upper pivots in a longitudinally spaced apart relationship; a cross-member having two or more lower pivots in a longitudinally spaced apart relationship, the cross-member being coupled to an intermediate frame or deck support of the patient support apparatus; a guiding mechanism operatively connected to the cross-member and the two or more lower pivots; and two or more support arms, a first end of each support arm pivotally connected to one of the two or more upper pivots of the siderail, a second end of each support arm pivotally connected to one of the two or more lower pivots; wherein the siderail is movable between a deployed position and a stowed position through rotational movement in a plane substantially vertical and substantially parallel to the longitudinal length of the patient support apparatus and wherein the guiding mechanism provides a means for lateral movement of the siderail towards and away from the patient support apparatus during rotational movement of the siderail.

In accordance with another aspect of the invention, there is provided a movable siderail apparatus for use with a patient support apparatus, the siderail apparatus comprising: a siderail having two or more upper pivots in a longitudinally spaced apart relationship; a cross-member having two or more lower pivots in a longitudinally spaced apart relationship, the cross-member being coupled to an intermediate frame or deck support of the patient support apparatus; a guiding mechanism operatively connected to the cross-member and the two or more lower pivots; and two or more support arms, a first end of each support arm pivotally connected to one of the two or more upper pivots of the siderail, a second end of each support arm pivotally connected to one of the two or more lower pivots; wherein the siderail is movable between a deployed position and a stowed position through rotational movement in a plane substantially vertical and substantially parallel to the longitudinal length of the patient support apparatus and wherein the guiding mechanism provides a means for lateral movement of the siderail towards and away from the patient support apparatus during rotational movement of the siderail and wherein the siderail is movable between a deployed position and a stowed position through rotational movement in a plane substantially vertical and substantially parallel to the longitudinal length of the patient support apparatus and wherein the angles defined between each support arm and a lower edge of the siderail are substantially obtuse during rotational movement of the siderail.

BRIEF DESCRIPTION OF THE DRAWINGS

FIG. 4*e* is an inside view of the siderail apparatus in a partially deployed position having two support arms pivotally connected to a cross-member which comprises a guiding mechanism, according to one embodiment of the present invention.

DETAILED DESCRIPTION OF THE INVENTION

Definitions

Figure 1A:
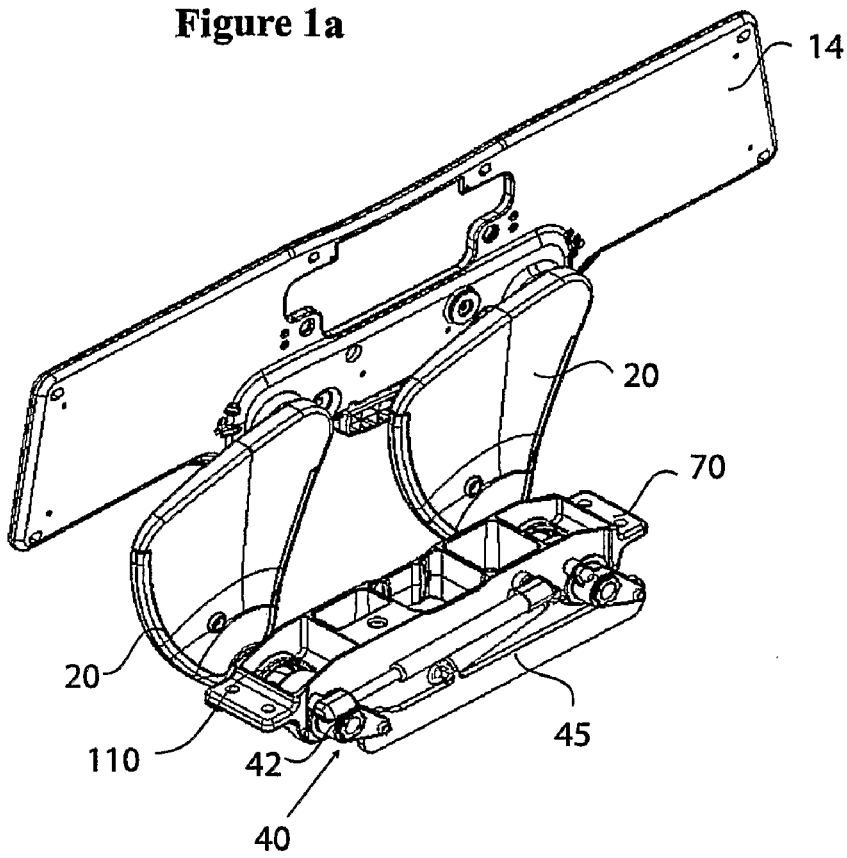
FIG. 1*a* illustrates a perspective inner side view of the siderail apparatus without the siderail cover, in a fully deployed position, according to one embodiment of the present invention.

The term "siderail" is used to define the part of a siderail apparatus designed to secure the lying surface to ensure the patient does not fall from or exit the lying surface when the siderail apparatus is in its fully or partially deployed positions.

The term "locking mechanism" is used to define any mechanism configured to allow the siderail apparatus to be locked or unlocked in any predetermined position.

The term "support arms" is used to define the physical components connecting the siderail body to the mechanism casing through pivots situated in proximity of each end of each of said support arms.

The term "guiding mechanism" is used to define a means for guiding the siderail body through a lateral movement of the siderail body towards and away from the lying surface during rotational movement of the siderail body.

The term "inside view" is used to define a view in relation to the siderail apparatus means the view from the side in relative proximity of the lying surface and the term "outside view" is used to define a view from the side opposite to that shown in the inside view.

The term "upper pivot" is used to define a pivot used to connect a support arm and a siderail body or siderail. The pivot connected to the other end of the support arm is defined to as a "lower pivot". The previous definition is not affected by the spatial position of the lower and upper pivot relatively to each other, as this position can change during operation of the siderail mechanism. It is to be understood that a pivot comprises a pivot shaft and a pivot slot.

The terms "intermediate frame" and "deck support" are used to define the part of the patient support apparatus to which the moveable siderail apparatus is operatively connected. The shape and appearance of the "intermediate frame" and "deck support" of the patient support apparatus can vary as understood by a worker skilled in the art without departing from the scope of the present invention.

The term "patient support apparatus" is used to define a an apparatus to support a patient such as, without limitation, a hospital bed, a therapeutic bed, stretcher, a patient transfer apparatus etc. and to which the siderail apparatus is operatively connected.

The term "lying surface" is used to define the surface of a patient support apparatus intended for the patient's body to rest on. The term "lying surface" includes, for example, any type of mattress, therapy surfaces, etc.

Unless defined otherwise, all technical and scientific terms used herein have the same meaning as commonly understood by one of ordinary skill in the art to which this invention belongs.

The present invention will thus be described in association with a patient support apparatus that includes a frame system, a mattress or other sleep surface. The frame system includes a base frame supported on the floor, for example by a plurality of caster wheels, an intermediate frame supported by an elevation system comprising lift arms configured to raise and lower the intermediate frame relative to the base frame, and a deck support connected to the intermediate frame. The deck support comprising a head or fowler section, pivotally coupled to a seat/thigh section, and a foot section pivotally coupled to the seat section, each configured to articulate between a plurality of positions. It would be readily understood by a worker skilled in the art that a patient support apparatus can be configured in other ways. The siderail apparatus according to the present invention would be readily usable with alternate configurations of the patient support apparatus as would be readily understood.

The present invention provides a movable siderail apparatus 5 for use with a patient support apparatus. The siderail apparatus comprises a siderail and two or more support arms. A first end of each support arm is pivotally connected to the siderail in a longitudinally spaced apart relationship using an upper pivot, a second end of each support arm is pivotally connected to a cross-member in a longitudinally spaced apart relationship through a lower pivot, wherein the cross-member is coupled to either the intermediate frame or the deck support of the patient support apparatus. The siderail is movable between a deployed position and a stowed position through clock-type rotational movement in a plane substantially vertical and substantially parallel to the longitudinal length of the patient support apparatus. In this embodiment, each support arm is configured to have a shape with a width greater at the first end than at the second end thereof. As a result of the shape of the support arms, the angle defined between each support arm and the bottom edge of the siderail remains obtuse during the rotational movement of the siderail. This relative configuration between the support arms and the siderail can substantially eliminate pinch points being created between each support arm and the bottom edge of the siderail.

In one embodiment of the present invention, the movable siderail apparatus comprises a siderail with two or more support arms, which are coupled to a patient support apparatus. The siderail is movable between a deployed position and a stowed position through clock-type rotational movement in a plane substantially vertical and substantially parallel to the longitudinal length of the patient support apparatus. In particular, a first end of each support arm is pivotally connected to the siderail in a longitudinally spaced apart relationship using an upper pivot, a second end of each support arm is pivotally connected to a cross-member in a longitudinally spaced apart relationship through a lower pivot, wherein the cross-member is coupled to either the intermediate frame or the deck support of the patient support apparatus. The cross member includes a guiding mechanism associated therewith, wherein the guiding mechanism is configured to transversally move the siderail relative the longitudinal axis of the patient support apparatus during rotational movement of the siderail apparatus.

In one embodiment of the present invention, the guiding mechanism can be configured as a groove, wherein each of the lower pivots includes a radial protrusion configured to engage with a respective groove. When the lower pivots are rotationally moved, the radial protrusions of the pivots are guided by the grooves thereby creating a transverse transitional movement of the pivots along the grooves of the guiding mechanism resulting in the transverse movement of the siderail towards or away from the patient support apparatus, during the raising or lowering of the siderail apparatus.

In one embodiment of the present invention, the movable siderail apparatus further comprises a locking mechanism operatively connected to the siderail and two or more support arms. The locking mechanism can be transferable between a locked position and an unlocked positioned, wherein in the locked position it can prevent any movement of the siderail apparatus relative to the patient support apparatus.

In one embodiment of the present invention, the siderail apparatus for use with a patient support apparatus comprises a detector module to detect the relative positioning of the siderail.

In another embodiment of the present invention, the siderail apparatus for use with a patient support apparatus comprises a siderail protective sheath.

Siderail

The siderail is the barrier component of the siderail apparatus, this barrier component being configured to control egress of a patient lying on the patient support apparatus. For example, the siderail assists in preventing the patient from inadvertently falling off of the patient support apparatus. The siderail comprises the siderail body and the siderail cover, these two components being either structurally distinct from one another or integrally formed as a single component. The shape and size of the siderail will vary depending on the patient support apparatus it is coupled to and its intended use. The choice of the height of the siderail, for example, will be dictated by the type of patient support apparatus, by the thickness of the lying surface, by the intended patient (i.e. child, adult, bariatric) etc. The length and shape of the siderail can be determined, for example, in relation to the length of the patient support apparatus, the presence or absence of other siderails on the same side of the patient support apparatus, the functions of the patient support apparatus and regulatory requirements. The siderail can have various handles to assist in the movement of the siderail and be designed to work with the mechanism that facilitates the movement of the siderail and with the ergonomics for the cleaning, general maintenance and aesthetics of the siderail apparatus.

Support Arms

The support arms of the siderail are support struts which physically connect the siderail to the patient support apparatus, while providing for a relative movement between the siderail and the patient support apparatus. The support arms are pivotally connected to the siderail and the cross-member. The use of bearing assemblies, pivot journals, lubricants or other friction reduction means can be used to relieve the friction during rotation of the siderail relative to the patient support apparatus. The support arms are shaped in a way so that the angles defined between each support arm and the bottom edge of the siderail remain substantially obtuse during the rotational movement of the siderail.

Cross Member

A cross-member provides a connection point between the support arms and the patient support apparatus. The cross-member is coupled to two support arms by two respective lower pivots. The cross-member is further connected to an intermediate frame or deck support of the patient support apparatus by securing means. It is generally made of a light metal such as aluminum or other materials that alone or treated appropriately (e.g. with a coating) will maintain a relatively high strength to weight ratio and high corrosion resistant characteristics. A bearing assembly or other friction reduction means can be used to reduced friction between the cross-member and the pivot shafts of the lower pivots.

Figure 1B:
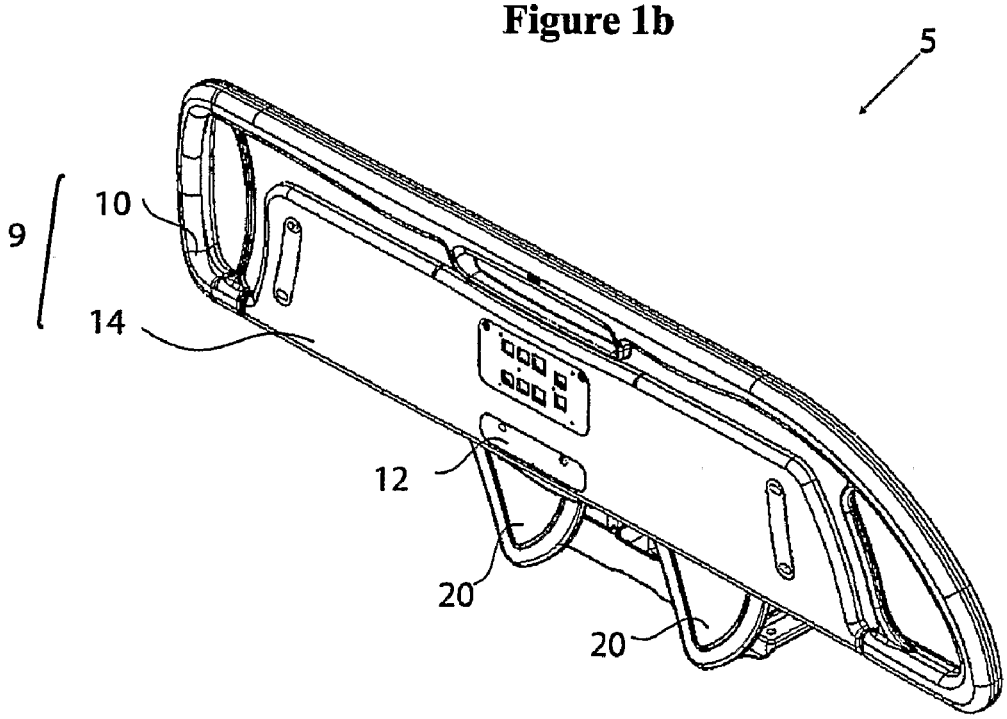
FIG. 1*b* illustrates a perspective outer side view of the siderail apparatus without the siderail cover according to one embodiment of the present invention.

FIG. 1*a* illustrates a three dimensional inside view of one embodiment of the siderail apparatus according to one embodiment of the present invention. The siderail body 14 is connected to two support arms 20 through two respective upper pivots 30. Two respective lower pivots 40 are used to connect the other ends of the two support arms 20 to a cross-member 70. The illustrated shape of the support arms 20 is an example of the configuration designed to avoid the creation of pinch points between the support arms 20 and the lower edge of the siderail body 14 during movement of the siderail apparatus 5. FIG. 1*b* illustrates an outside view of the embodiment of FIG. 1*a* with the siderail cover 10 of the siderail apparatus 5. The siderail cover 10 is coupled to the siderail body 14, and can be replaced or changed if damaged or to suit different needs, without having to change the complete siderail apparatus 5. A release system for a locking mechanism 120 (FIG. 3C) is shown. The location of the release system is designed according of its intended use. As such, where it is preferable to limit the use of the locking mechanism 120 to the care giver or someone else other that the person lying on the patient support apparatus, the release system 12 can be configured and located on the siderail body 14 in where it is inaccessible for the person on the patient support apparatus. This configuration can be useful for security and safety reasons.

Figure 2A:
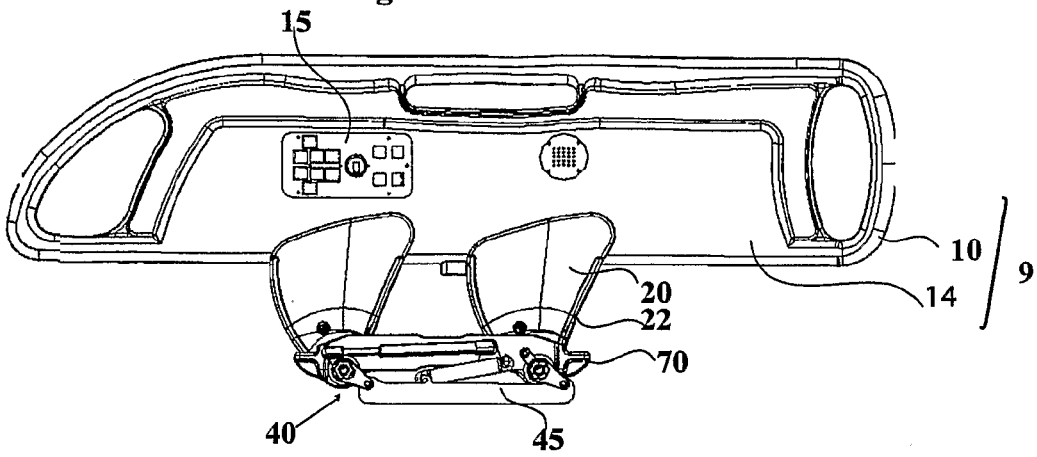
FIG. 2*a* illustrates an inner side view of the siderail apparatus in a fully deployed position according to one embodiment of the present invention.
Figure 2B:
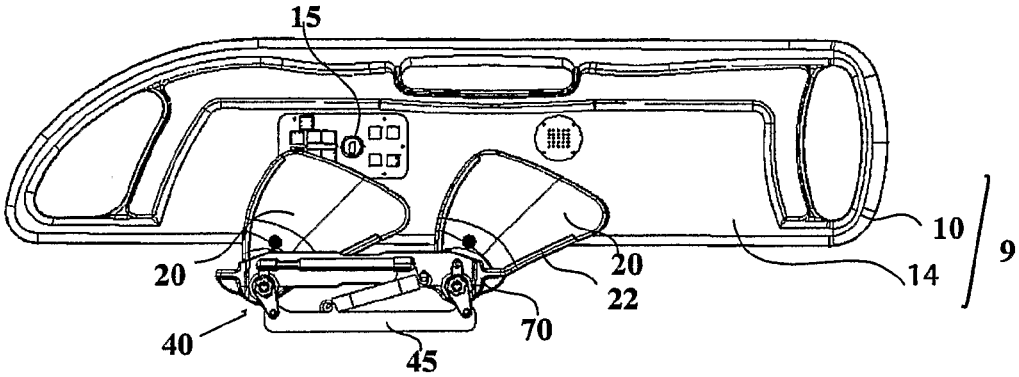
FIG. 2*b* illustrates an inner side view of the siderail apparatus in a partially deployed position according to the embodiment of FIG. 2*a*.
Figure 2C:
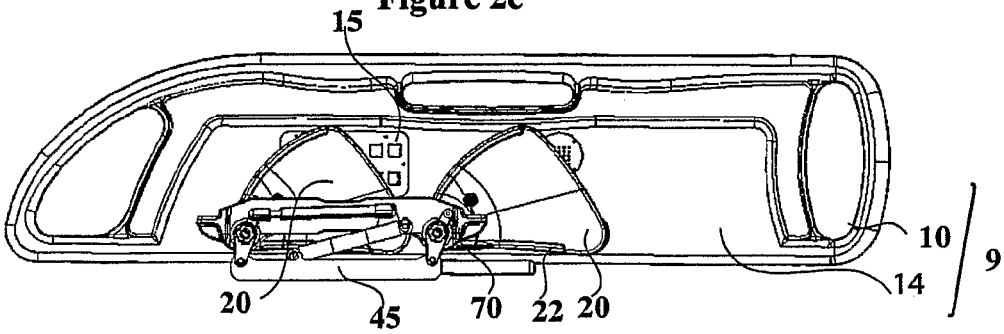
FIG. 2*c* illustrates an inner side view of the siderail apparatus in a partially stowed position according to the embodiment of FIG. 2*a*.
Figure 2D:
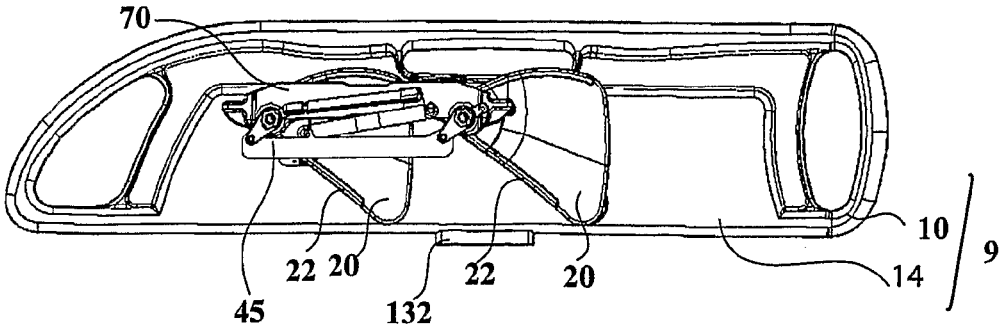
FIG. 2*d* illustrates an inner side view of the siderail apparatus in a fully stowed position according to the embodiment of FIG. 2*a*.

With reference to FIGS. 2*a* to 2*d*, inside views of the siderail apparatus 5 in accordance with an embodiment of the present invention are illustrated for different positions from a fully deployed position (FIG. 2*a*) to a fully stowed position (FIG. 2*d*). It can be clearly identified that the angle formed between each support arm 20 and the bottom edge of the siderail 9 remains substantially obtuse during the rotational movement of the siderail 9. The siderail cover 10 can be made for example from plastic or other synthetic materials which can be molded while the siderail body 14 can be made for example of aluminum, aluminum alloys or any other material with a desired level of strength. These materials are provided solely as examples and the choice of materials used for these parts can vary according to various considerations such as, for example, weight, strength, appearance, durability and sturdiness. Both the siderail cover 10 and the siderail body 14 of the siderail apparatus 5 can be made from the same material and/or integrally formed. The shape of the support arms 20 provides a means for the substantial elimination of pinch points between the support arms and the bottom side of the siderail body.

Figure 8A:
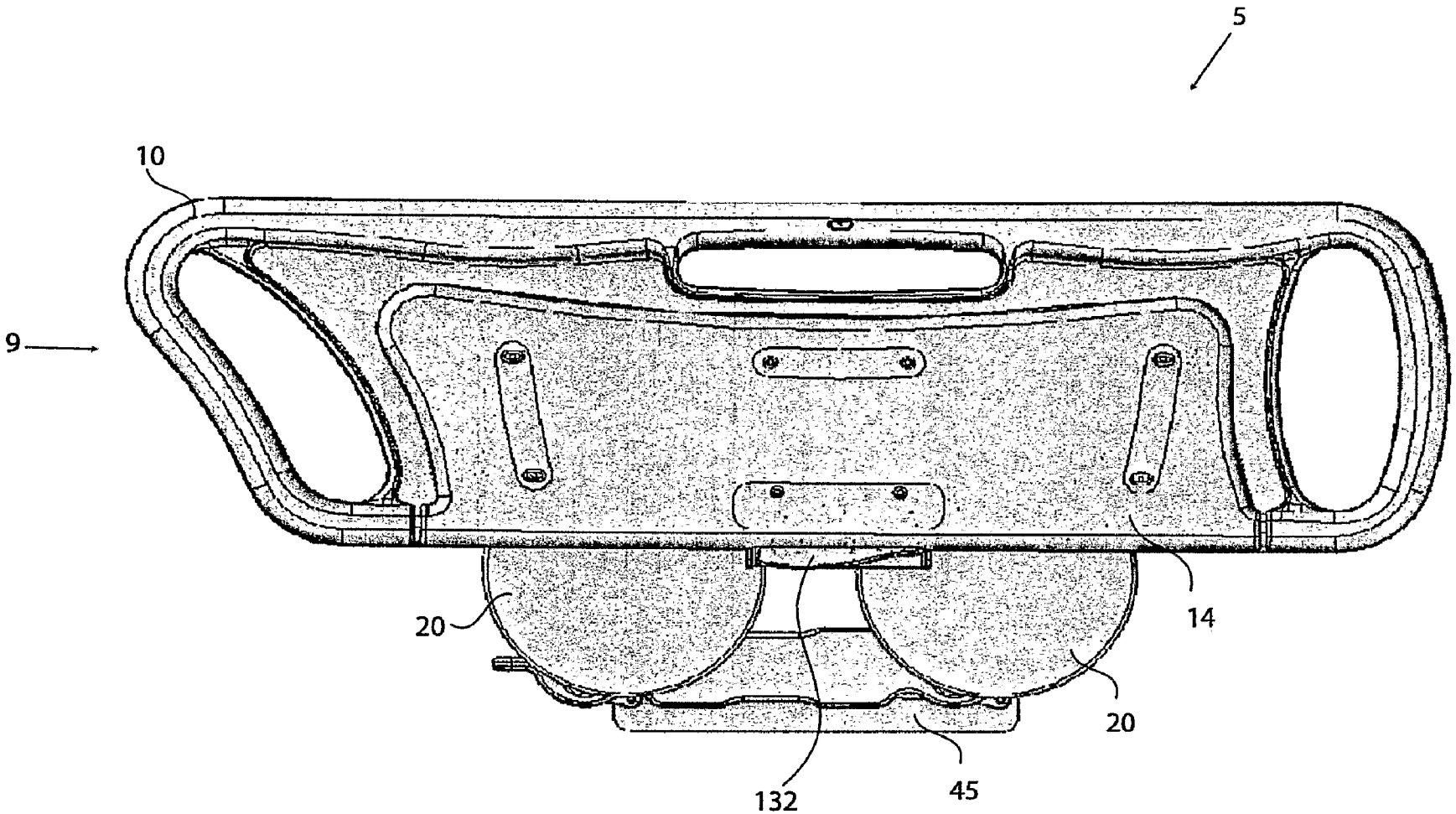
FIG. 8*a* is a side view of a siderail apparatus according to one embodiment of the present invention in a fully deployed position.
Figure 8B:
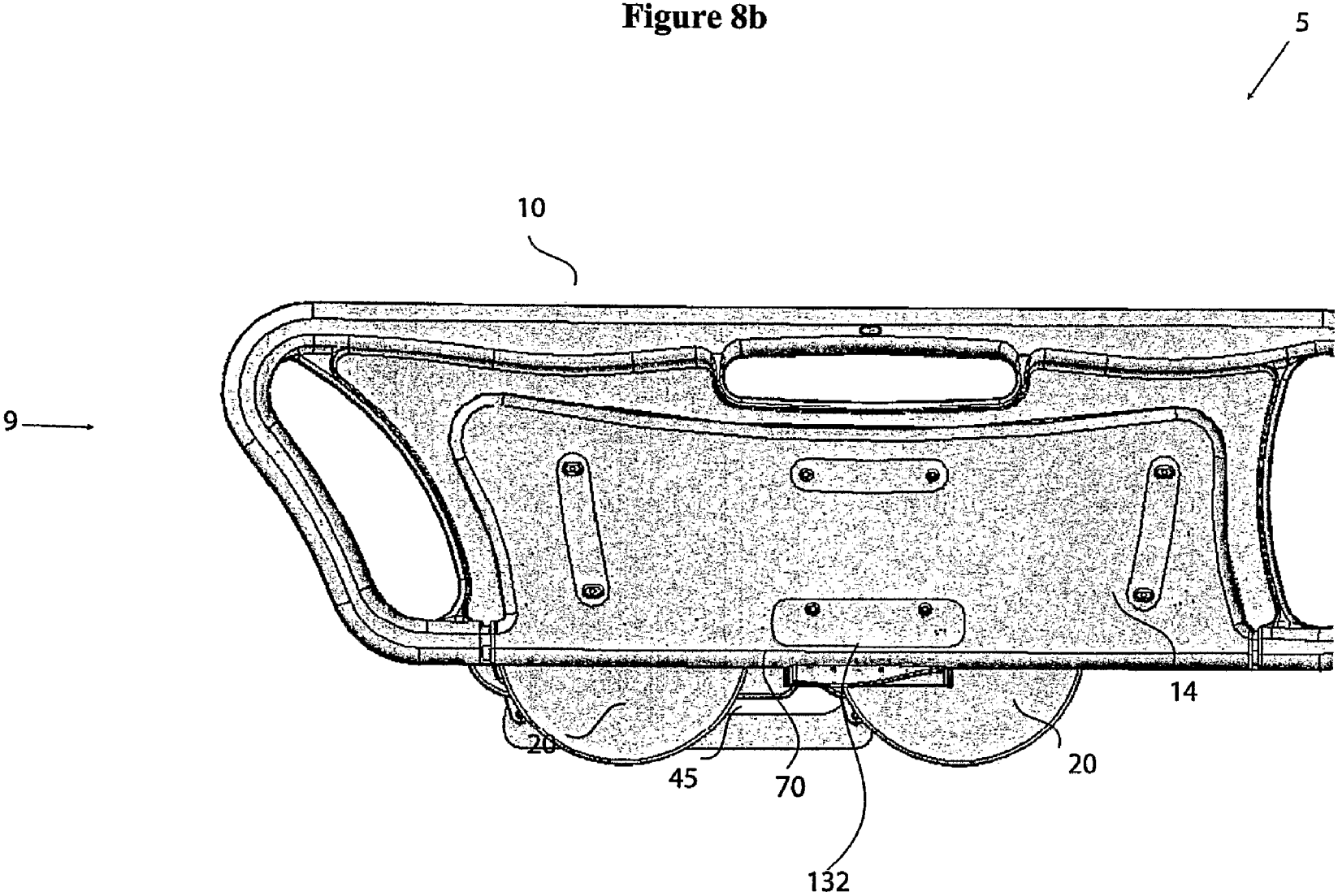
FIG. 8*b* is a side view of a siderail apparatus according to one embodiment of the present invention in a partially deployed position.
Figure 8C:
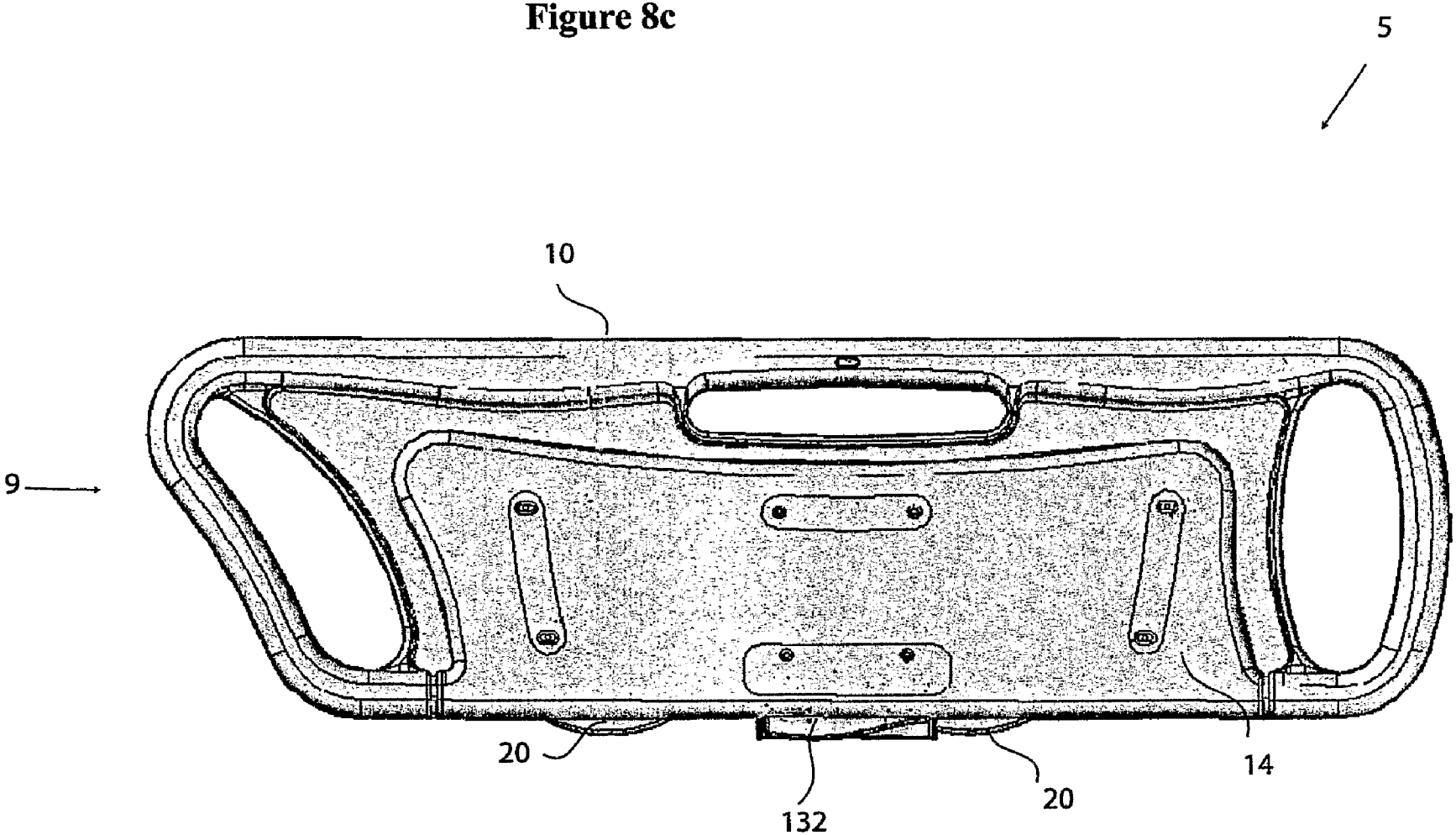
FIG. 8*c* is a side view of a siderail apparatus according to one embodiment of the present invention in a partially stowed position.
Figure 9:
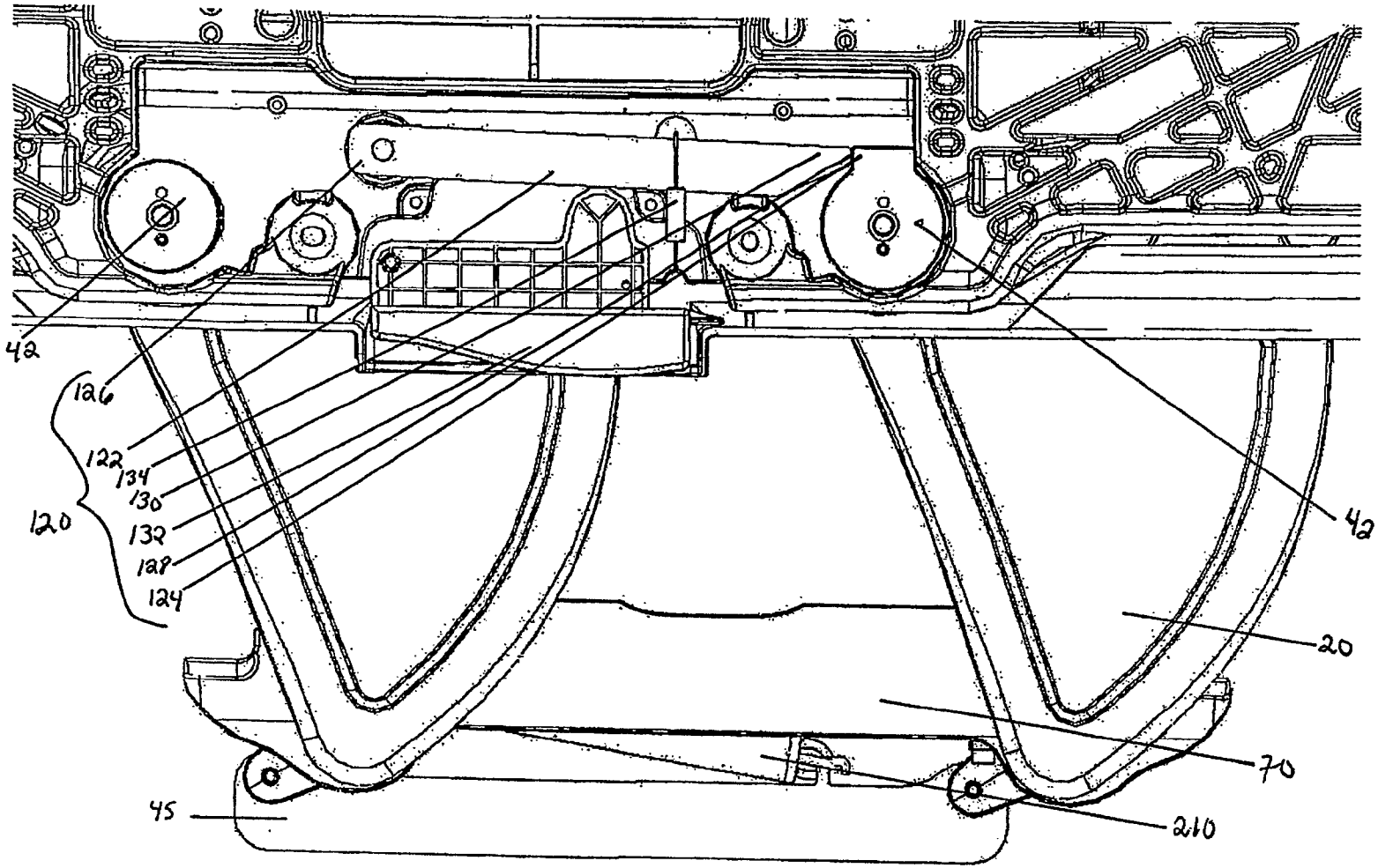
FIG. 9 is a partial detailed view of a siderail apparatus according to another embodiment of the present invention.

Several shapes for the support arms can be used, with the common characteristic that the angle defined by the lower edge of the siderail (or siderail body) and the point of overlap with the support arms remains substantially obtuse during the operation of the siderail apparatus, substantially eliminating pinch points during operation of the siderail apparatus. For example, possible shapes for the support arms are triangular, trapezoidal, round (see for example FIGS. 8*a*, 8*b*, 8*c*), having sides curved in various convex or concave manners (see for example FIG. 1*a*), etc. A worker skill in the art would understand that the measurement of the substantially obtuse angle defined by the lower edge of the siderail (or siderail body) and the supports arms at the point of overlap can be from 90 degrees to 180 degrees, thereby substantially eliminating the possibility of creating pinch-points during operation of the siderail apparatus. Thus, examples of such angles may be 95, 100, 105, 110, 115, 120, 125, 130, 135, 140, 145, 150, 155, 160, 165, 170 and 175 degrees.

In one embodiment of the present invention, to have the desired effect of substantially eliminating pinch points, the location of the connection between the upper ends of the support arms and the upper pivots can also be considered. For example, the connection points between the upper ends of the support arms 20 and the upper pivots 30 have to be proximal to the rotational side 22 of the support arms 20 which faces the rotational movement when the siderail apparatus 5 is moved from the deployed position to the stowed position as illustrated in FIGS. 2*a*, 2*b*, 2*c* and 2*d*.

Figure 4A:
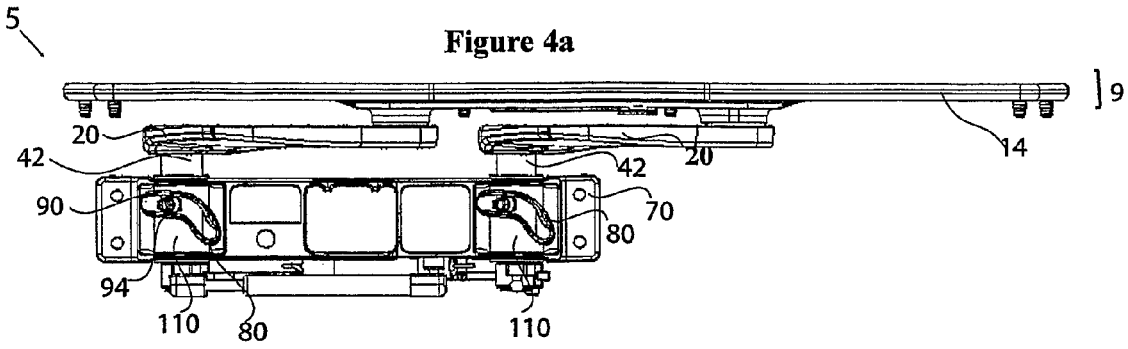
FIG. 4*a* is a top view of the siderail apparatus without the siderail cover in a partially deployed position having two support arms pivotally connected to a cross-member which comprises a guiding mechanism, according to one embodiment of the present invention.
Figure 4B:
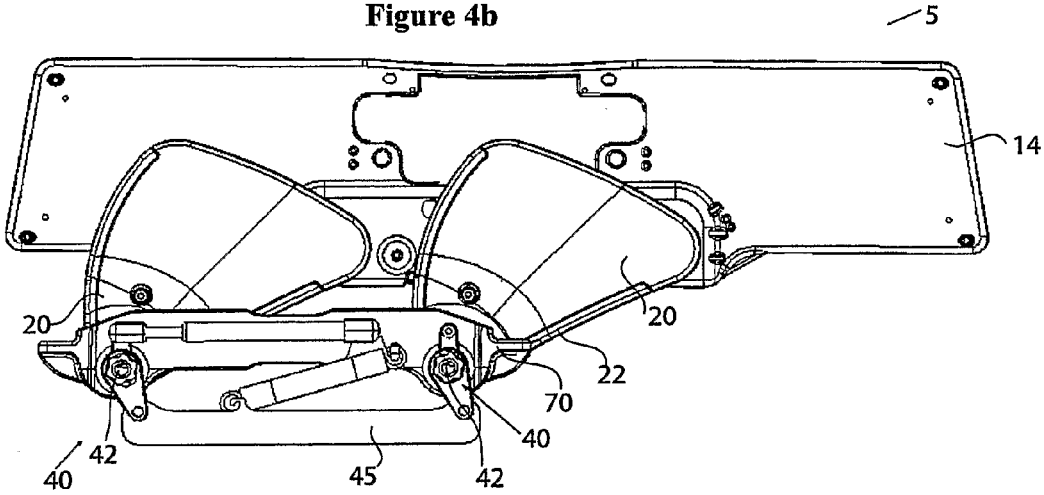
FIG. 4*b* is an inside view of the siderail apparatus without the siderail cover in a partially deployed position having two support arms pivotally connected to a cross-member which comprises a guiding mechanism, according to the embodiment of the present invention illustrated in FIG. 4*a*.
Figure 4C:
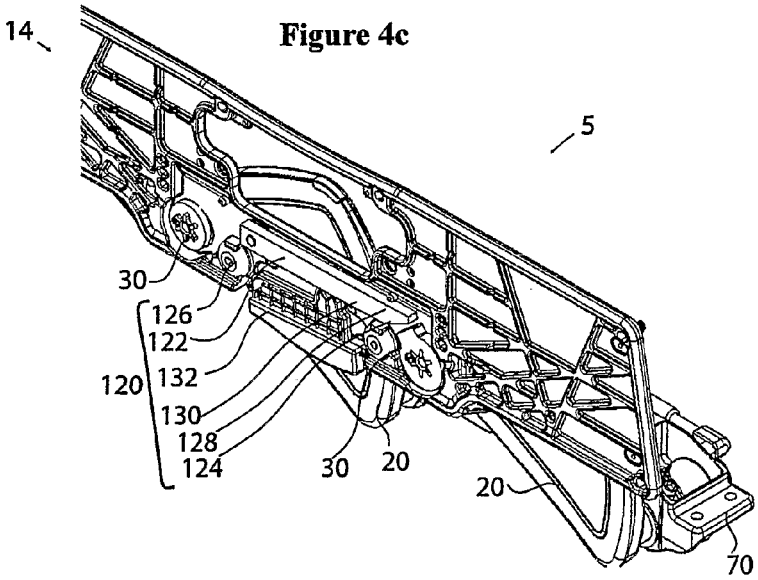
FIG. 4*c* is an outside perspective view of the siderail apparatus without the siderail cover in a partially deployed position having two support arms pivotally connected to a cross-member which comprises a guiding mechanism, according to the embodiment of the present invention illustrated in FIG. 4*a*.
Figure 4C:
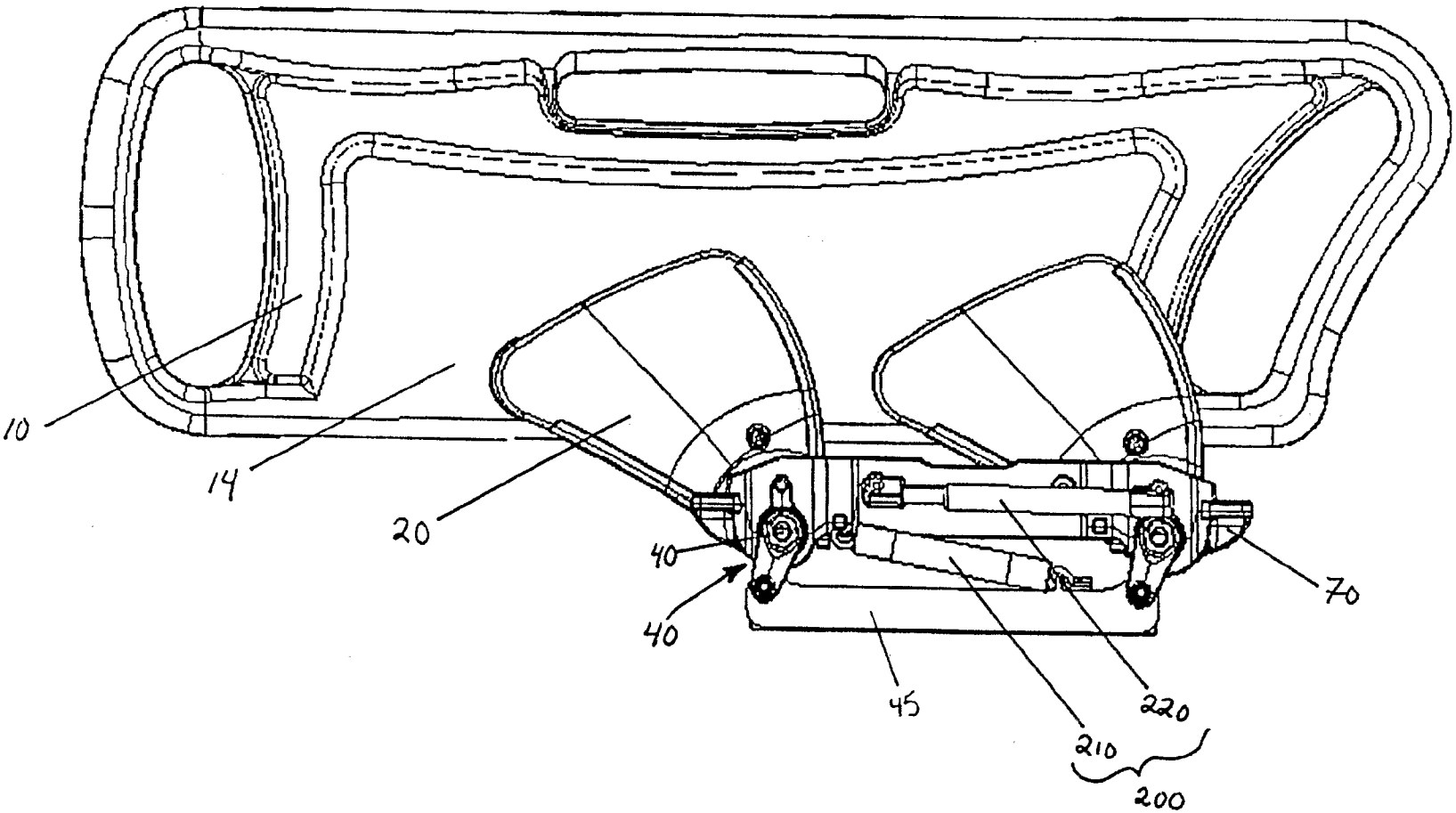
Figure 4D:
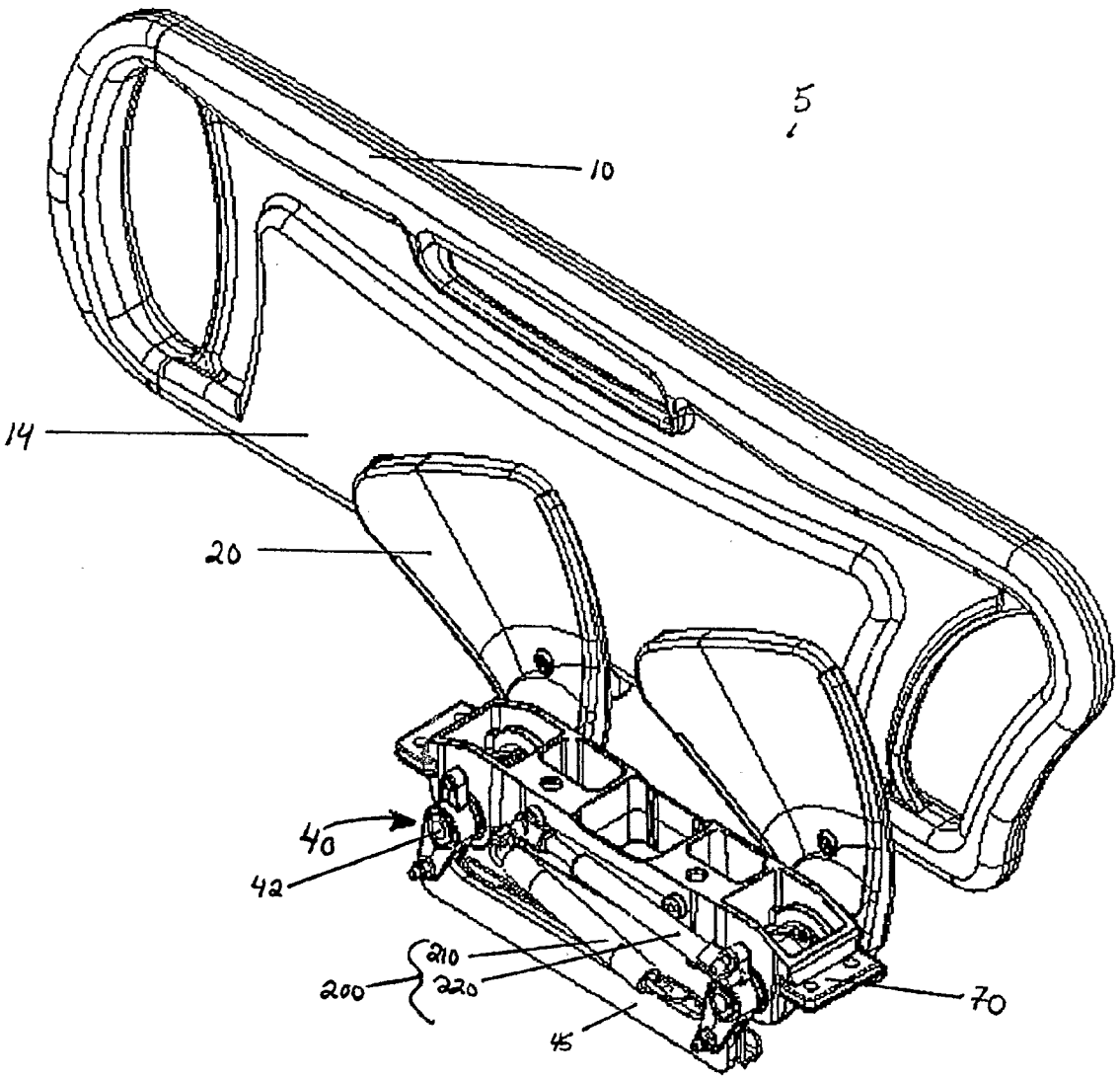
FIG. 4*d* is a perspective inside view of the siderail apparatus in a partially deployed position having two support arms pivotally connected to a cross-member which comprises a guiding mechanism, according to one embodiment of the present invention.
Figure 4F:
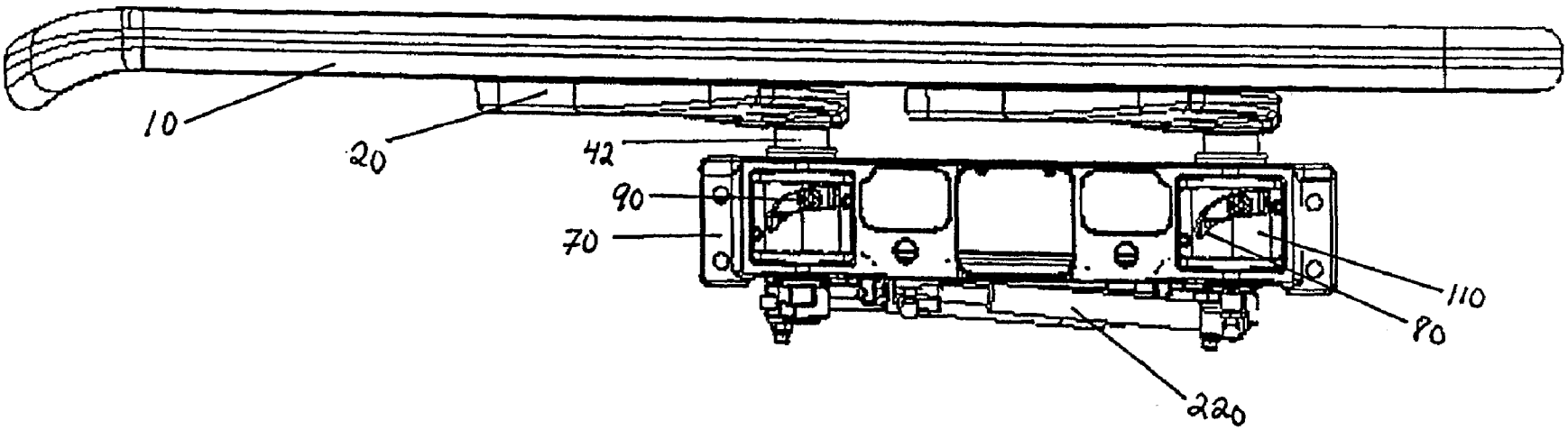
FIG. 4*f* is a top view of the siderail apparatus in a partially deployed position having two support arms pivotally connected to a cross-member which comprises a guiding mechanism, according to one embodiment of the present invention.
Figure 5A:
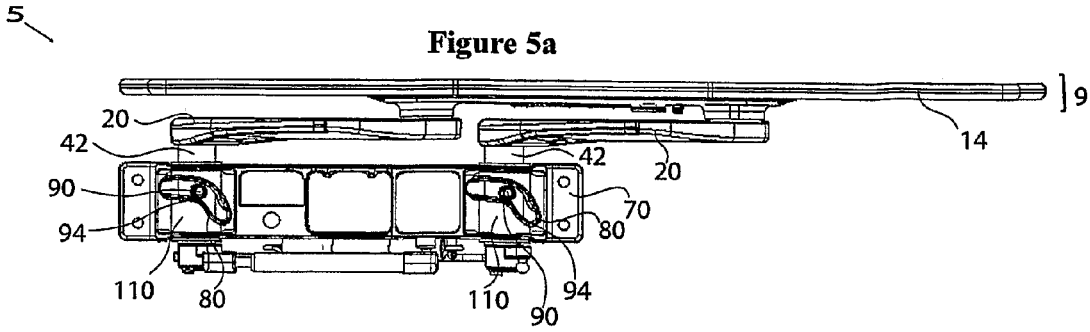
FIG. 5*a* is a top view of the siderail apparatus without the siderail cover in a partially stowed position having two support arms pivotally connected to a cross-member which comprises a guiding mechanism, according to one embodiment of the present invention.
Figure 5B:
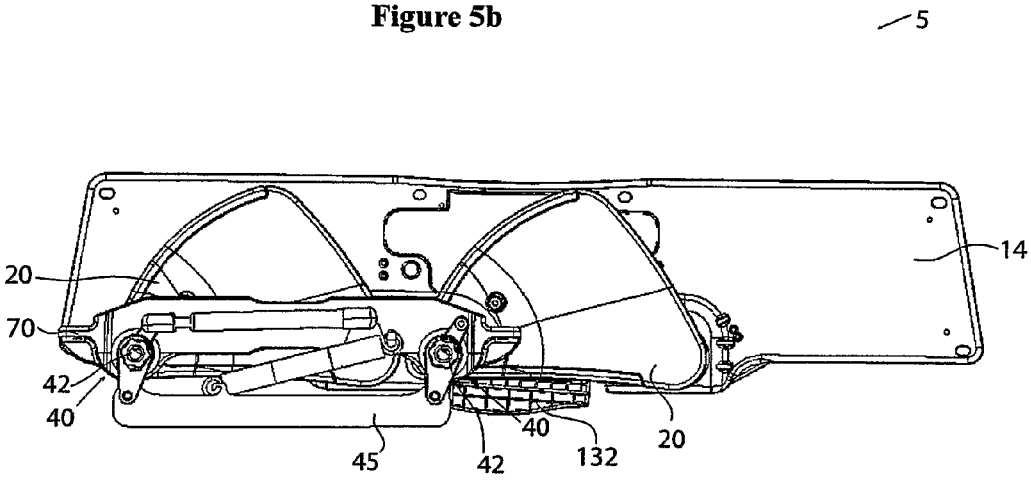
FIG. 5*b* is an inside view of the siderail apparatus without the siderail cover in a partially stowed position having two support arms pivotally connected to a cross-member which comprises a guiding mechanism, according to the embodiment of the present invention illustrated in FIG. 5*a*.
Figure 5C:
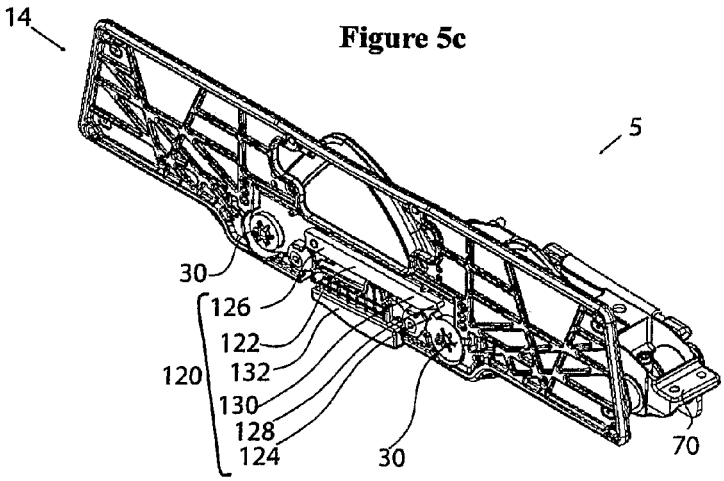
FIG. 5*c* is an outside perspective view of the siderail apparatus without the siderail cover in a partially stowed position having two support arms pivotally connected to a cross-member which comprises a guiding mechanism, according to the embodiment of the present invention illustrated in FIG. 5*a*.
Figure 5D:
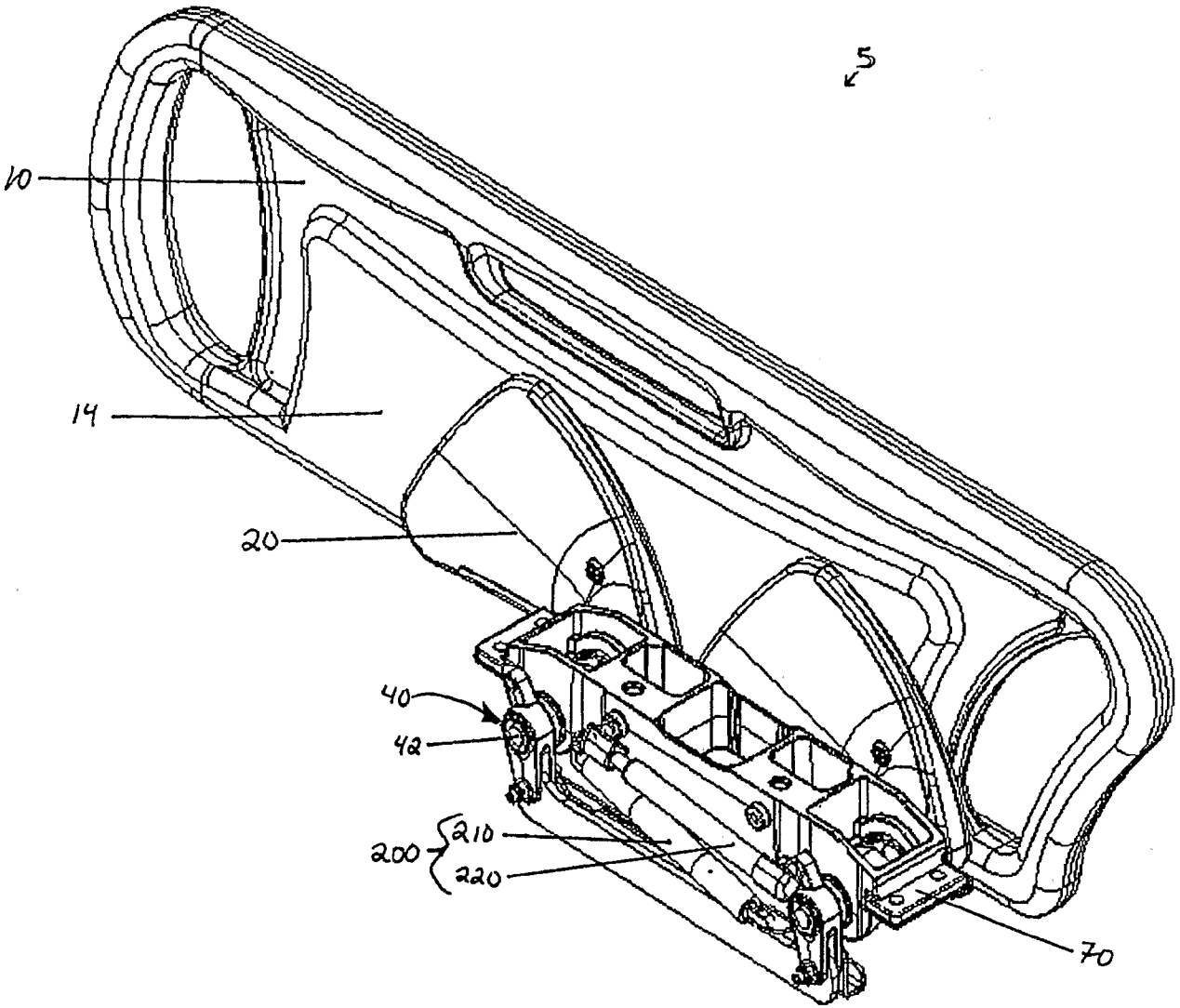
FIG. 5*d* is a perspective inside view of the siderail apparatus in a partially stowed position having two support arms pivotally connected to a cross-member which comprises a guiding mechanism, according to one embodiment of the present invention.
Figure 5E:
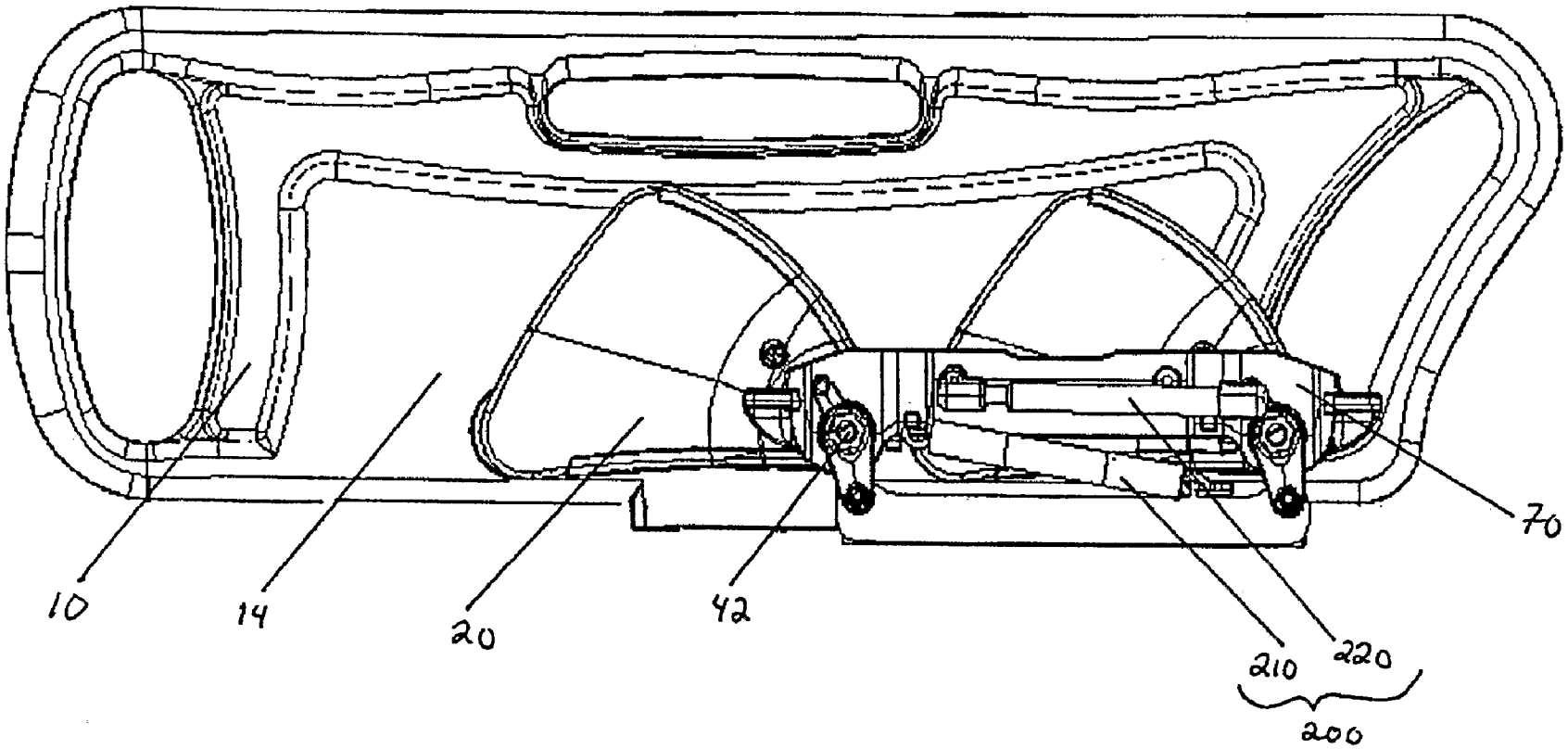
FIG. 5*e* is an inside view of the siderail apparatus in a partially stowed position having two support arms pivotally connected to a cross-member which comprises a guiding mechanism, according to one embodiment of the present invention.
Figure 5F:
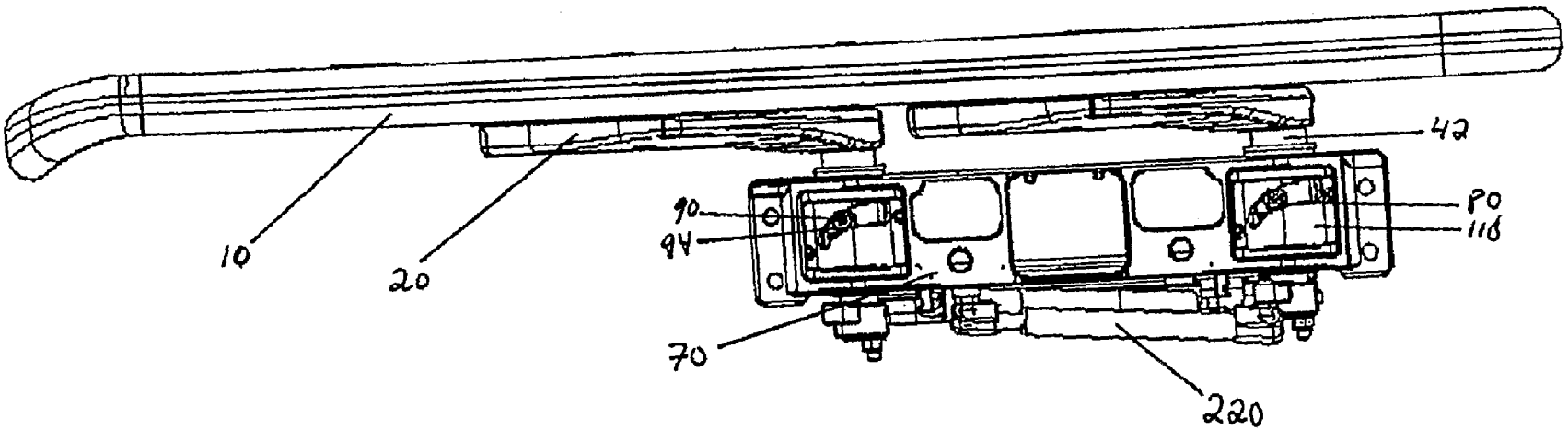
FIG. 5*f* is a top view of the siderail apparatus in a partially stowed position having two support arms pivotally connected to a cross-member which comprises a guiding mechanism, according to one embodiment of the present invention.

FIGS. 4*b* and 5*b* are detailed inside views of the siderail apparatus 5 illustrated respectively in FIGS. 4*a* and 5*a*. The angle formed by the bottom edge of the siderail 9 and the support arms 20 remains substantially obtuse until it is eliminated when the siderail 9 (not shown in these figures) is lowered to a point where the upper pivots 30 are substantially aligned horizontally to the lower pivots 40. This illustrates how the siderail body 14 can be moved laterally towards and away from the center of the patient support apparatus in order to minimize the width of the patient support apparatus when not in use and conversely maximize the patient's lying surface area when in use. Also, the vertical and lateral movement of the siderail 9 (not shown in these figures) takes place through a single movement during operation of the siderail apparatus 5, thereby decreasing the effort and separate actions required for operation of the siderail apparatus 5.

Figure 16A:
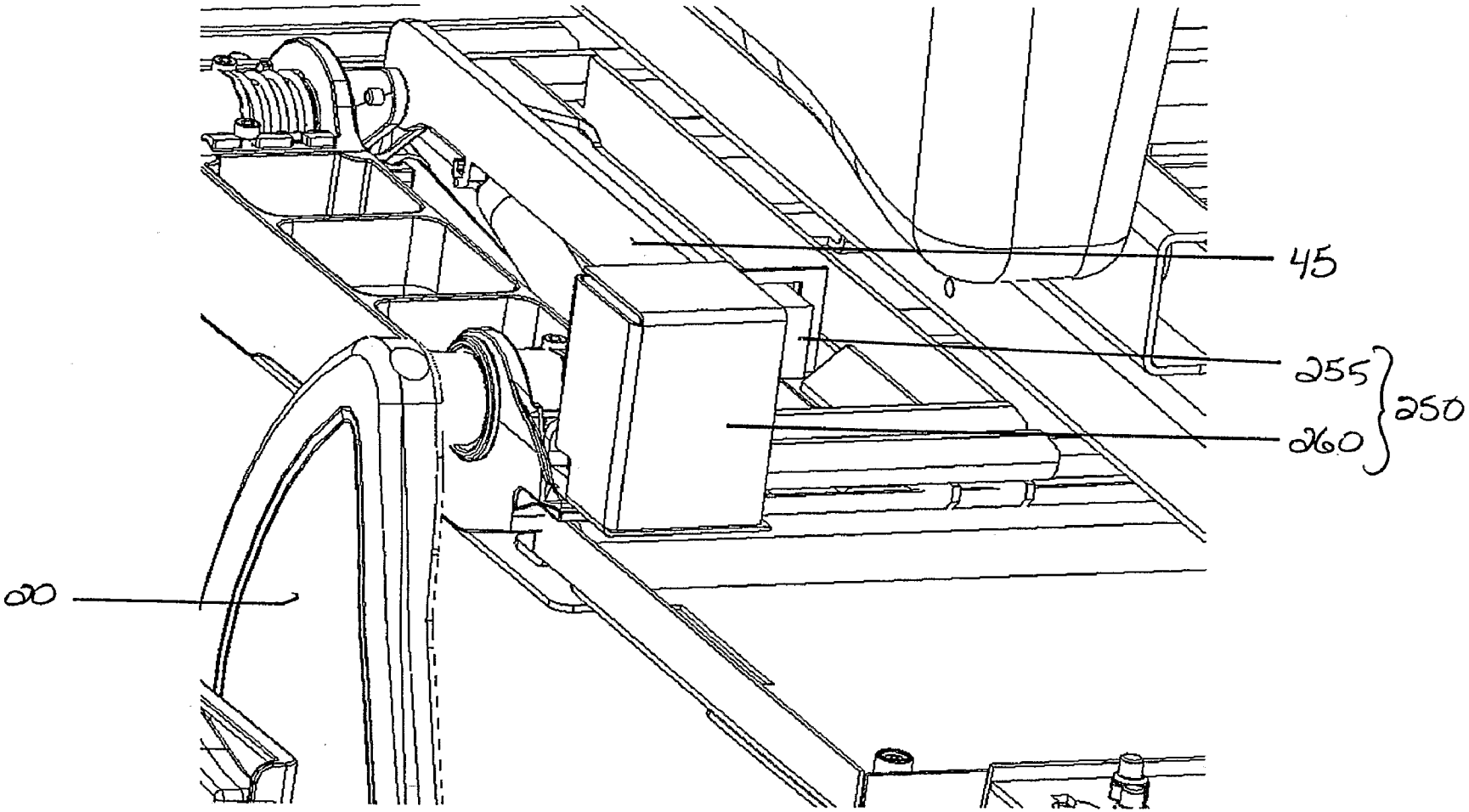
FIG. 16*a* is a perspective view of a siderail apparatus according to one embodiment of the present invention in a fully deployed position showing the detector mechanism coupled to the foot section of the frame system of a patient support apparatus.
Figure 16B:
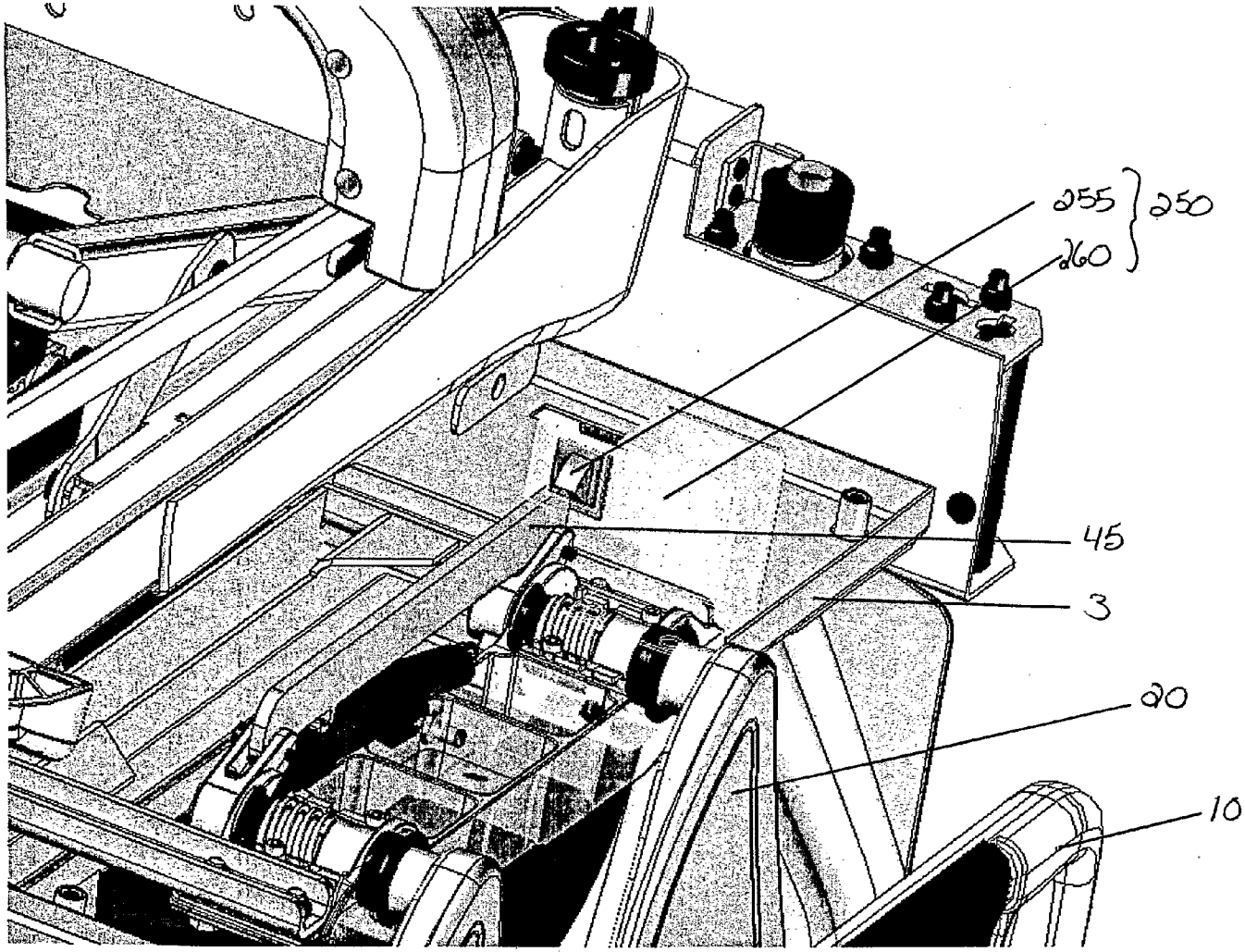
FIG. 16*b* is a perspective view of a siderail apparatus according to one embodiment of the present invention in a fully deployed position showing the detector mechanism coupled to the foot section of the frame system of a patient support apparatus.
Figure 16C:
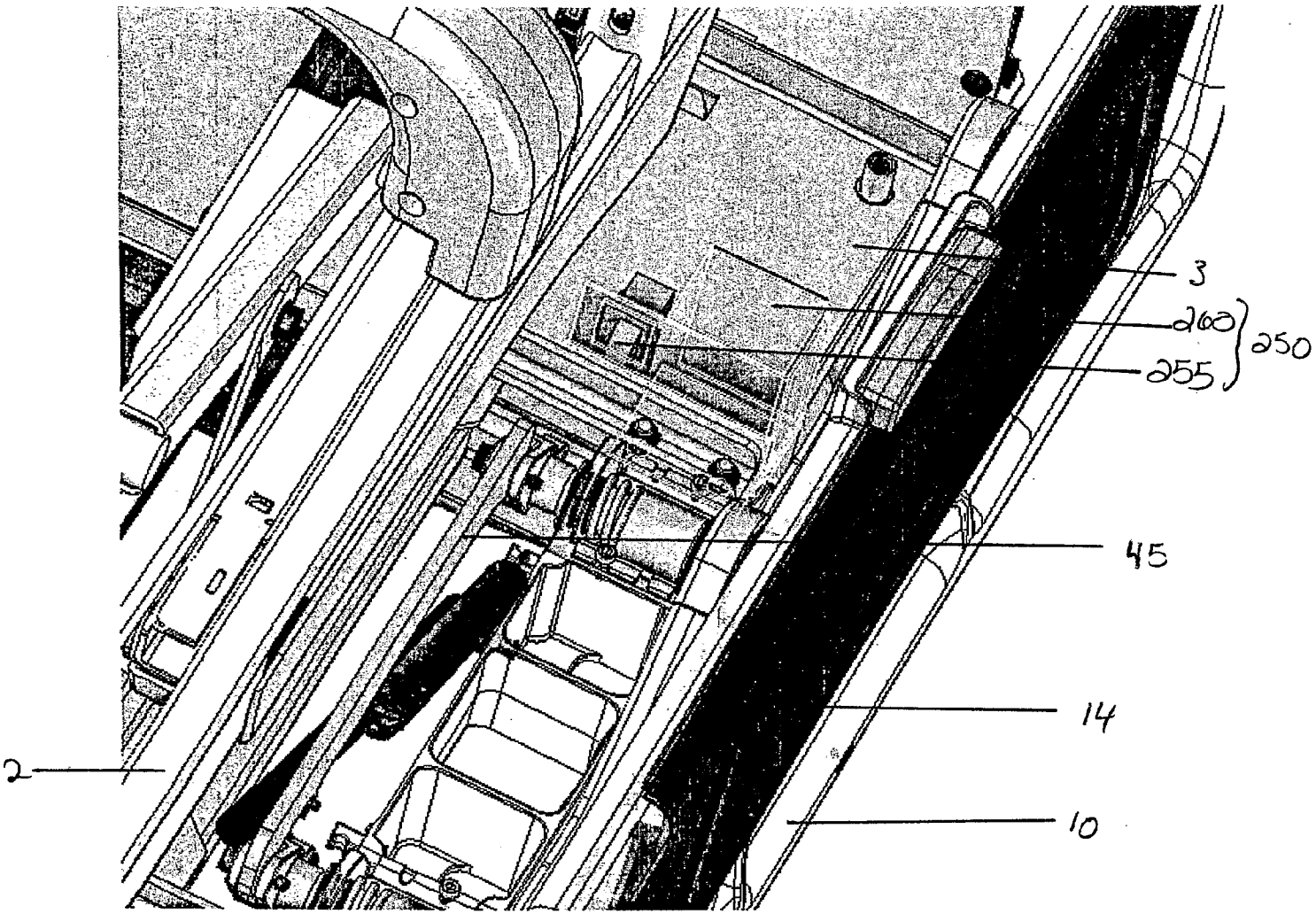
FIG. 16*c* is a perspective view of a siderail apparatus according to one embodiment of the present invention in a fully stowed position showing the detector mechanism coupled to the foot section of the frame system of a patient support apparatus.
Figure 16D:
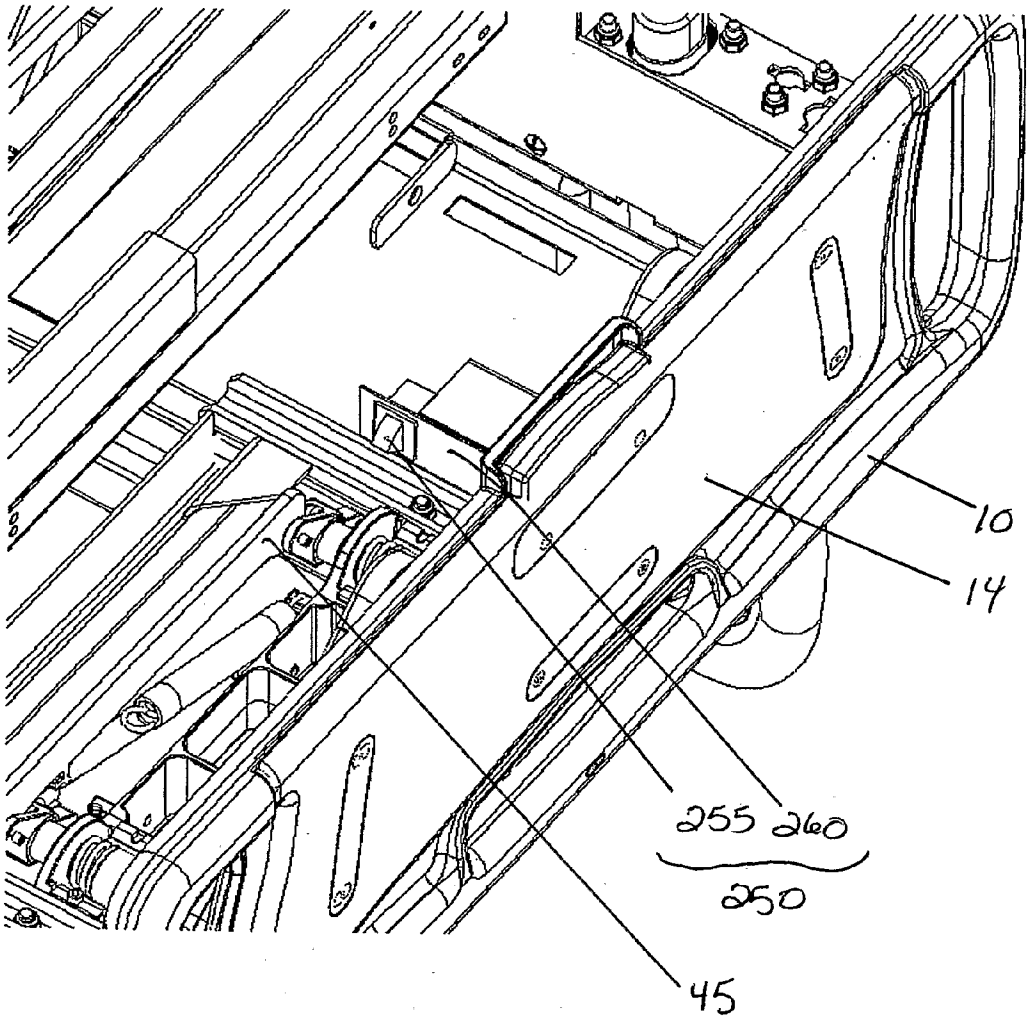
FIG. 16*d* is a perspective view of a siderail apparatus according to one embodiment of the present invention in a fully stowed position showing the detector mechanism coupled to the foot section of the frame system of a patient support apparatus.
Figure 16E:
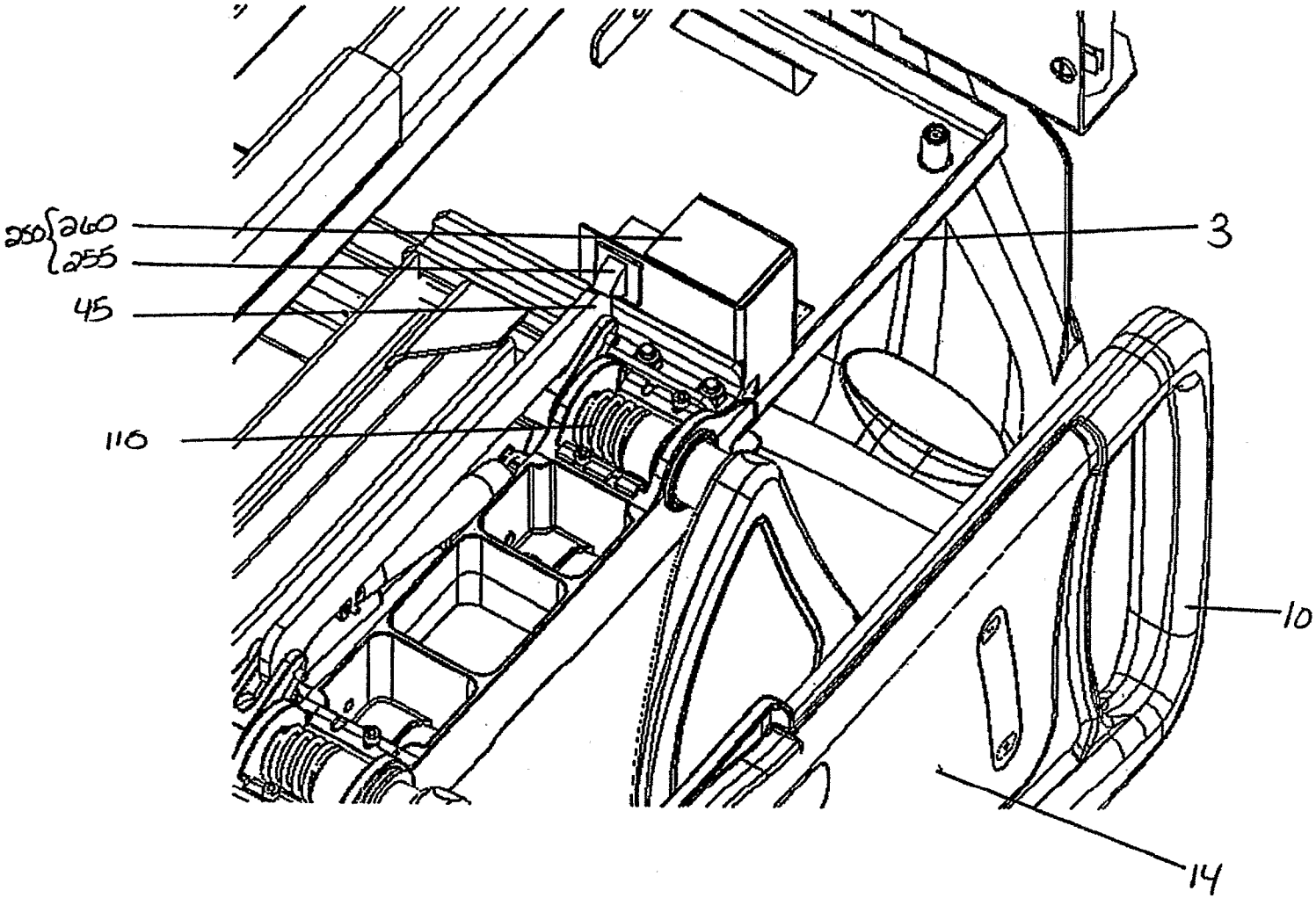
FIG. 16*e* is a perspective view of a siderail apparatus according to one embodiment of the present invention in a fully deployed position showing the detector mechanism coupled to the foot section of the frame system of a patient support apparatus.
Figure 17:
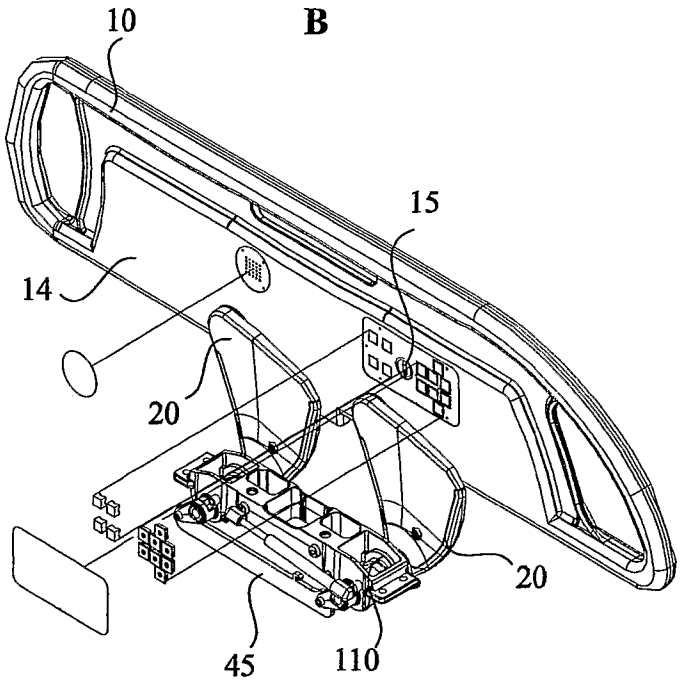
FIGS. 17*a* and 17*b* are perspective internal views of right and left head-end siderail apparatuses according to one embodiment of the present invention, wherein the siderail control system is shown in an exploded view.
Figure 17:
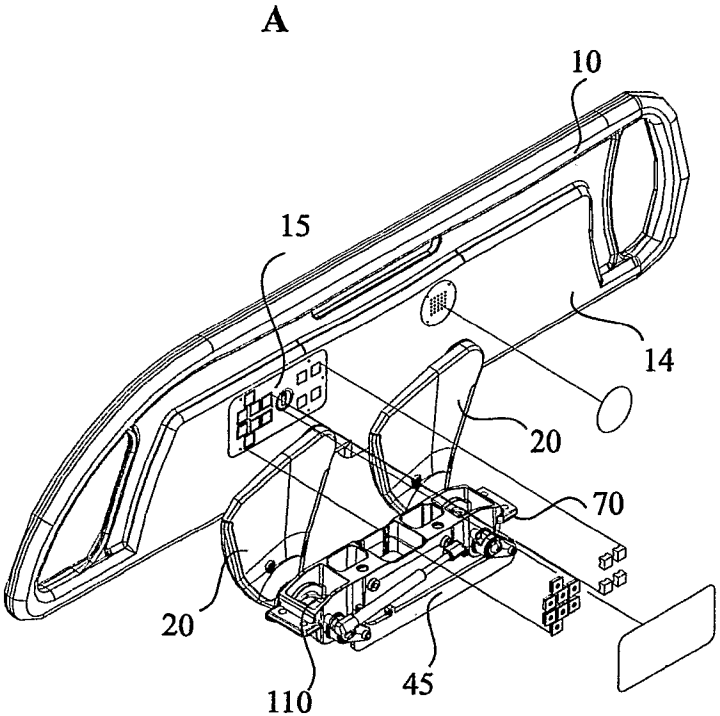
Figure 18:
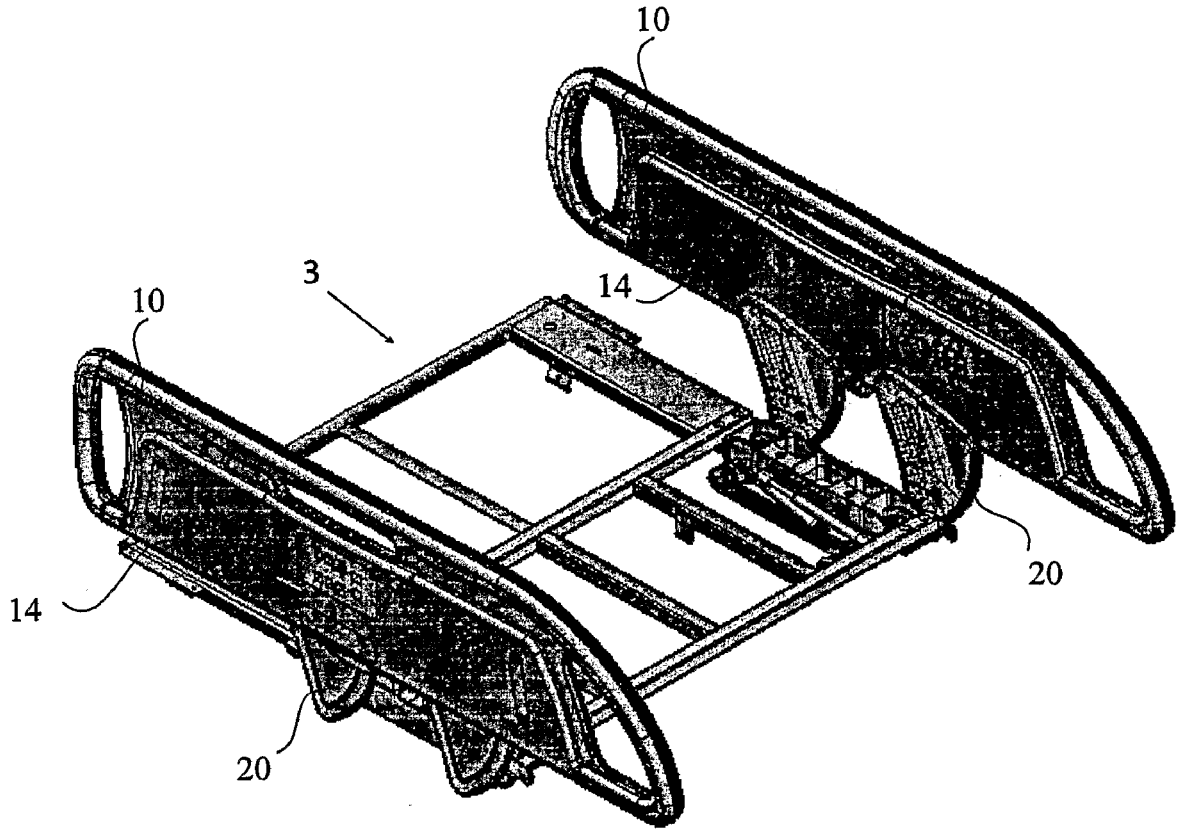
FIG. 18 is a perspective view of the head-end siderail apparatus according to one embodiment of the present invention in a fully deployed position attached to a frame system.
Figure 19:
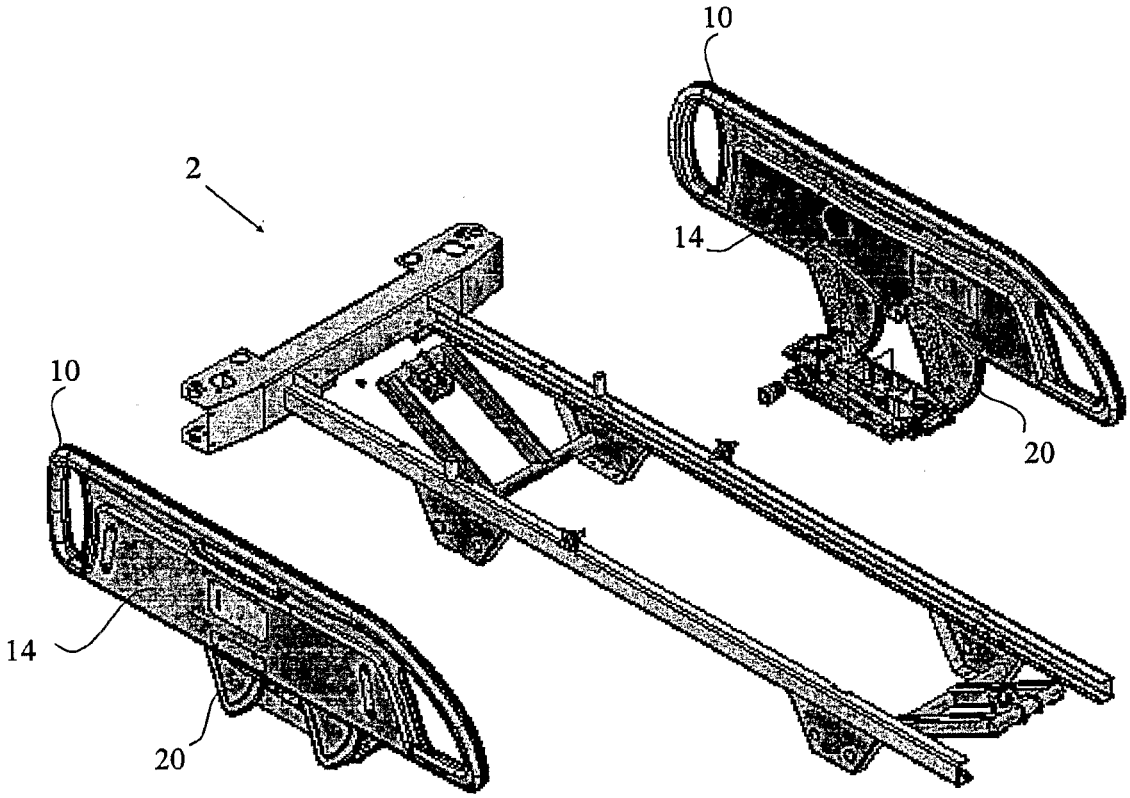
FIG. 19 is a perspective view of the head-end siderail apparatus according to one embodiment of the present invention in a fully deployed position relative to a frame system.
Figure 20:
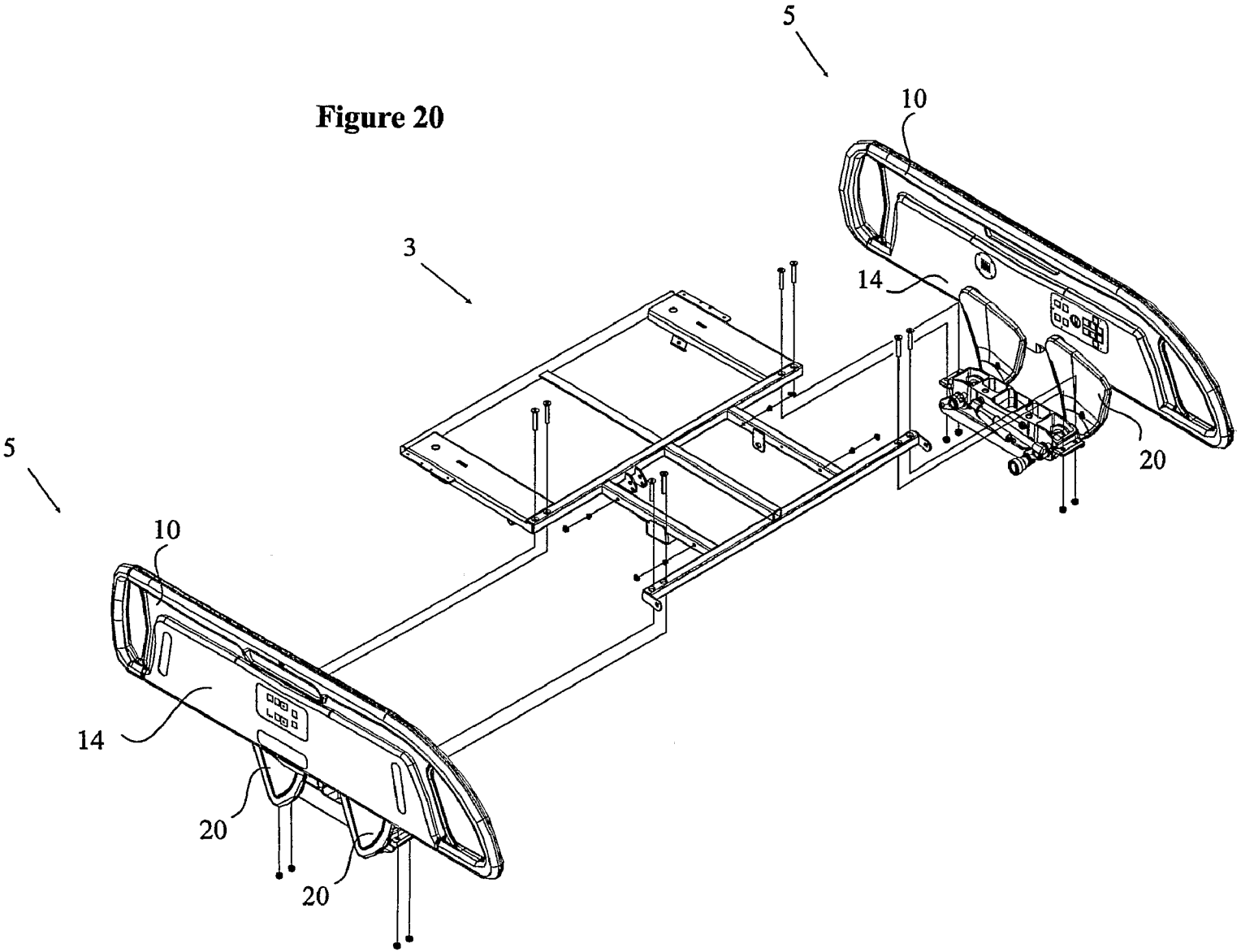
FIG. 20 is a exploded view of the position of the head-end siderail apparatus according to one embodiment of the present invention in a fully deployed position attached to a frame system.
Figure 21:
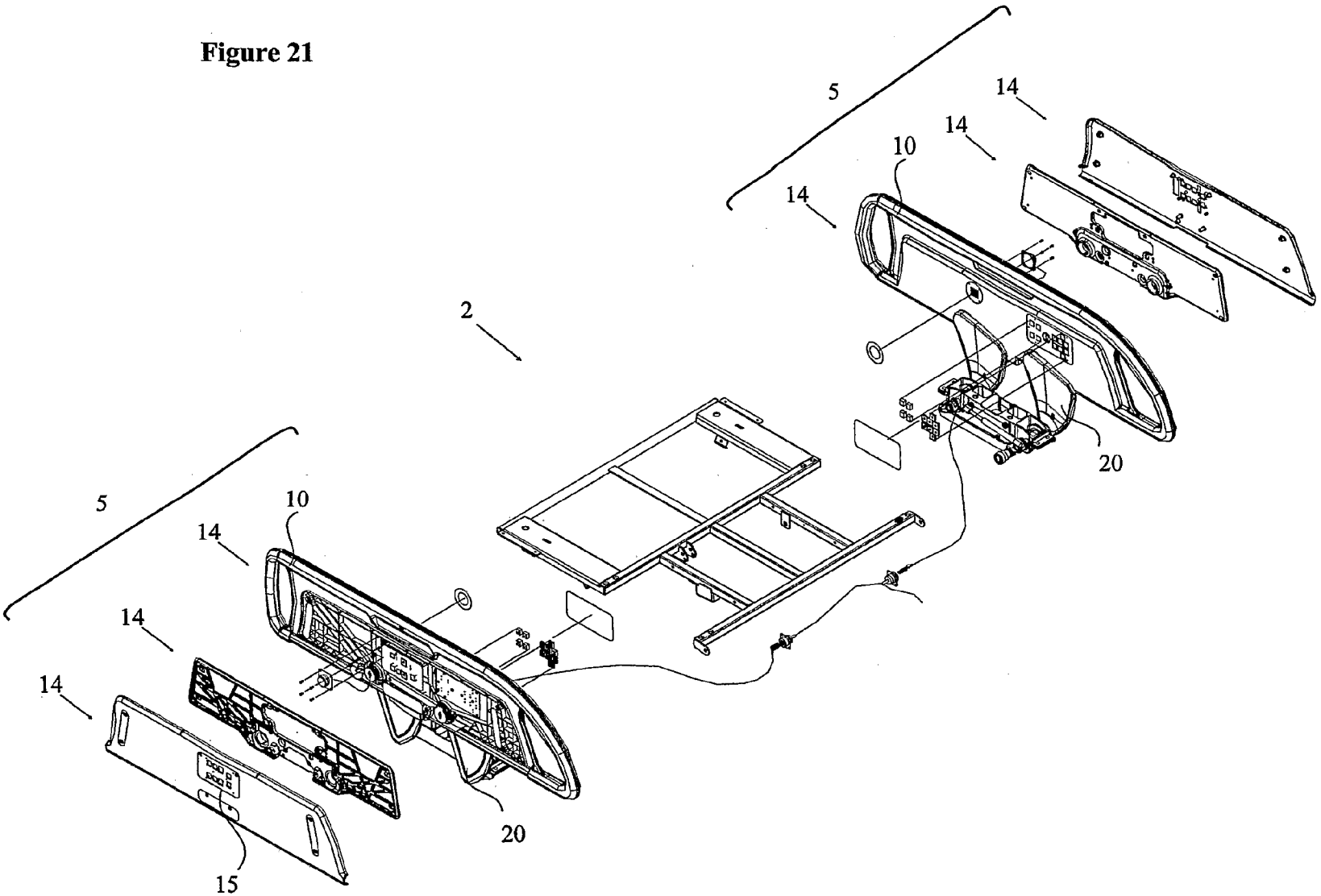
FIG. 21 is a perspective view of the head-end siderail apparatus according to one embodiment of the present invention showing the head-end siderail apparatus in a fully deployed position exploded away from a frame system.
Figure 22:
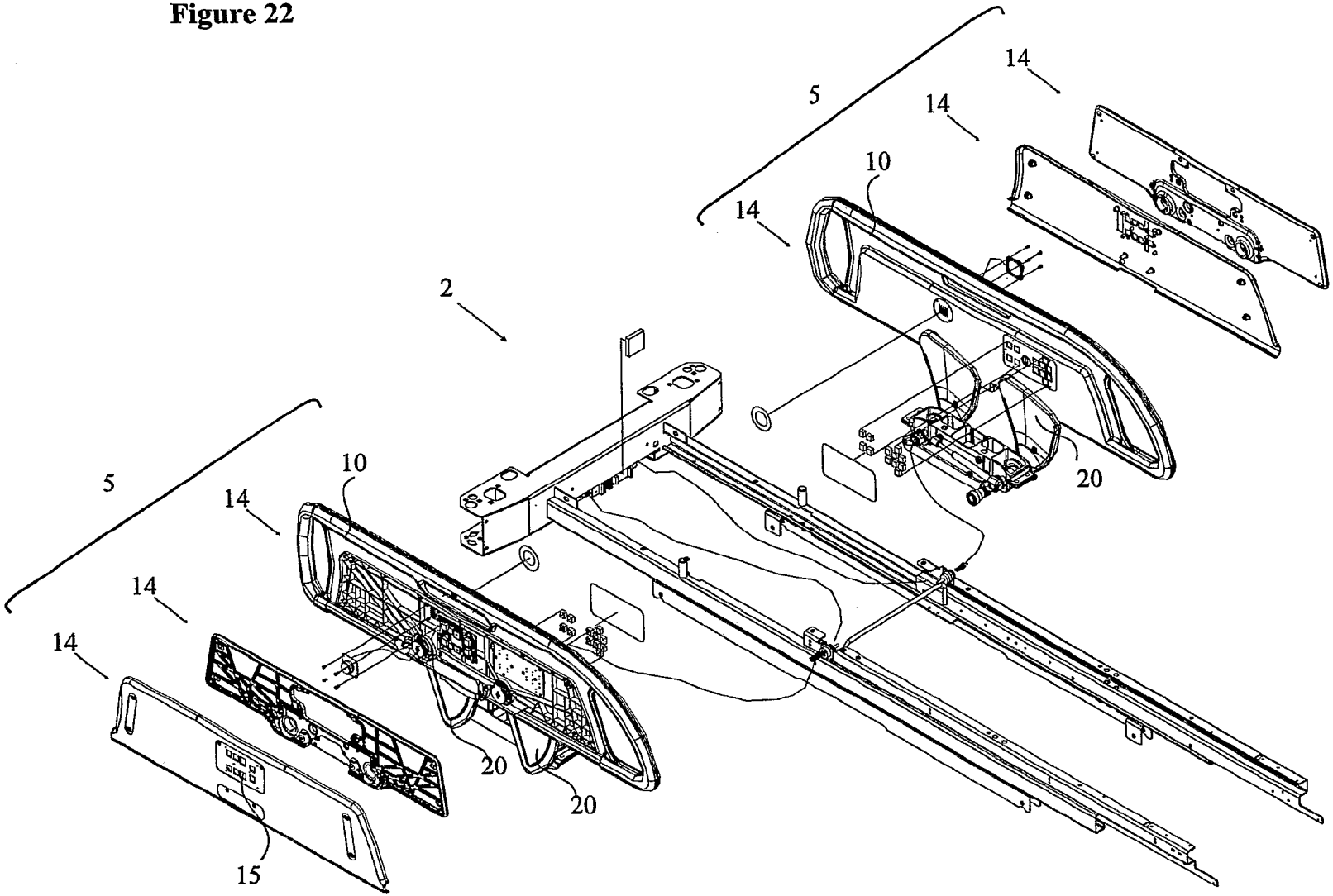
FIG. 22 is a perspective view of the head-end siderail apparatus according to one embodiment of the present invention showing the head-end siderail apparatus components and control system exploded away from the head-end siderail apparatus relative to the frame system of FIG. 19.

FIG. 17 illustrates a three dimensional inside view of one embodiment of the siderail apparatus 5 according to one embodiment of the present invention. The siderail body 14 is connected to two support arms 20 through two respective upper pivots 30. Two respective lower pivots 40 are used to connect the other ends of the two support arms 20 to a cross-member 70. The shape of the support arms 20 is an example of the configuration designed to substantially avoid the creation of pinch points between the support arms 20 and the lower edge of the siderail body 14 during movement of the siderail apparatus 5. A siderail control panel 15 is coupled to the siderail body 14. The control panel 15 can be located on the inside or outside of the siderail body 14. In one embodiment of the present invention, the control panel 15 is configured to receive output signals from a siderail detector mechanism 250 (e.g. FIG. 16*b*) and displays the relative position of the siderail 9. The output signal is either that the siderail 9 is in a fully deployed position (for example a locked position) or a partially deployed, partially stowed or fully stowed position (for example unlocked positions). The control panel on the inside and the outside of the siderail 9 can further include functions such as raising parts of the patient support apparatus. The control panel 15 on the inside of the siderail further include a nurse call and optional communications package (includes controls for room lighting, reading light, and power and volume buttons for external television and radio systems).

Figure 23:
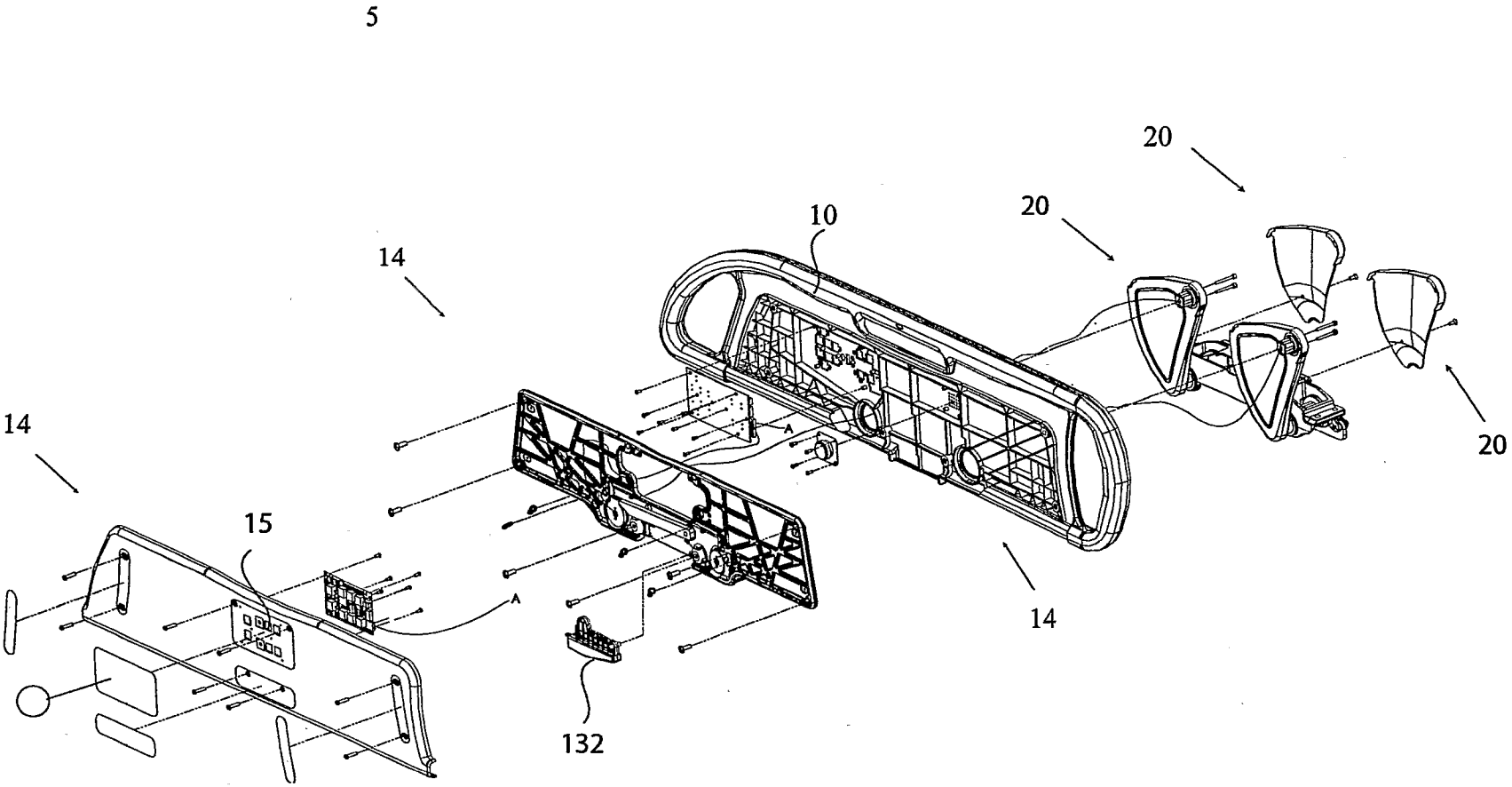
FIG. 23 is an exploded view of the foot-end siderail apparatus components, control system and support arms according to one embodiment of the present invention.

FIG. 23 is an exploded view of the siderail apparatus 5 components, control system 15 and support arms 20 according to one embodiment of the present invention. The siderail body 14 is connected to two support arms 20 through two respective upper pivots 30. The shape of the support arms 20 is an example of the configuration designed to substantially avoid the creation of pinch points between the support arms 20 and the lower edge of the siderail body 14 during movement of the siderail apparatus 5. A siderail control panel 15 is coupled to the outside siderail body 14. In one embodiment of the present invention, the control panel 15 is configured to receive output signals from siderail detector mechanism 250 and displays the relative position of the siderail 9. The output signal is either that the siderail body 14 is in a fully deployed position (for example a locked position) or a partially deployed, partially stowed or fully stowed position (for example unlocked positions). The control panel 15 can further include functions such as raising parts of the patient support apparatus.

Guiding Mechanism

A guiding mechanism is provided which is associated with the cross-member, wherein the guiding mechanism is configured to transversally move the siderail body relative the longitudinal axis of the patient support apparatus during rotational movement of the siderail apparatus. The guiding mechanism comprises one or more radial protrusions and one or more corresponding guiding grooves. The radial protrusions can be located on the lower pivots and the guiding grooves on the cross-member or conversely the radial protrusions can be located on the cross-member and the guiding grooves on the lower pivots. The shape of the grooves can be straight, angled, curved or any combination thereof, depending on the desired transversal movement. Bearing assemblies or other friction reducing mechanism can be used within the guiding mechanism.

Figure 3A:
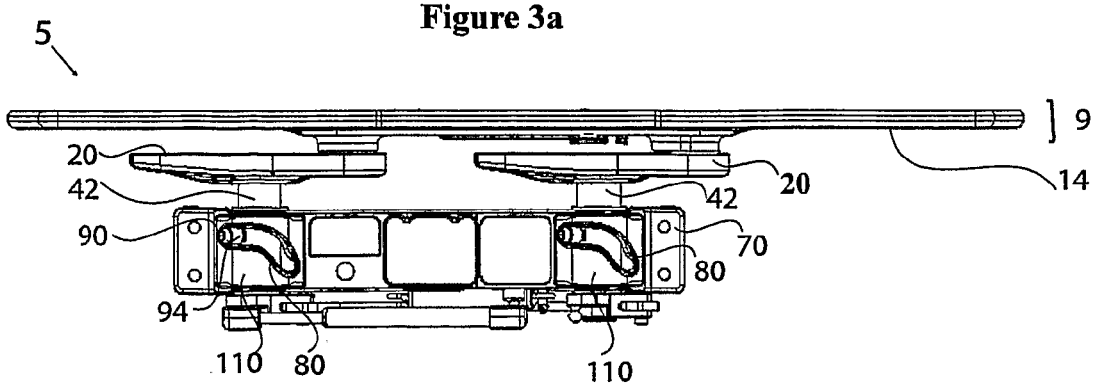
FIG. 3*a* is a top view of the siderail apparatus without the siderail cover in a fully deployed position having two support arms pivotally connected to a cross-member which comprises a guiding mechanism, according to one embodiment of the present invention.
Figure 3B:
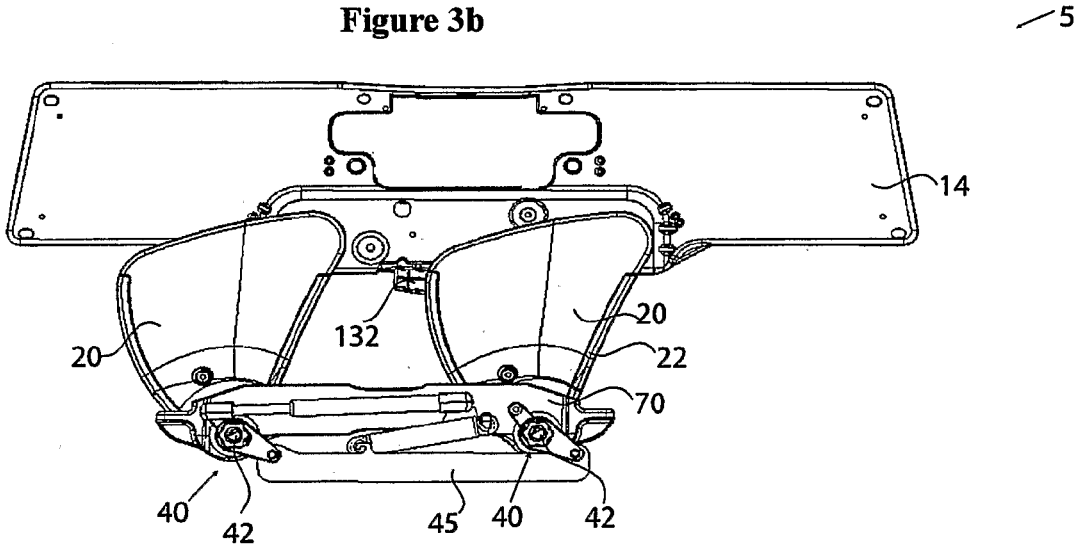
FIG. 3*b* is an inside view of the siderail apparatus without the siderail cover in a fully deployed position having two support arms pivotally connected to a cross-member which comprises a guiding mechanism, according to the embodiment of the present invention illustrated in FIG. 3*a*.
Figure 3C:
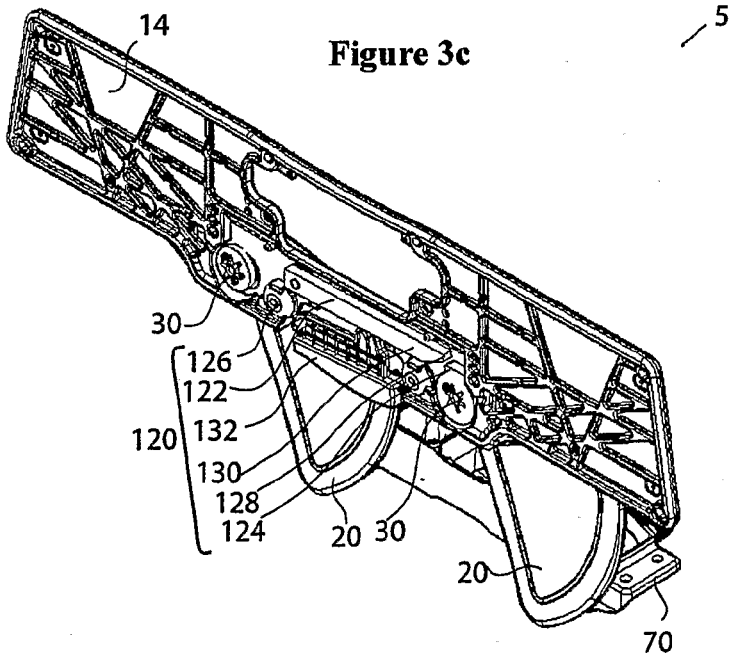
FIG. 3*c* is an outside perspective view of the siderail apparatus without the siderail cover in a fully deployed position having two support arms pivotally connected to a cross-member which comprises a guiding mechanism, according to the embodiment of the present invention illustrated in FIG. 3*a*.
Figure 3D:
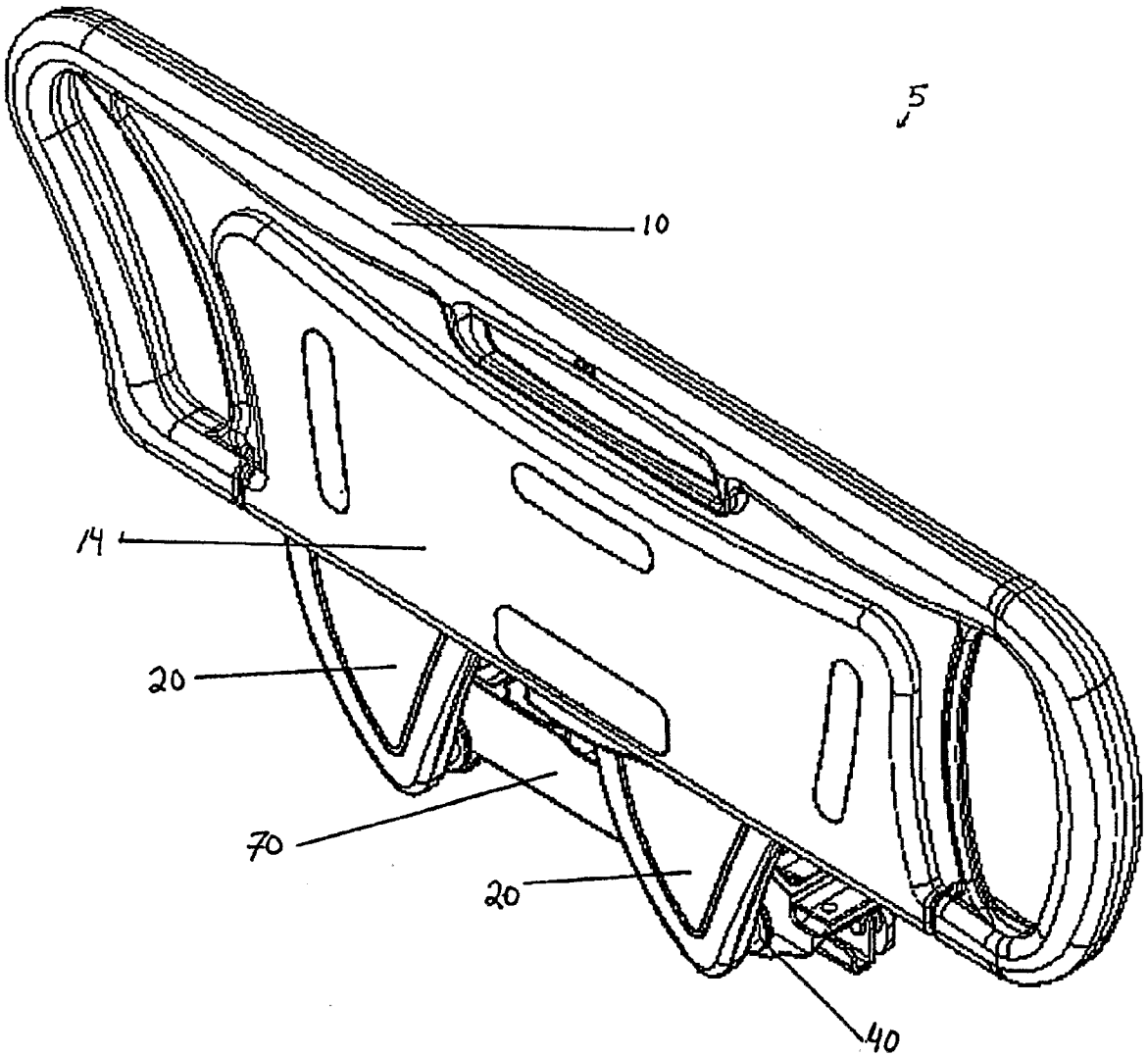
FIG. 3*d* is a perspective outside view of the siderail apparatus in a fully deployed position having two support arms pivotally connected to a cross-member which comprises a guiding mechanism, according to one embodiment of the present invention.
Figure 3E:
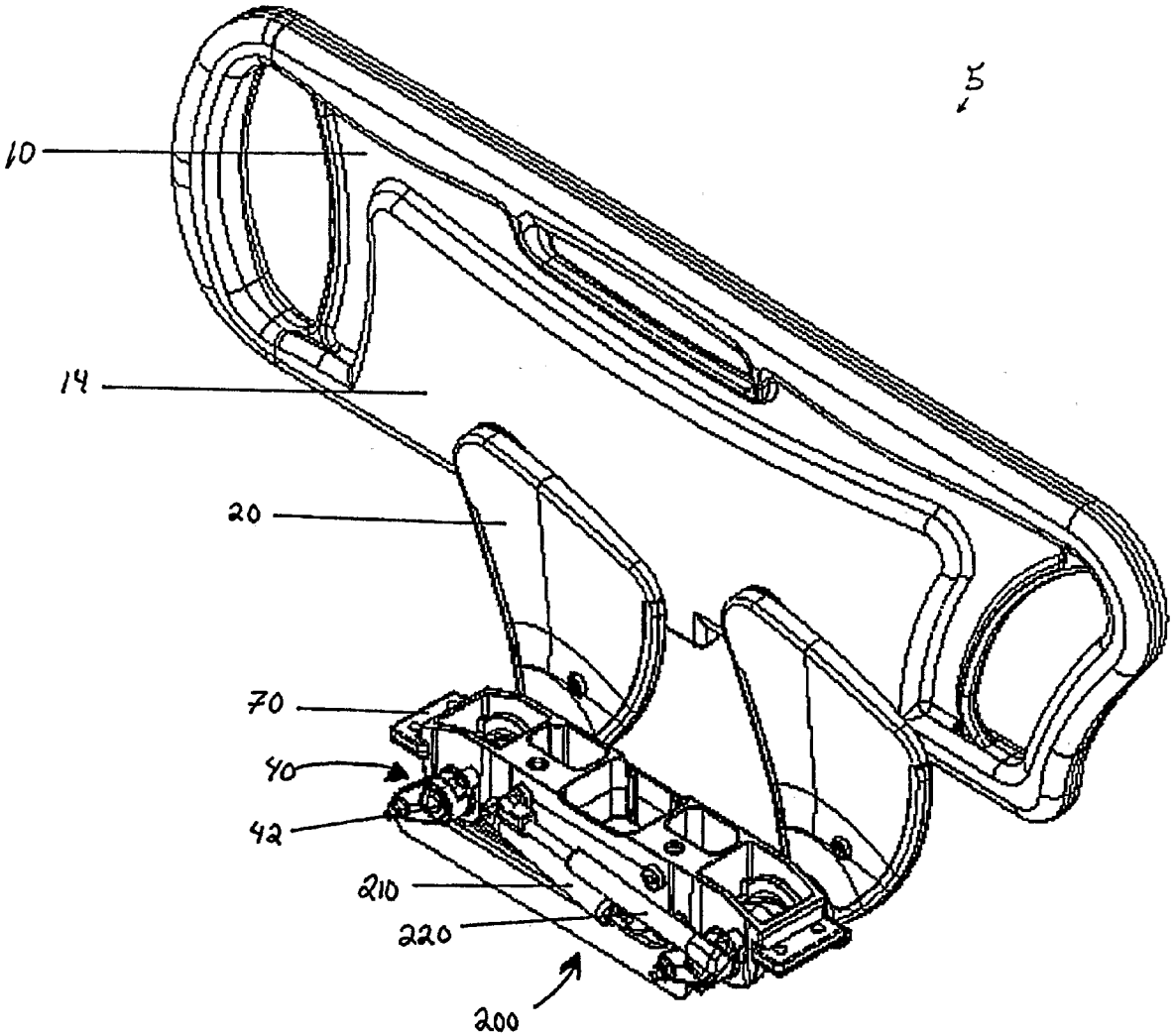
FIG. 3*e* is a perspective inside view of the siderail apparatus in a fully deployed position having two support arms pivotally connected to a cross-member which comprises a guiding mechanism, according to one embodiment of the present invention.
Figure 3F:
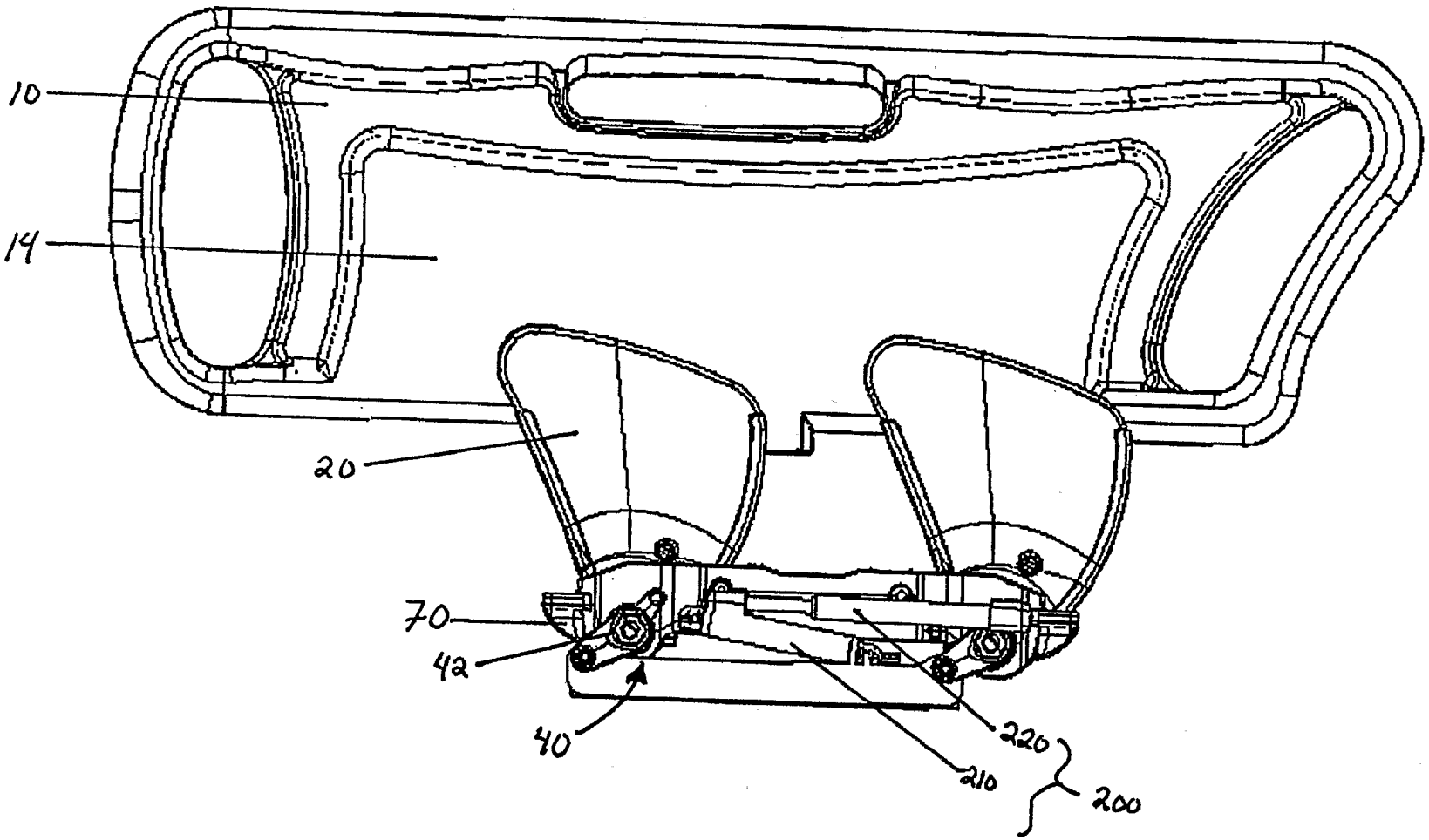
FIG. 3*f* is an inside view of the siderail apparatus in a fully deployed position having two support arms pivotally connected to a cross-member which comprises a guiding mechanism, according to one embodiment of the present invention.
Figure 3G:
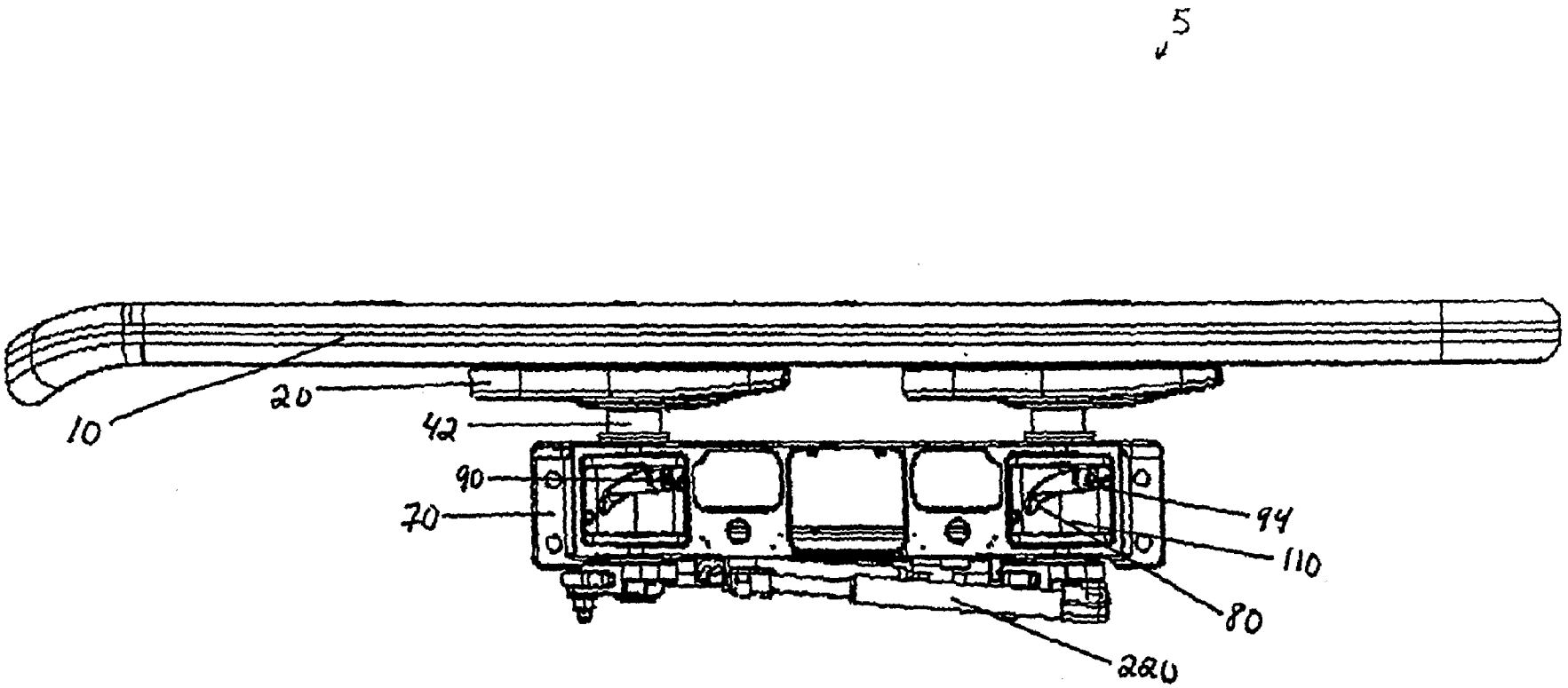
FIG. 3*g* is a top view of the siderail apparatus in a fully deployed position having two support arms pivotally connected to a cross-member which comprises a guiding mechanism, according to one embodiment of the present invention.

FIG. 3*a* is a detailed top view of the siderail apparatus 5 in the fully deployed position according to one embodiment of the present invention. The siderail body 14 is pivotally connected to two support arms 20 through a pair of upper pivots 30. The two support arms 20 are pivotally connected to guiding mechanisms 110 through a pair of lower pivots 40, the guiding mechanisms 110 operatively connected to a cross-member 70. A radial protrusion 90 located on each lower pivot shaft 42 is operatively coupled to a bearing assembly 94 which is operatively engaged with a groove 80 of the guiding mechanism 110 (see for example FIGS. 12*a*-12*d*). The bearing assembly 94 operatively coupled to the radial protrusion 90 reduces the frictional coefficient during the operation of the siderail apparatus 5 considerably diminishing the wear of the radial protrusion 90 and the edges of the groove 80. Any kind of conventional bearing assembly can be used for this purpose. The shape and size of groove can vary depending on the desired lateral and translational movement of the lower pivots shafts 42 along the pivot slots of the guiding mechanism 110. The rotational movement around the lower pivots 40 which occurs during operation of the siderail apparatus 5 results in the transverse movement of the lower pivots shafts 42 and translates into a transverse movement of the siderail body 14 towards or away from the longitudinal centerline of the patient support apparatus 5. The distance between the siderail body 14 and the patient support apparatus 5 can be substantially at its maximum in this deployed position. FIG. 3*b* illustrates an inside view of FIG. 3*a* and illustrates the angle formed between the support arms 20 and the siderail body 14 being substantially obtuse.

Figure 10A:
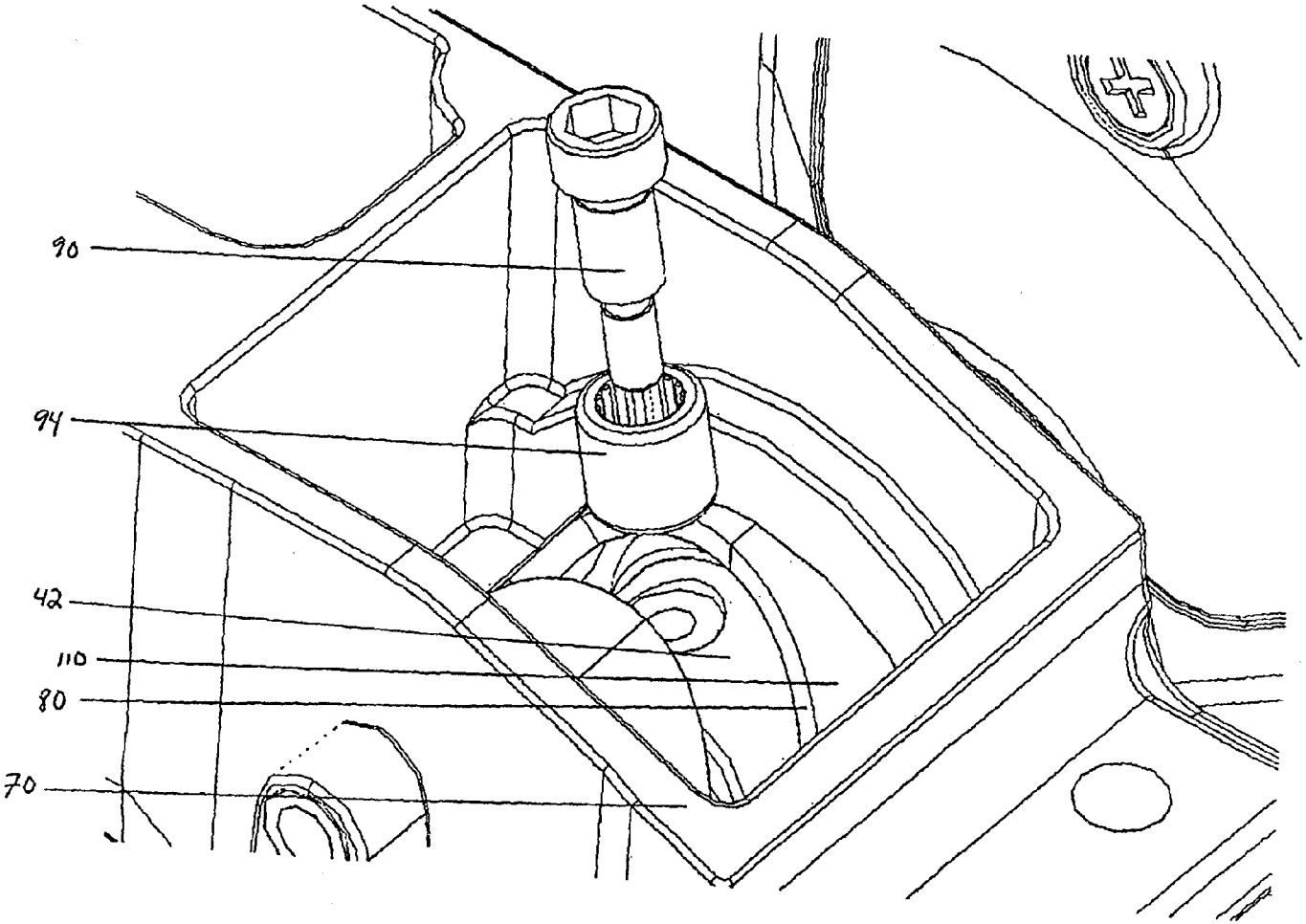
FIG. 10*a* is perspective view of a partially assembled guiding mechanism according to an embodiment of the present invention.
Figure 10B:
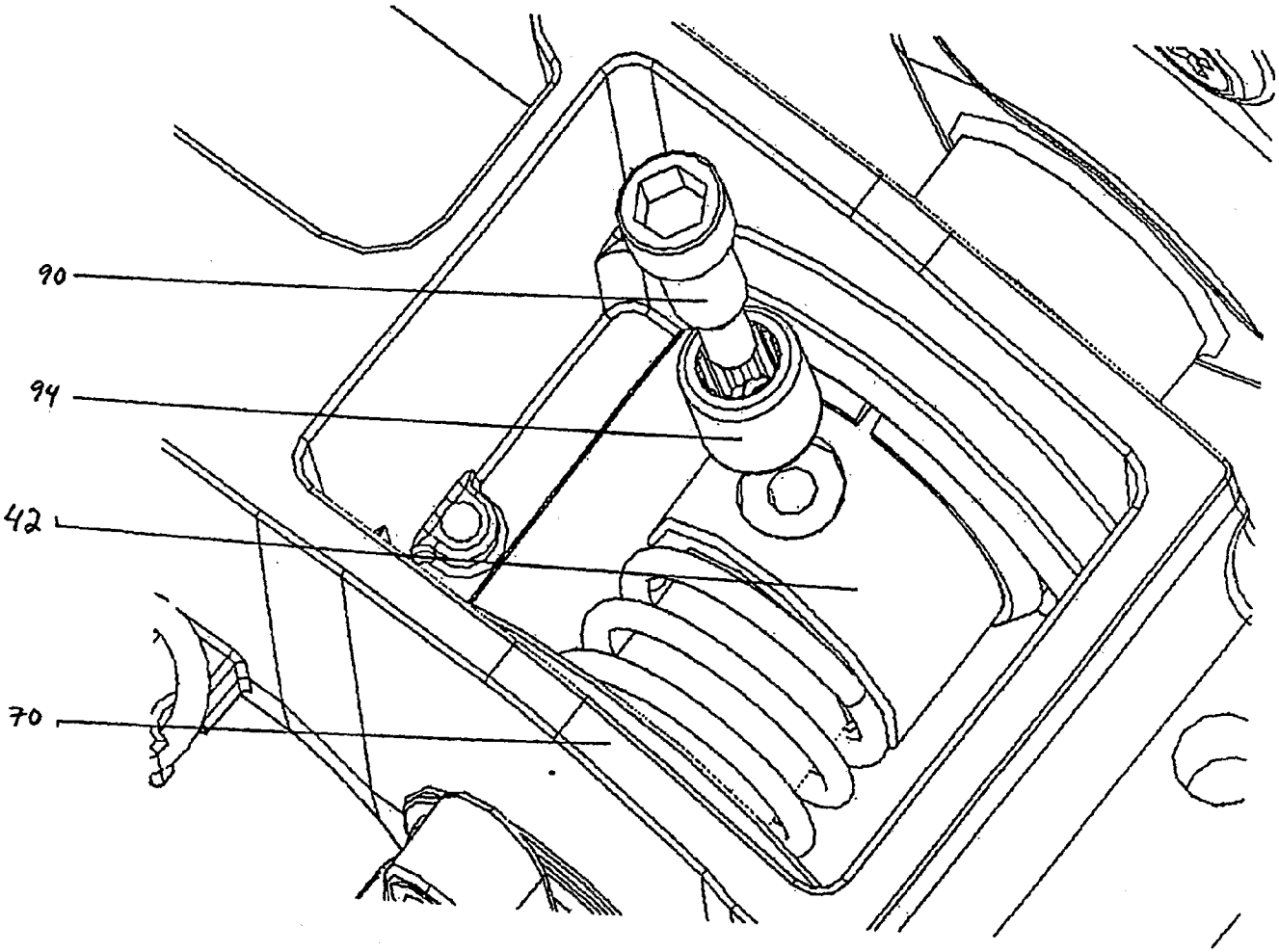
FIG. 10*b* is perspective view of a partially assembled guiding mechanism according to another embodiment of the present invention.

The characteristics of the guiding mechanism 110 in accordance with embodiments of the present invention can be configured in several ways. For example, the guiding mechanism 110 can be cast in a single component as shown for example in FIGS. 3*a* and 3*b*, incorporating the cross-member 70. It can also be machined from a single piece of material. Some of the advantages of such embodiments are reduced costs of production, simplified installation and structural integrity of the guiding mechanisms 110 and the cross-member 70. The guiding mechanism 110 and cross-member 70 can also be formed from several parts. For instance, the areas immediately surrounding the grooves 80 of the guiding mechanism 110 can be made from parts distinct from the rest of the guiding mechanism 110. Given that these sections of the guiding mechanism 110 can be the areas which will sustain the heaviest wear due to the friction between the radial protrusions located on each lower pivot or the bearing assembly 94 operatively coupled to the radial protrusions 90 (FIGS. 10*a*, 10*b*) it can be desirable to have these sections separate from the rest of the guiding mechanism 110 and the cross-member 70 in order to replace only the damaged sections when needed instead of replacing the whole guiding mechanism 110 or cross-member 70. This modular configuration of the guiding mechanism 110 and cross member 70 can provide a means for replacing the sections immediately surrounding the grooves 80 of the guiding mechanism 110 to change the configuration of the grooves 80 for different uses of the siderail apparatus 5 with the same patient support apparatus. The shape of the guiding grooves themselves can vary to accommodate various needs and various patient support apparatuses with which the siderail apparatus 5 is to be used. For example, the grooves can be linear (for example groove 280, FIG. 13*a*), curved (for example groove 380, FIG. 13*b*), angled or a combination thereof (for example 480, FIG. 13*c*), as long as the guiding grooves of the support arms 20 of a siderail apparatus 5 are substantially identical and have substantially the same orientation.

The embodiment of the present invention illustrated in FIG. 3*a*, for example, has guiding grooves 80 which have a substantially longitudinally linear portion followed by a curved portion. When a rotational force is applied to the siderail apparatus 5 embodied at FIG. 3*a*, there is no lateral movement until the radial protrusions 90 engage with the curved portions of the guiding grooves 80. When the radial protrusions 90 reach the beginning of the curved portions of the guiding grooves 80, the top of the siderail body 14 is located lower that the side of the lying surface or mattress so that once the radial protrusions 90 engage with the curved portions of the guiding grooves 80, siderail body 14 is free to translate laterally closer to the center of the patient support apparatus.

FIGS. 12*a*, 12*b*, 12*c* and 12*d* depict an embodiment of the present invention where the radial protrusion 90 and bearing assembly 94 are in different positions during the lateral translation movement. This is merely one example of possible configurations of the guiding grooves 80 according to the present invention.

Figure 13A:
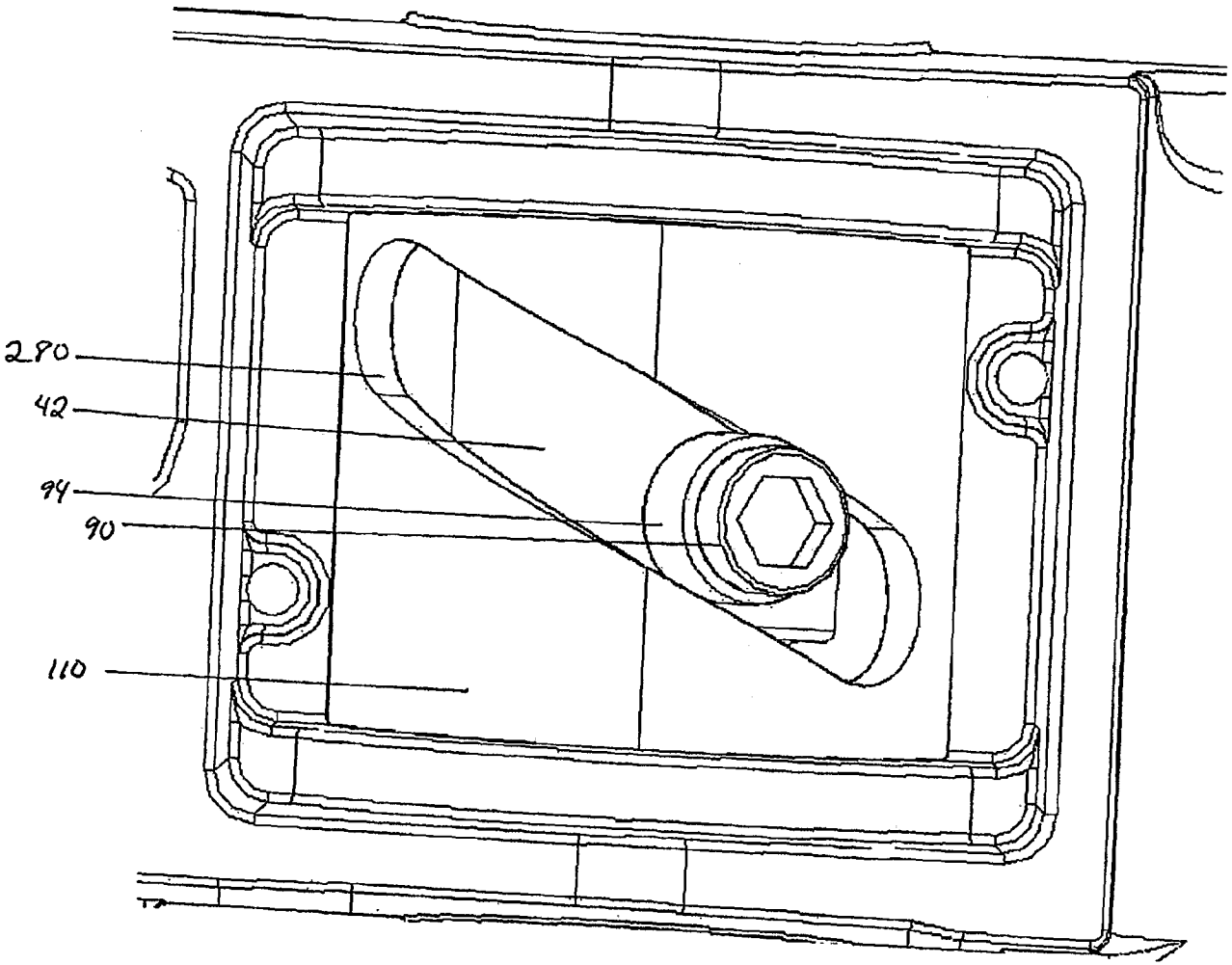
FIG. 13*a* is a top view of the guiding mechanism according to one embodiment of the present invention.
Figure 13B:
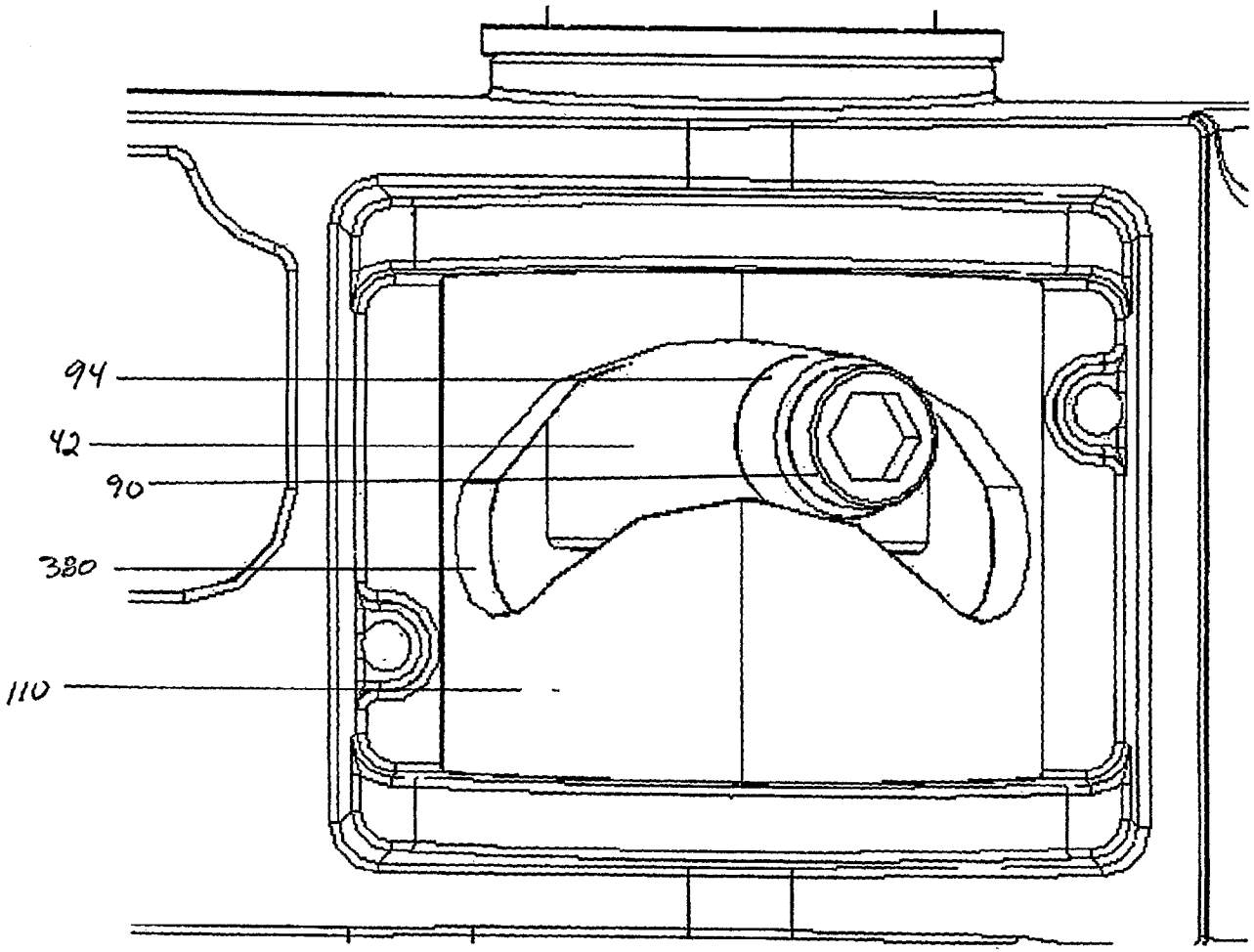
FIG. 13*b* is a top view of the guiding mechanism according to one embodiment of the present invention.
Figure 13C:
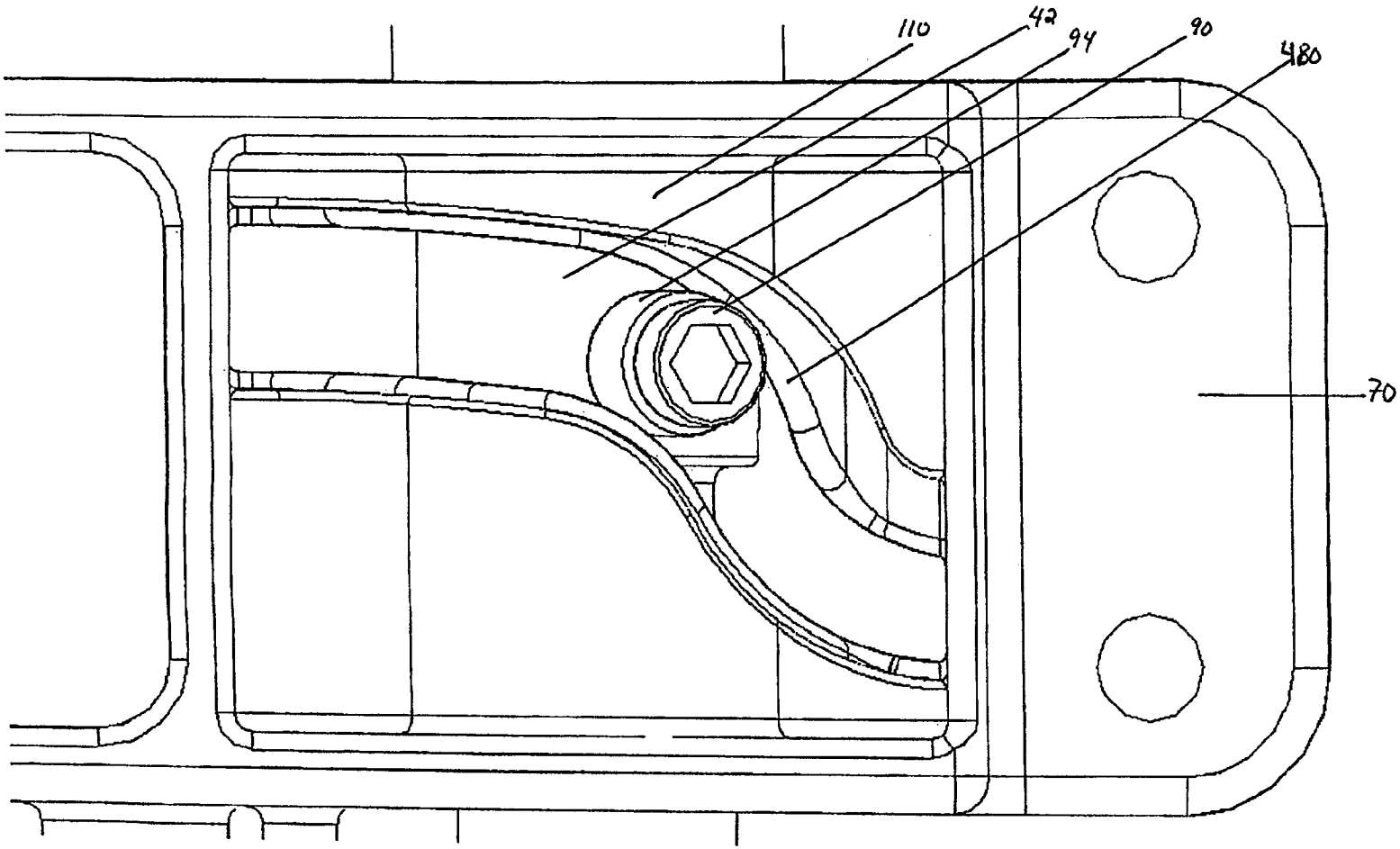
FIG. 13*c* is a top view of the guiding mechanism according to one embodiment of the present invention.

In one embodiment the guiding grooves can have curved portions curving towards or away from the cross-member, or any combination of curved and linear portions. For example, a guiding groove can have two curved portions curving towards the cross-member separated by a substantially linear portion such that a rotational force applied to the siderail will result in a lateral movement translating in the siderail being closer to the center of the patient support apparatus when in a fully deployed position or fully stowed position and the siderail would be farther from the center of the patient support apparatus when in transitional positions. Further examples of embodiments of the present invention with different designs and shapes of guiding grooves 280, 380 and 480 are illustrated in FIGS. 13*a*, 13*b* and 13*c* respectively.

In a further embodiment of the invention, the guiding grooves are located on the pivot shaft to operatively engage with one or more protrusions, coupled or not to a bearing assembly, extending from the inside of the pivot slot.

In one embodiment the guiding mechanism and the cross-member, or the different components thereof, as the case may be, can be made of several materials. Characteristics such as weight-to-strength ratio, hardness, wear resistance and corrosion resistance (corrosion from airborne corrosive agents, air and cleaning solvents and bodily fluids usually found in a hospital/medical environment) should be given consideration when choosing the materials to be used in the manufacturing of the guiding mechanism and the cross-member or the different components thereof. For example, aluminum is lightweight and has some high corrosion resistant characteristics, making a good material for the cross-member. However, other parts such as the areas immediately surrounding the grooves of the guiding mechanism and the slots of the lower pivot can be made from other materials to accommodate the higher frictional abrasion on such parts and therefore being more prone to wear. Materials with a high resistance to wear, such as steel, stainless steels or ferrite alloys for example, can be used for making these parts. Other parts of the siderail mechanism (apparatus) can be made from further different materials and are not limited in any way to the materials used for the guiding mechanism. The various parts of the guiding mechanism and the cross-member can comprise interlocking mechanisms provided between the multiple parts to ensure correct alignment of these multiple parts during assembly. As mentioned previously, for example, the guiding grooves within a same guiding mechanism have to be the same for the siderail apparatus to function properly, requiring parts that are precisely operatively connected. Slots, grooves, apertures or fittings, for example, may be used to interlock the various parts of the siderail apparatus together precisely.

With reference to FIGS. 4*a*, 4*b*, 5*a* and 5*b*, the siderail apparatus 5 according to an embodiment of the present invention is illustrated in transitional positions between a fully deployed position and a fully stowed position. FIGS. 4*a* and 5*a* are detailed top views of the siderail apparatus 5 in such transitional positions. The siderail body 14 is pivotally connected to two support arms 20 through a pair of upper pivots 30. The two support arms 20 are pivotally connected to the guiding mechanism 110 coupled to the cross-member 70 through a pair of lower pivots 40. A radial protrusion 90 located on each lower pivot shaft 42 is operatively coupled to a bearing assembly 94 which is operatively engaged with a groove 80 of the guiding mechanism 110. The bearing assembly 94 operatively coupled to the radial protrusion 90 reduces the frictional coefficient during the operation of the siderail apparatus 5 which can considerably diminishing the wear of the radial protrusion 90 and the edges of the groove 80. The radial protrusions 90 are guided along the guiding grooves 80. The rotational movement around the lower pivots 40 which occurs during operation of the siderail apparatus 5 results in a transverse movement of the lower pivots 40 and translates into a transverse movement of the siderail body 14 towards or away from the longitudinal centerline of the patient support apparatus.

In the illustrated embodiment, the distance between the siderail body 14 and the lying surface is at substantially a maximum in the deployed position. Still referring to the present embodiment, the spacing between the support arms 20 and the guiding mechanism 110 of the cross-member 70 is diminished as the siderail body 14 is lowered. The rate at which the spacing between the support arms 20 and the cross-member 70 is diminished and the lateral transitional movement are defined by the size and shape of the guiding grooves 80 of the guiding mechanism 110. Variations to the siderail apparatus 5 according to the present invention can be made in order to get relative spacing between the support arms 20 and the cross-member 70 which varies at different stages of the rotational movement of the siderail body 14. A single or several lower pivot shafts 42 can be designed to have radial protrusion 90 to operatively be coupled to a bearing assembly 94 which is operatively engaged with a groove 80 of the guiding mechanism 110. FIGS. 12*a*, 12*b*, 12*c* and 12*d* illustrate a radial protrusion 90 operatively coupled to a bearing assembly 94 which is operatively engaged with a groove 80 of the guiding mechanism 110 at different positions during the movement of the siderail apparatus 5 and the lateral translational movement of the pivot shaft 42.

Figure 6A:
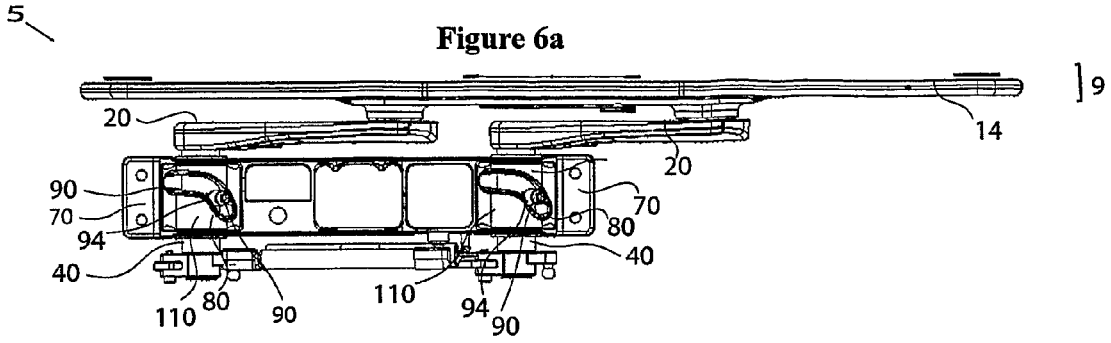
FIG. 6*a* is a top view of the siderail apparatus without the siderail cover in a fully stowed position having two support arms pivotally connected to a cross-member which comprises a guiding mechanism, according to one embodiment of the present invention.
Figure 6B:
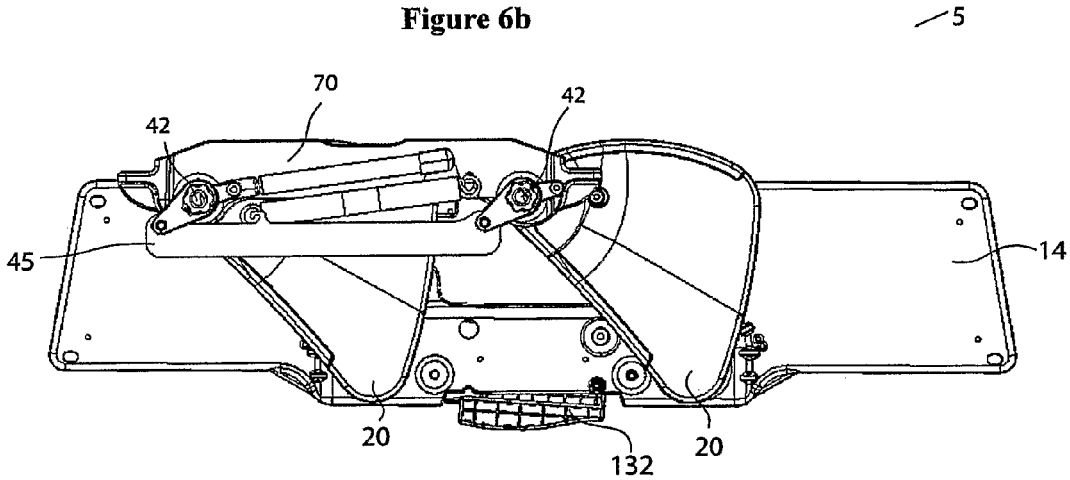
FIG. 6*b* is an inside view of the siderail apparatus without the siderail cover in a fully stowed position having two support arms pivotally connected to a cross-member which comprises a guiding mechanism, according to the embodiment of the present invention illustrated in FIG. 6*a*.
Figure 6C:
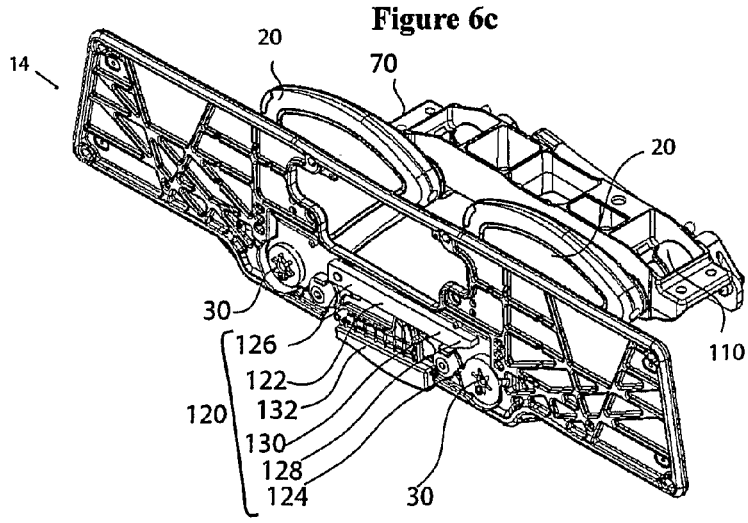
FIG. 6*c* is an outside perspective view of the siderail apparatus without the siderail cover in a fully stowed position having two support arms pivotally connected to a cross-member which comprises a guiding mechanism, according to the embodiment of the present invention illustrated in FIG. 6*a*.
Figure 6D:
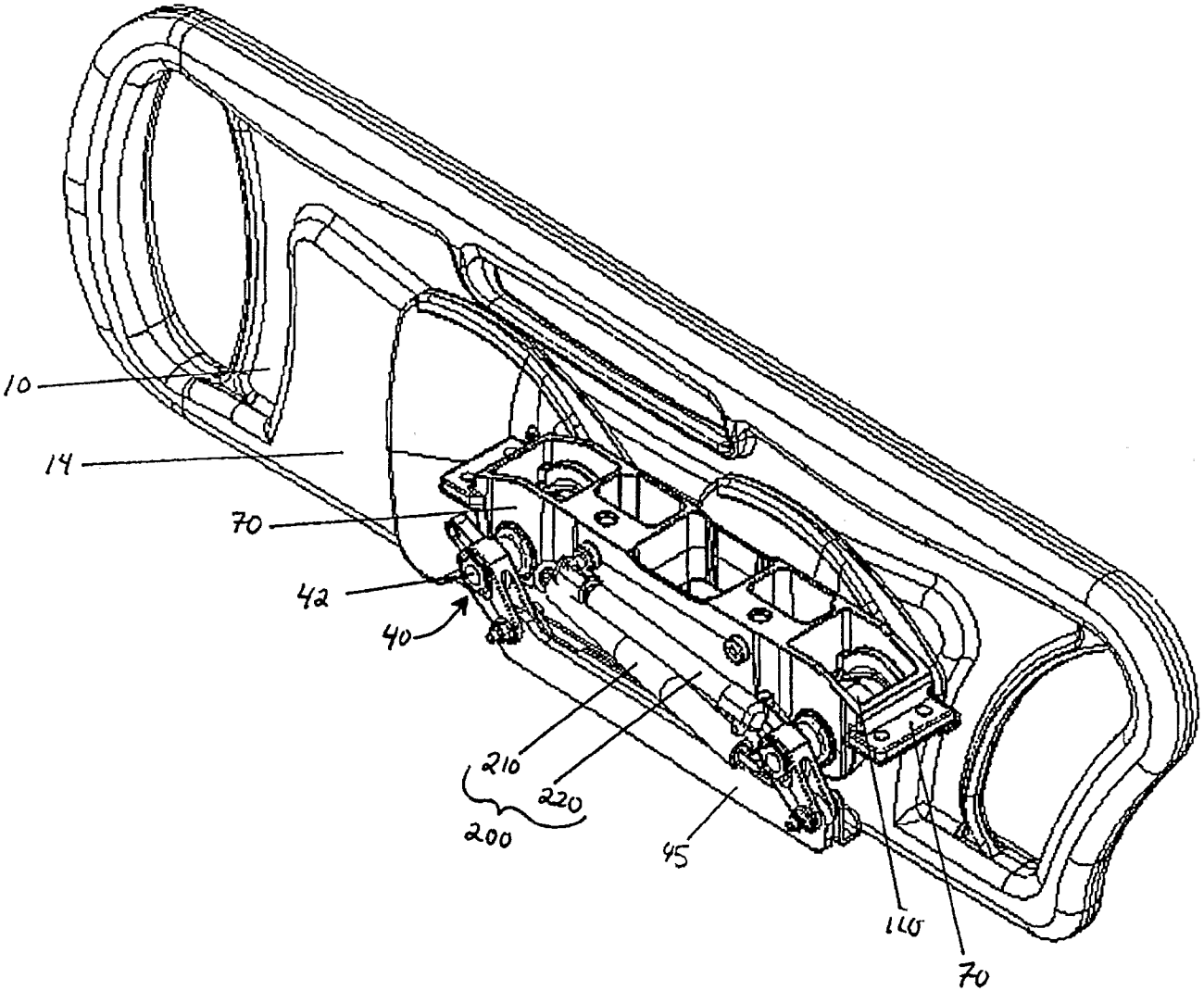
FIG. 6*d* is a perspective inside view of the siderail apparatus in a fully stowed position having two support arms pivotally connected to a cross-member which comprises a guiding mechanism, according to one embodiment of the present invention.
Figure 6E:
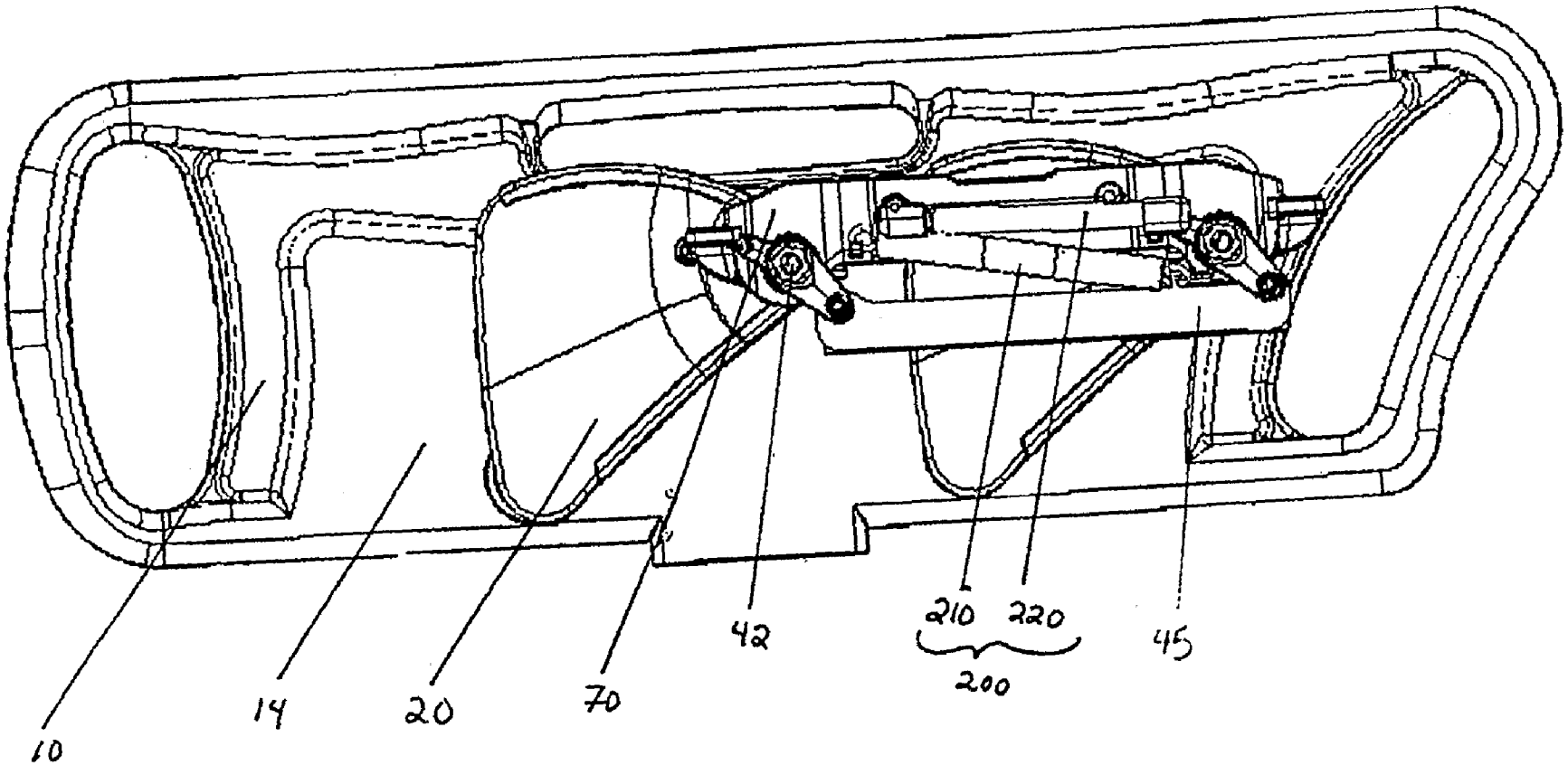
FIG. 6*e* is an inside view of the siderail apparatus in a fully stowed position having two support arms pivotally connected to a cross-member which comprises a guiding mechanism, according to one embodiment of the present invention.
Figure 6F:
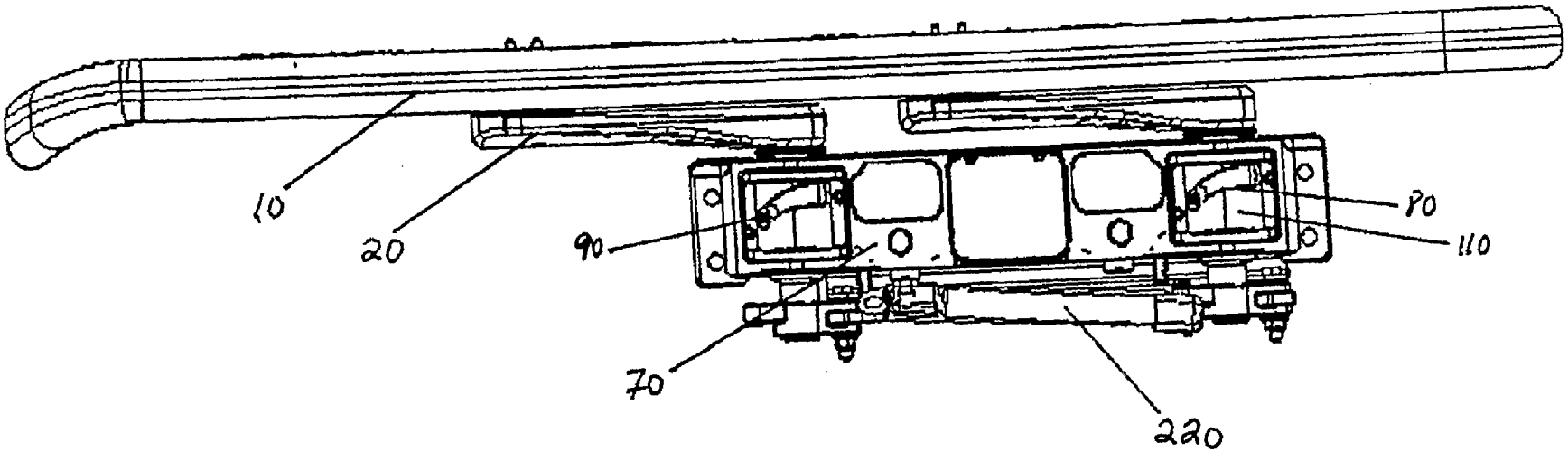
FIG. 6*f* is a top view of the siderail apparatus in a fully stowed position having two support arms pivotally connected to a cross-member which comprises a guiding mechanism, according to one embodiment of the present invention.
Figure 7A:
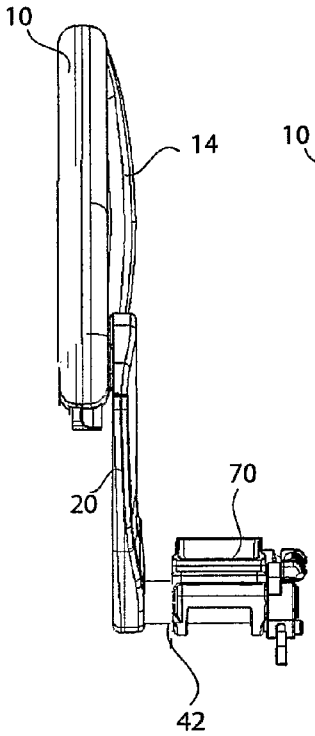
FIG. 7*a* is a longitudinal view of the siderail apparatus in a fully deployed position having two support arms pivotally connected to a cross-member which comprises a guiding mechanism, according to one embodiment of the present invention.
Figure 7B:
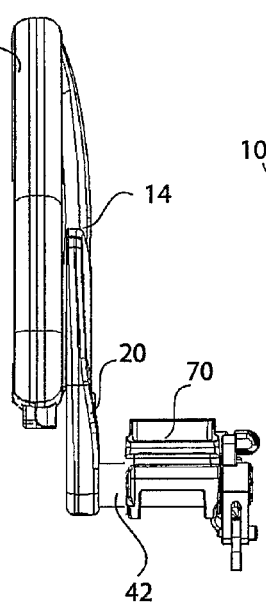
FIG. 7*b* is a longitudinal view of the siderail apparatus in a partially deployed position having two support arms pivotally connected to a cross-member which comprises a guiding mechanism, according to the embodiment of the present invention illustrated in FIG. 7*a*.
Figure 7C:
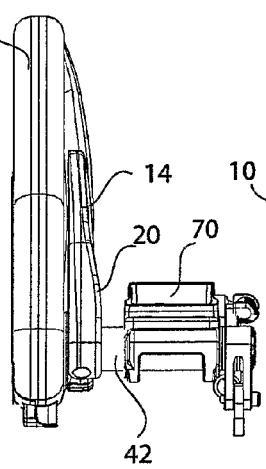
FIG. 7*c* is a longitudinal view of the siderail apparatus in a partially stowed position having two support arms pivotally connected to a cross-member which comprises a guiding mechanism, according to the embodiment of the present invention illustrated in FIG. 7*a*.
Figure 7D:
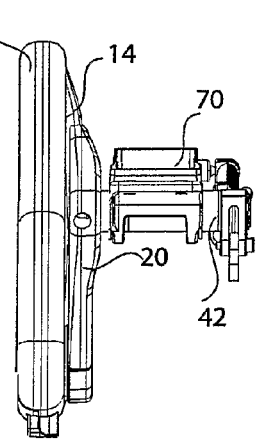
FIG. 7*d* is a longitudinal view of the siderail apparatus in a fully stowed position having two support arms pivotally connected to a cross-member which comprises a guiding mechanism, according to the embodiment of the present invention illustrated in FIG. 7*a*.

FIG. 6*a* is a detailed top view of the siderail apparatus 5 in the fully stowed position according to one embodiment of the present invention. The operation of the siderail apparatus 5 is as described above and illustrated in FIGS. 3*a* to 5*c*. The distance between the lower portion of the siderail body 14 and the patient support apparatus is substantially at its minimum in this fully stowed position. FIG. 6*b* illustrates an inside view of FIG. 6*a* and illustrates the absence of an angle between the support arms 20 and the lower edge of the siderail body 14, and therefore the absence of pinch points.

FIGS. 7*a*, 7*b*, 7*c* and 7*d* represent longitudinal views of the siderail apparatus 5 corresponding respectively to the positions depicted in FIGS. 3*a*, 4*a*, 5*a* and 6*a*. FIGS. 7*a*, 7*b*, 7*c* and 7*d* further illustrates the relative transitional movement of the siderail 9 proportionally with the vertical movement of the said siderail 9, resulting in the siderail 9 being located closer to the center of the patient support apparatus when in the fully stowed position and further from the longitudinal centerline of the patient support apparatus when in the fully deployed position.

Figure 11:
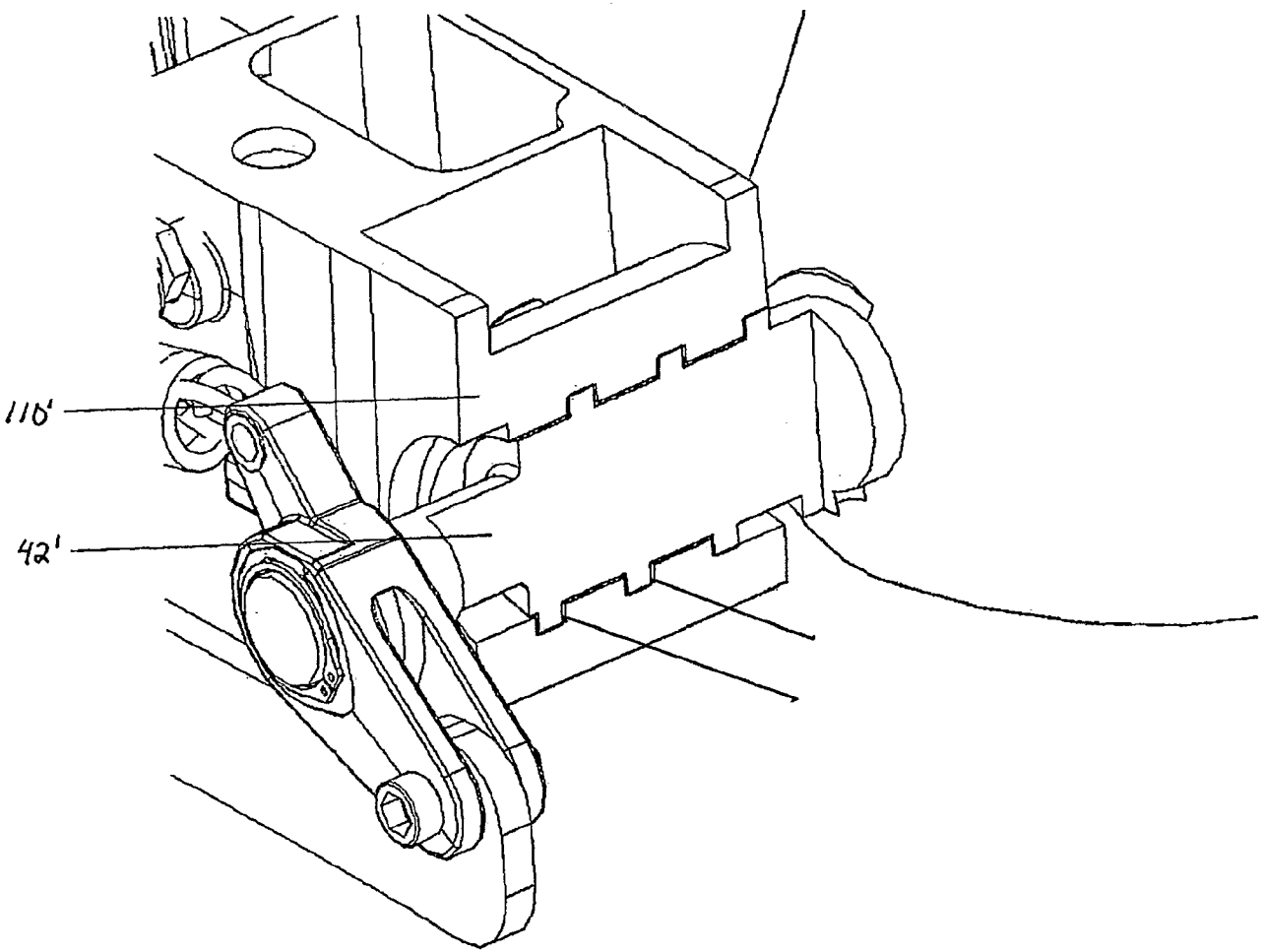
FIG. 11 is a partial transversal view of a pivot shaft according to one embodiment of the present invention.
Figure 12A:
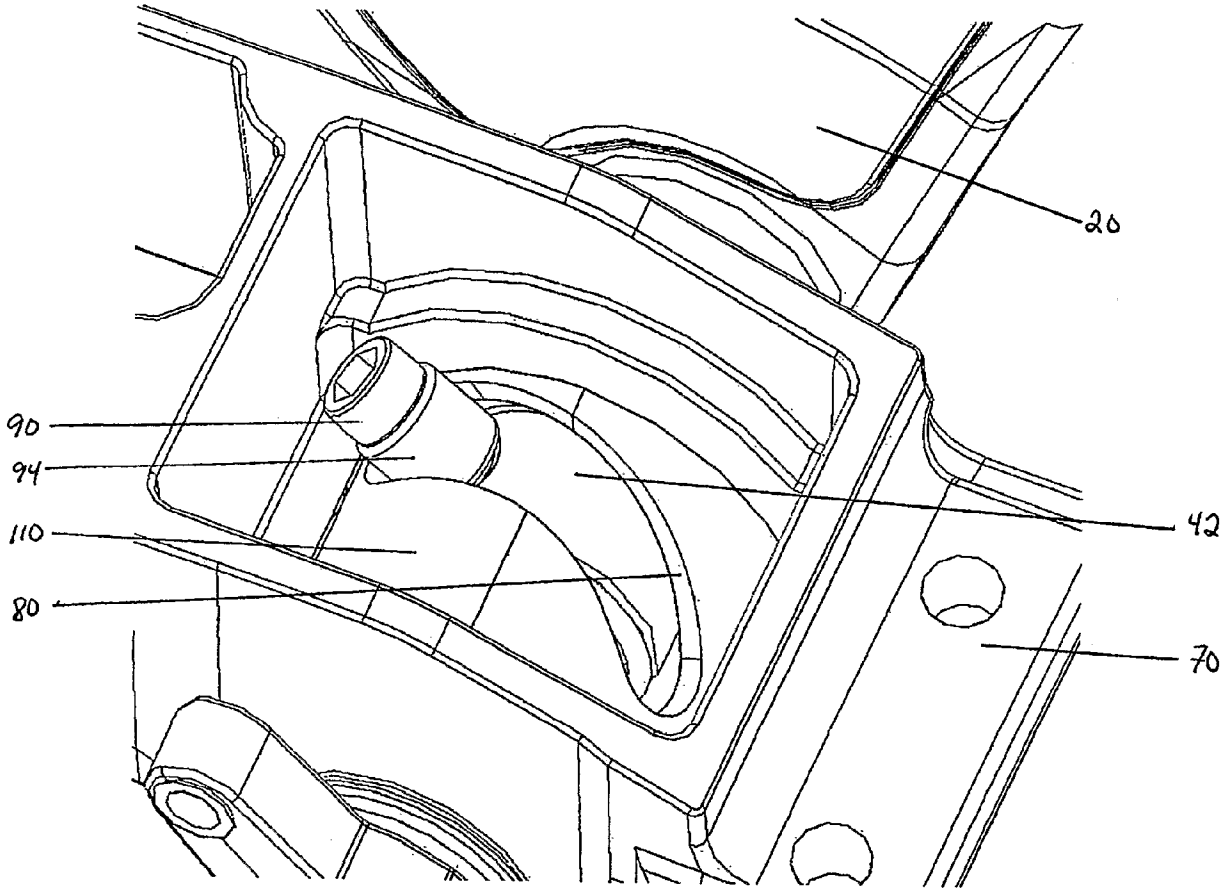
FIG. 12*a* is partial perspective view of a guiding mechanism according to one embodiment of the present invention wherein the siderail apparatus is in a fully deployed position.
Figure 12B:
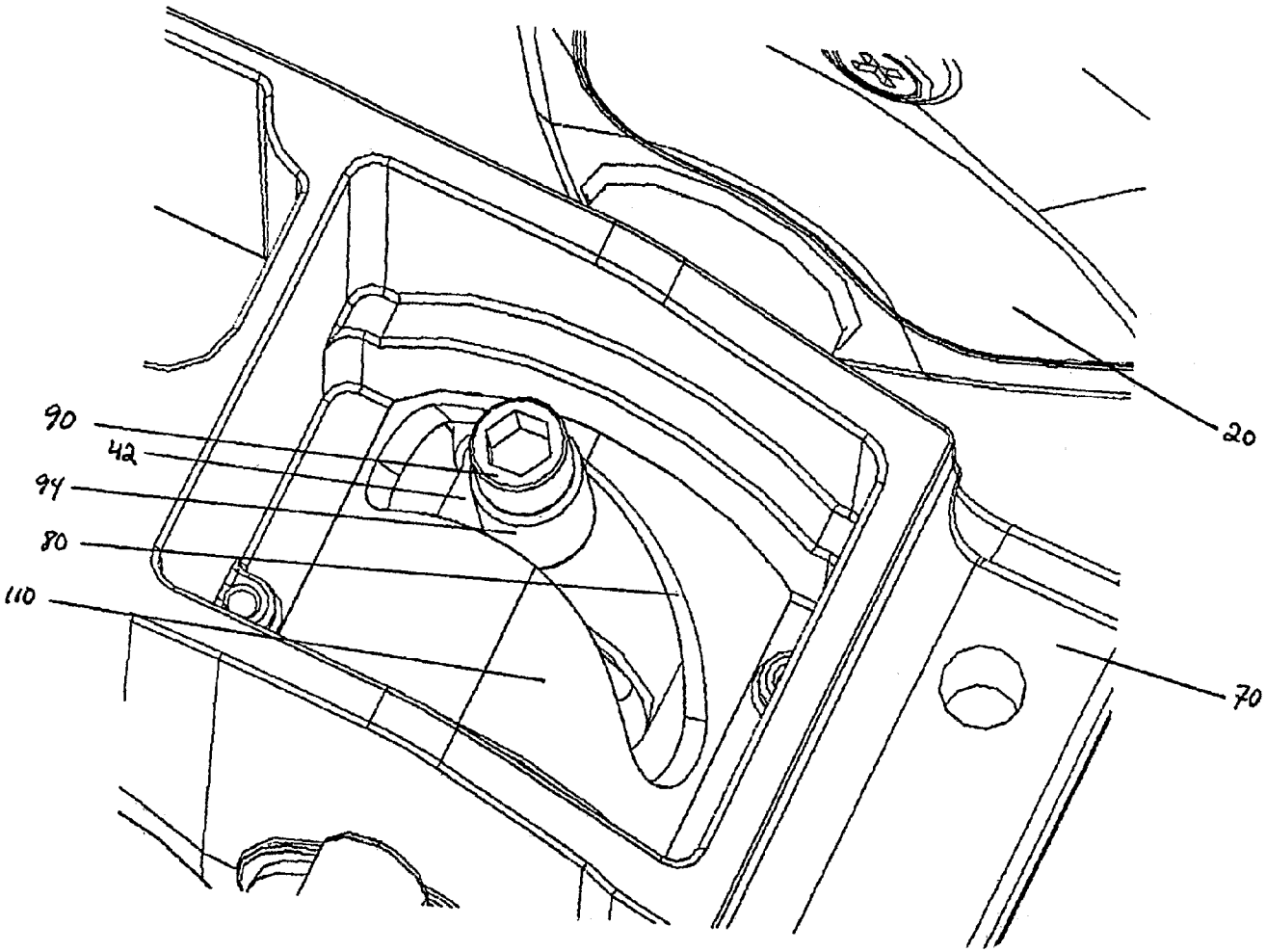
FIG. 12*b* is partial perspective view of a guiding mechanism according to one embodiment of the present invention wherein the siderail apparatus is in a partially deployed position.
Figure 12C:
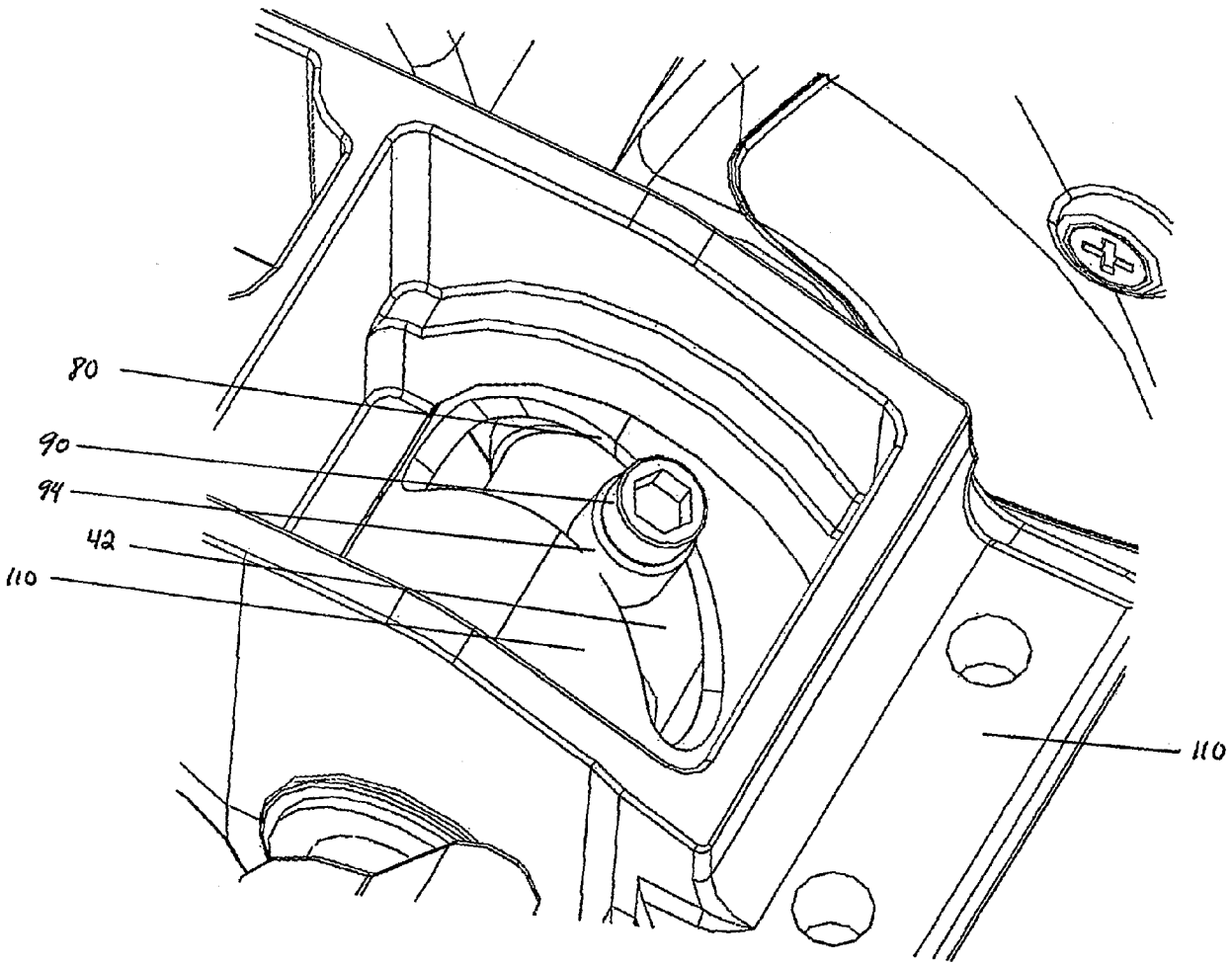
FIG. 12*c* is partial perspective view of a guiding mechanism according to one embodiment of the present invention wherein the siderail apparatus is in a partially stowed position.
Figure 12D:
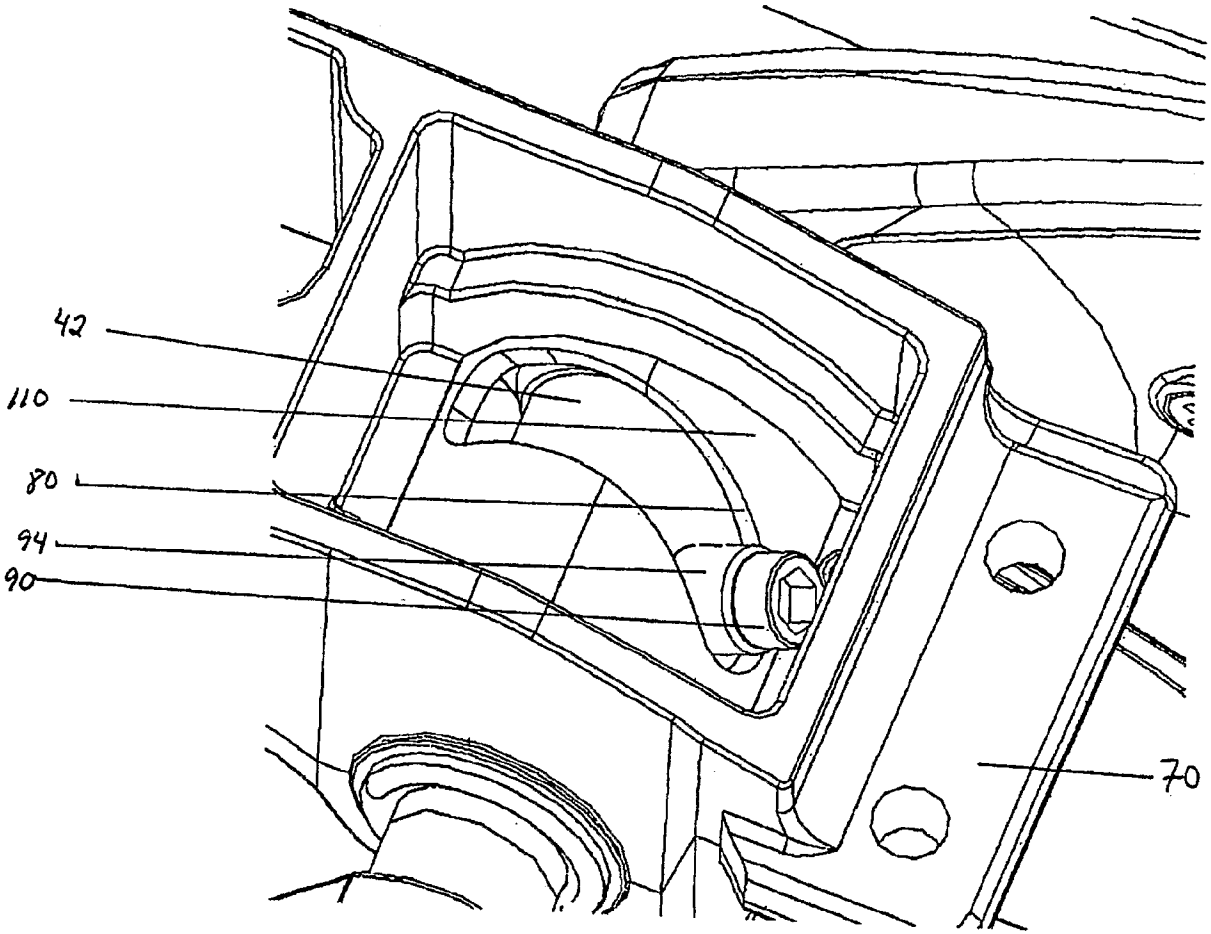
FIG. 12*d* is partial perspective view of a guiding mechanism according to one embodiment of the present invention wherein the siderail apparatus is in a fully stowed position.

In one embodiment of the present invention, the pivot shafts 42' of the lower pivots 40 engaging with the guiding mechanism 110 are screw-type shafts as illustrated in FIG. 11. In this embodiment, the guiding mechanism 110' is designed to have treads 140 matching the radial extensions 145 of the screw-type pivot shafts 42' to operatively receive the said radial extensions 145 creating a lateral translation movement of the pivot shafts 42' through a rotation of the pivot shafts 42'. The lateral translation movement is away or towards the guiding mechanism 110' depending on the orientation of the rotational movement applied to the shafts 42'. Using this type of screw-type pivot shaft 42', one or more lower pivot shafts 42' can be designed to have radial extensions 145 to operatively be coupled to a bearing assembly 94 which can be operatively engaged with treads 140 of the guiding mechanism 110.

In one embodiment of the present invention, pivot journals or journal bearings (not shown) can be used between the pivots shafts 42 and their corresponding pivot slots 44. The pivot journals or journal bearings help reduce significantly the wearing of the pivot shafts and the corresponding pivot slots 44 while also reducing high contact stresses and strain. Within the parameters of the present invention, this is especially useful when applied to the upper pivots 30 since they sustain the heaviest strain during operation of the siderail mechanism due to their relational position from the patient support apparatus.

During operation of the siderail mechanism according to an embodiment of the present invention, a rotational force is applied to the siderail body. However, while operating the siderail mechanism, there will always be a certain amount of substantially longitudinal force applied to the mechanism possibly resulting in binding at the pivot points. This can happen as a result of the application of a force to the siderail apparatus 5 that is not aligned with the rotation centered with the lower pivots 40. In order to address and minimize such a result, an embodiment of the present invention provides a first upper pivot slot being slightly oblong-shaped while the second upper pivot slot is circular. This feature is particularly advantageous for one hand operation of the siderail apparatus 5 where the force applied to the siderail apparatus 5 will likely not be aligned with the rotational movement of the siderail apparatus 5.

Locking Mechanism

A locking mechanism is provided which allows the siderail apparatus to be locked in a specific position such as in a fully deployed position. The locking mechanism includes a locking arm pivotally mounted on the siderail body at a first end and having a locking tooth at a second end. The locking arm can be biased downwardly by a spring for the locking tooth to engage with a locking cog mounted on the shaft of one upper pivot. The position in which the siderail is locked is determined by the position of the locking cog mounted on the shaft of one upper pivot. The locking mechanism includes a one-hand lock release mechanism to unlock the siderail apparatus from its locked position to permit the moving of the siderail.

In an embodiment of the present invention, the siderail apparatus 5 includes a locking mechanism 120 configured to allow the siderail apparatus 5 to be locked in a specific position. Referring now to FIGS. 3*c*, 4*c*, 5*c* 6*c* and 9, examples of a suitable locking mechanism 120 are depicted. The locking mechanism 120 includes a locking arm 122 pivotally mounted on the siderail body 14 at a first end 126 and having a locking tooth 128 at a second end 130. The locking arm 122 is biased downwardly by a spring 134 for the locking tooth 128 to engage with a locking cog 124 mounted on the shaft 42 of one upper pivots 30. The position in which the siderail 9 is locked is determined by the position of the locking cog 124 mounted on the shaft 42 of one upper pivots 30. The locking mechanism 120 includes a one hand lock release mechanism 132 to unlock the siderail apparatus 5 from its locked position to permit the moving of the siderail 9.

Damper Mechanism

A damper mechanism comprising a spring and a damper is operatively connected with the cross-member of the siderail apparatus. The damper mechanism facilitates the downward, lowering movement of the siderail and acts as a shock absorber creating a smoother movement of the siderail.

In an embodiment of the present invention, the movable siderail apparatus 5 incorporates a damper mechanism 200 (see for example FIGS. 3*e*, 3*f*, 4*d*, 4*e*, 5*d*, 5*e*, 6*d*, and 6*e*). The damper mechanism 200 comprises a spring 210 and a damper 220 operatively connected with the cross-member 70 of the siderail apparatus 5. The damper mechanism 200 facilitates the downward, lowering movement of the siderail 9. The damper mechanism 200 prevents the siderail 9 from descending to a lower position at an undesired fast rate due to the gravitational force acting on the siderail 9. The damping coefficient (the magnitude of effect on the lowering movement) of the damping mechanism 200 can be adjustable. For the adjustability of the damping coefficient of the damper mechanism 200, the stiffness of the material of the damper 220 may be adjusted, modifying correspondingly the ability of the damper 220 providing the damping to change shape. This type of damper mechanism 200 can be applied using with elastomeric pads which can be color coded for different damping coefficients. The damper mechanism 200 can further act as a shock absorber by decreasing the amplitude of the mechanical oscillations (up and down movement) of the springs 210 and as such, eliminates or progressively diminishes the vibrations or oscillations of the siderail 9, thereby creating a smoother movement. There are many advantages associated with the use of a damper mechanism 200, such as achieving a smoother movement of the siderail 9, improving the feel for the user of the siderail apparatus 5, eliminating the loud noise and possible damage or injury caused when a siderail 9 is 'dropped' from the raised position and improving the feel of quality of the siderail apparatus 5.

FIGS. 18, 19, 20, 21 and 22 are perspective view of a right and left siderail apparatuses 5 of one embodiment of the present invention in a fully deployed position positioned on each side of a patient support apparatus at the head-end of a frame system. The operation of this embodiment is as fully described above in respect of the embodiments illustrated in FIGS. 2*a* to 6*f*.

Figure 24:
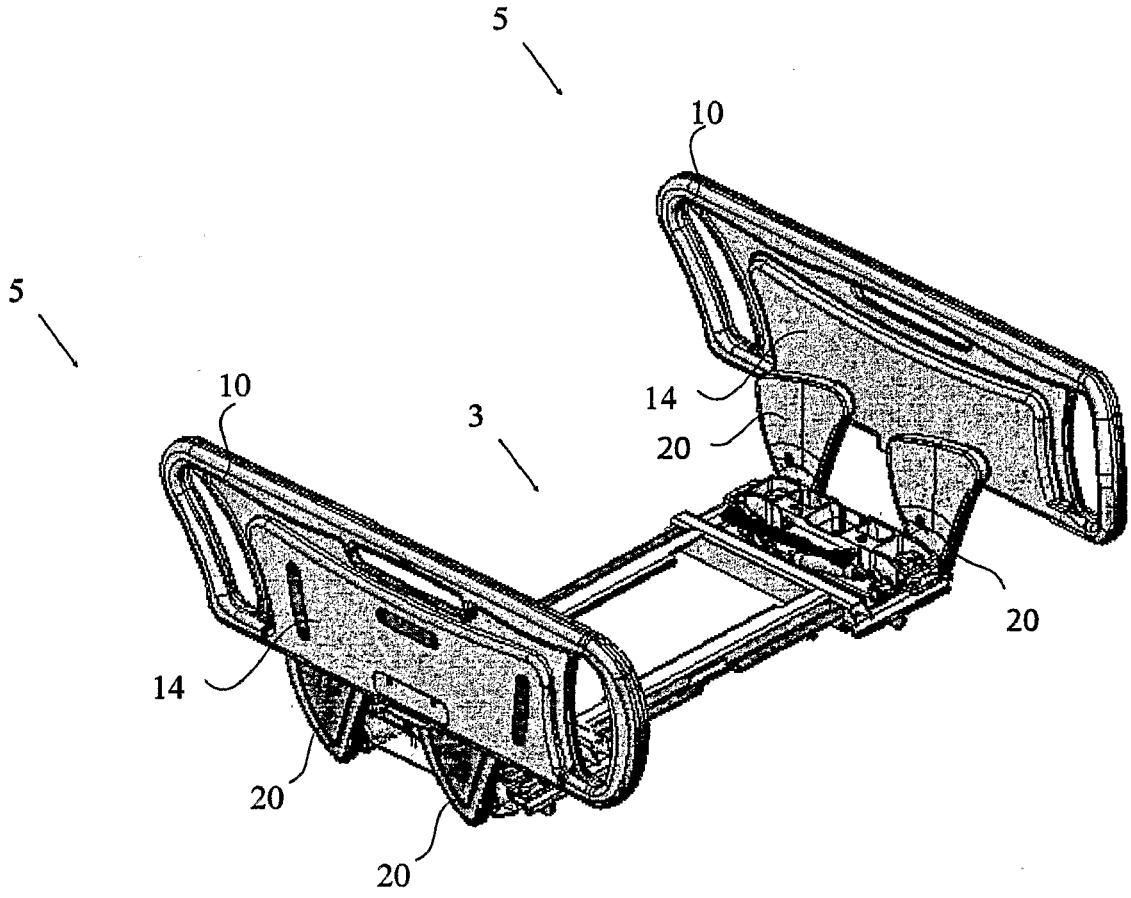
FIG. 24 is a perspective view of the foot-end siderail apparatus in a fully deployed position attached to a frame system according to one embodiment of the present invention.
Figure 25:
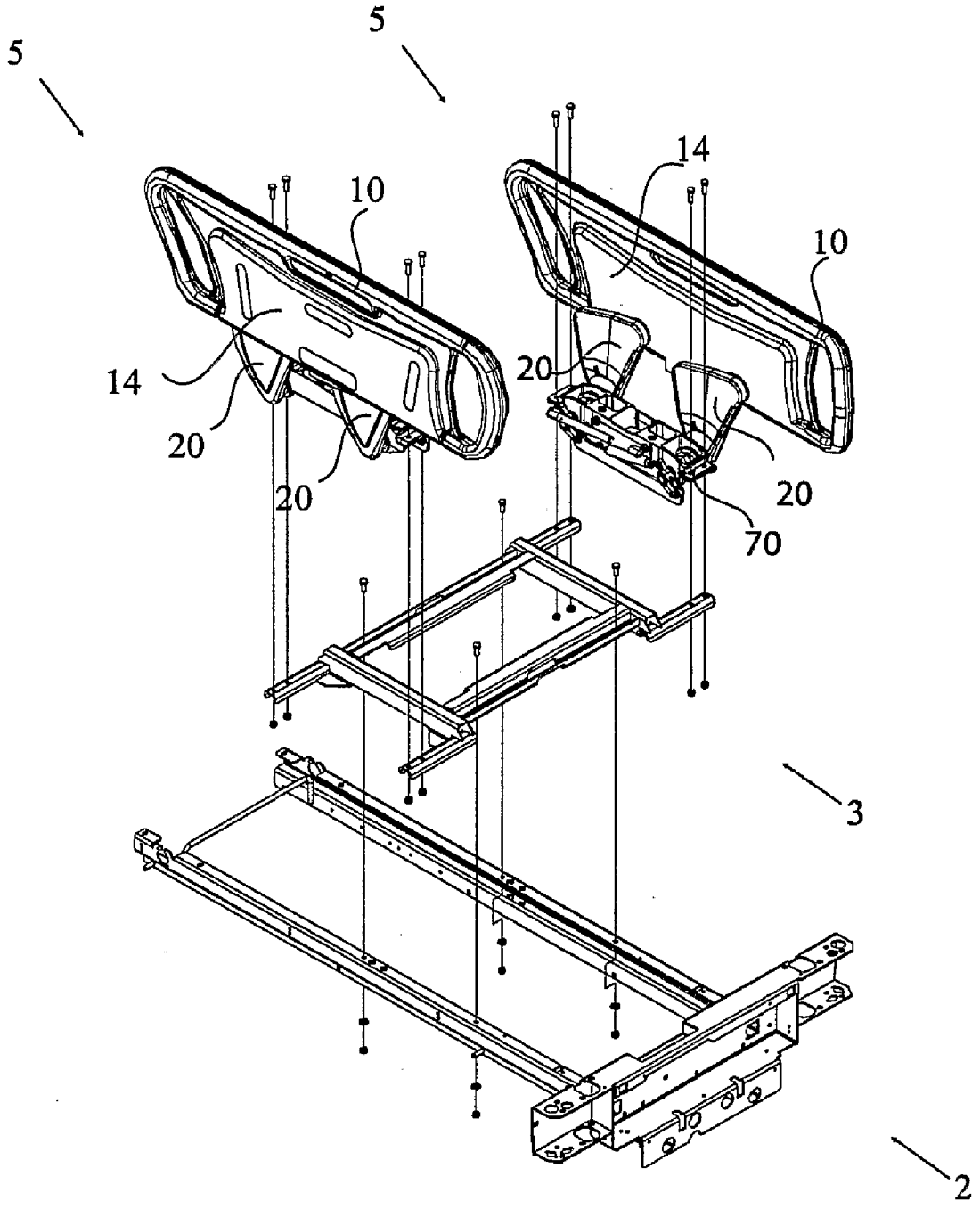
FIG. 25 is an exploded view of the foot-end siderail apparatus of FIG. 24 attached to the load frame and the load frame being attached to a frame system according to one embodiment of the present invention.
Figure 26:
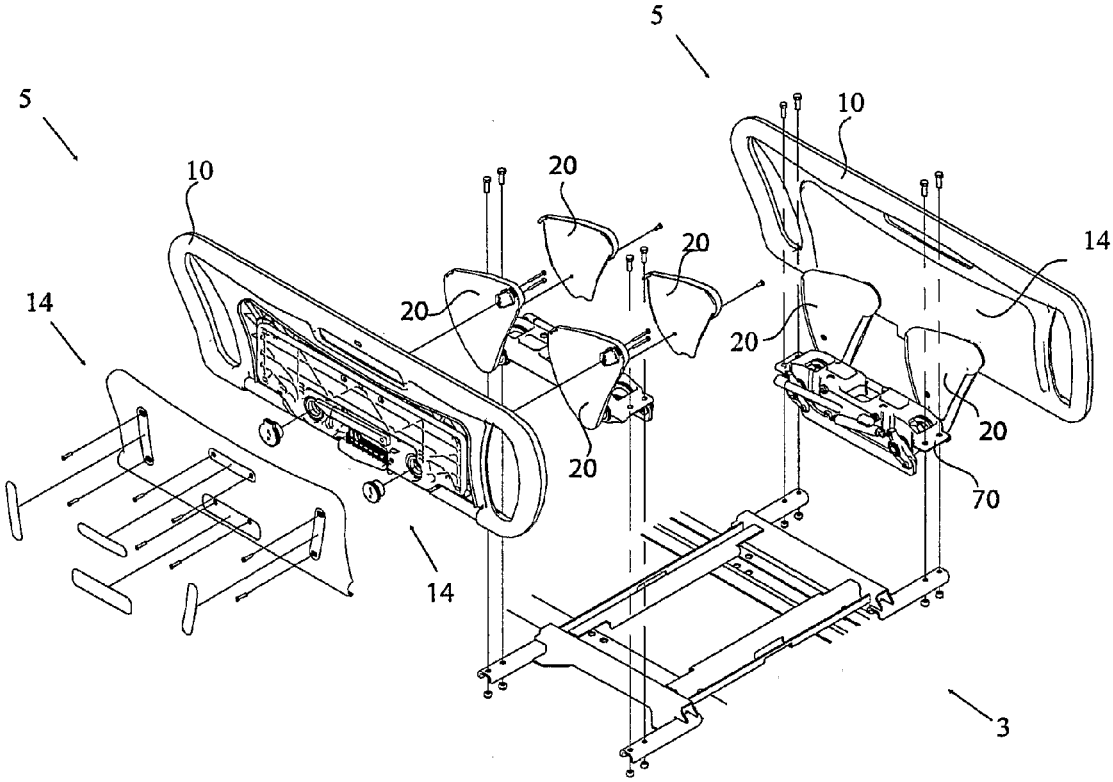
FIG. 26 is a perspective view of the foot-end siderail apparatuses of FIG. 24 according to one embodiment of the present invention showing an exploded view of the right foot-end siderail apparatus and attachment to a frame system.

FIGS. 24, 25 and 26 are perspective view of a right and left siderail apparatuses 5 of one embodiment of the present invention in a fully deployed position positioned on each side of a patient support apparatus at the foot-end of a frame system. The operation of this embodiment is as fully described above in respect of the embodiments illustrated in FIGS. 2*a* to 6*f*.

Siderail Position Detector Mechanism

The detector mechanism detects the relative position of the siderail body support. It can be placed on the siderail or on the patient support apparatus. The detector mechanism comprises a sensor and a processor. The sensor may include for example, a proximity sensor, a photoelectric sensor and a limit switch. The sensor generates an output signal when the siderail is in fully deployed position (for example a locked position). The sensor generates another output signal when the siderail is in either a partially deployed, partially stowed or fully stowed position (for example unlocked positions). The output signals are communicated to a processor which then communicates to a display module. The generated information will increase the safety of the patient support apparatus by alarming a caregiver when the siderail is not in a fully deployed position. The processor can also be configured to disable certain therapies that may be dangerous when a siderail is not in a fully deployed position, for example, rotational therapy and articulation of a section of the patient support.

In an embodiment of the present invention, the siderail apparatus 5 includes a detector mechanism 250 configured to detect the relative position of the siderail 9. The detector mechanism 250 comprises a sensor 255 and a processor 260. The type of sensors sensor 255 that may be used could be, for example, a proximity sensor, a photoelectric sensor, a limit switch, an integrated circuit sensor, a Piezo sensitive device, an angular sensor, a potentiometer, a contact switch, a capacitor, a magneto resistive element, an optical sensor, a camera sensor, a radar sensor, an ultrasonic sensor, a magnetic sensor, or a Temposonic™ sensor. The sensor generates an output signal when the siderail 9 is in fully deployed position (for example a locked position). The sensor generates an output signal when the siderail 9 is in either a partially deployed, partially stowed or fully stowed position (for example unlocked positions). The output signals are communicated to a processor 260 which then communicates to a display module 265 (not shown). The display module indicates the relative position of the siderail 9.

Figure 14A:
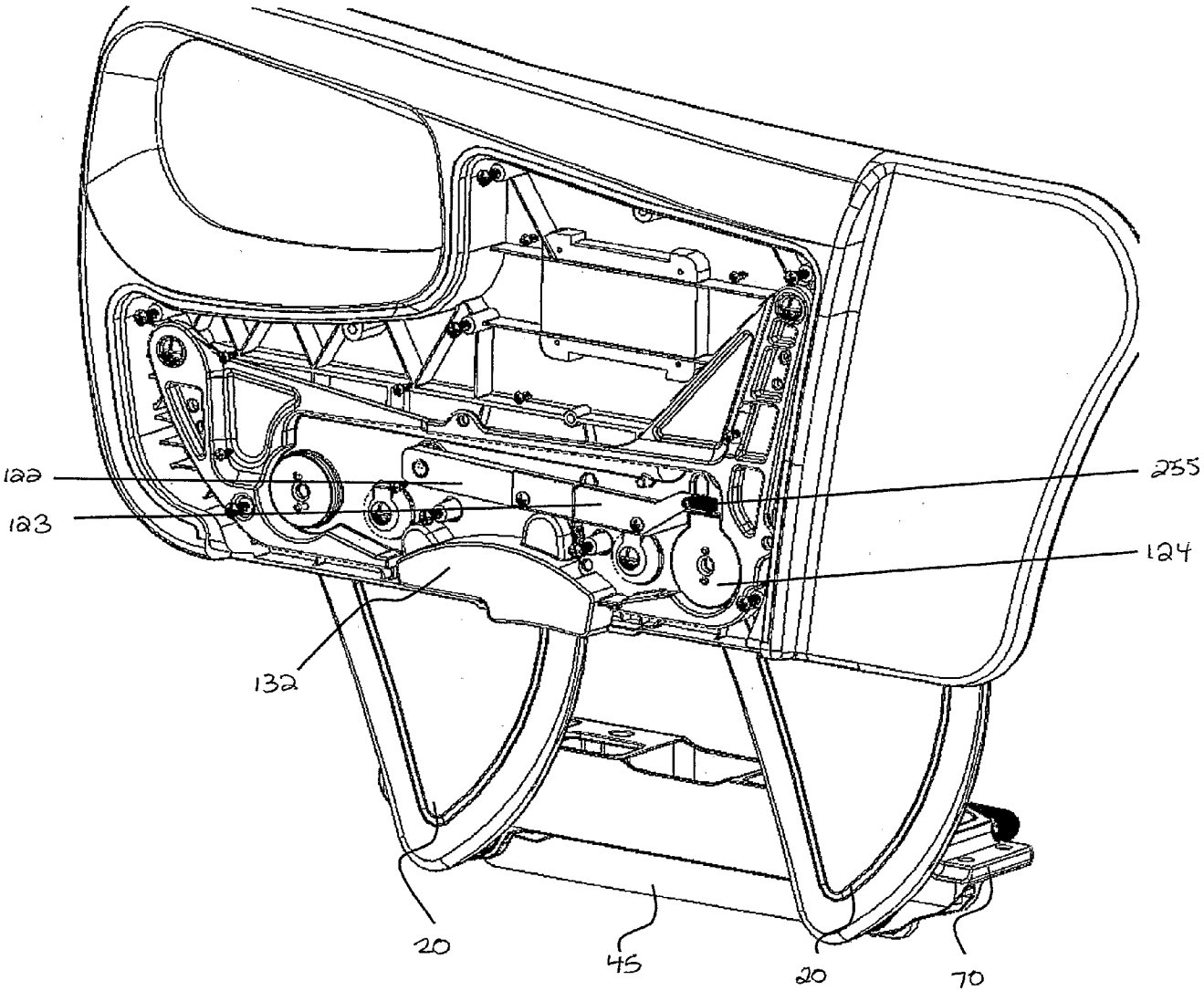
FIG. 14*a* is a perspective view of the internal components of the siderail body according to one embodiment of the present invention wherein the siderail apparatus is in a fully deployed position.

With reference to FIGS. 14*a*, 14*b*, 14*c* and 14*d*, a detector mechanism 250 according to an embodiment of the present invention is depicted, and is merely one example of possible configurations of the detector mechanism 250 according to the present invention. FIG. 14*a* is a perspective view of the internal components of the siderail body 14. In this embodiment, the sensor 255 is coupled to a sensor support arm 123, mounted to the second end 130 of the locking arm 122. The sensor support arm 123 projects over the pivot shaft 42 coupling the sensor 255 superposed to upper portion of the pivot shaft 42. In the position shown in FIG. 14*a* the sensor is resting on the pivot shaft 42 orientated upwards and the locking tooth 128 engaged with the locking cog 124 of the pivot shaft 42. In this position, the sensor 255 generates an output signal indicating that the siderail 9 in a fully deployed position.

Figure 14B:
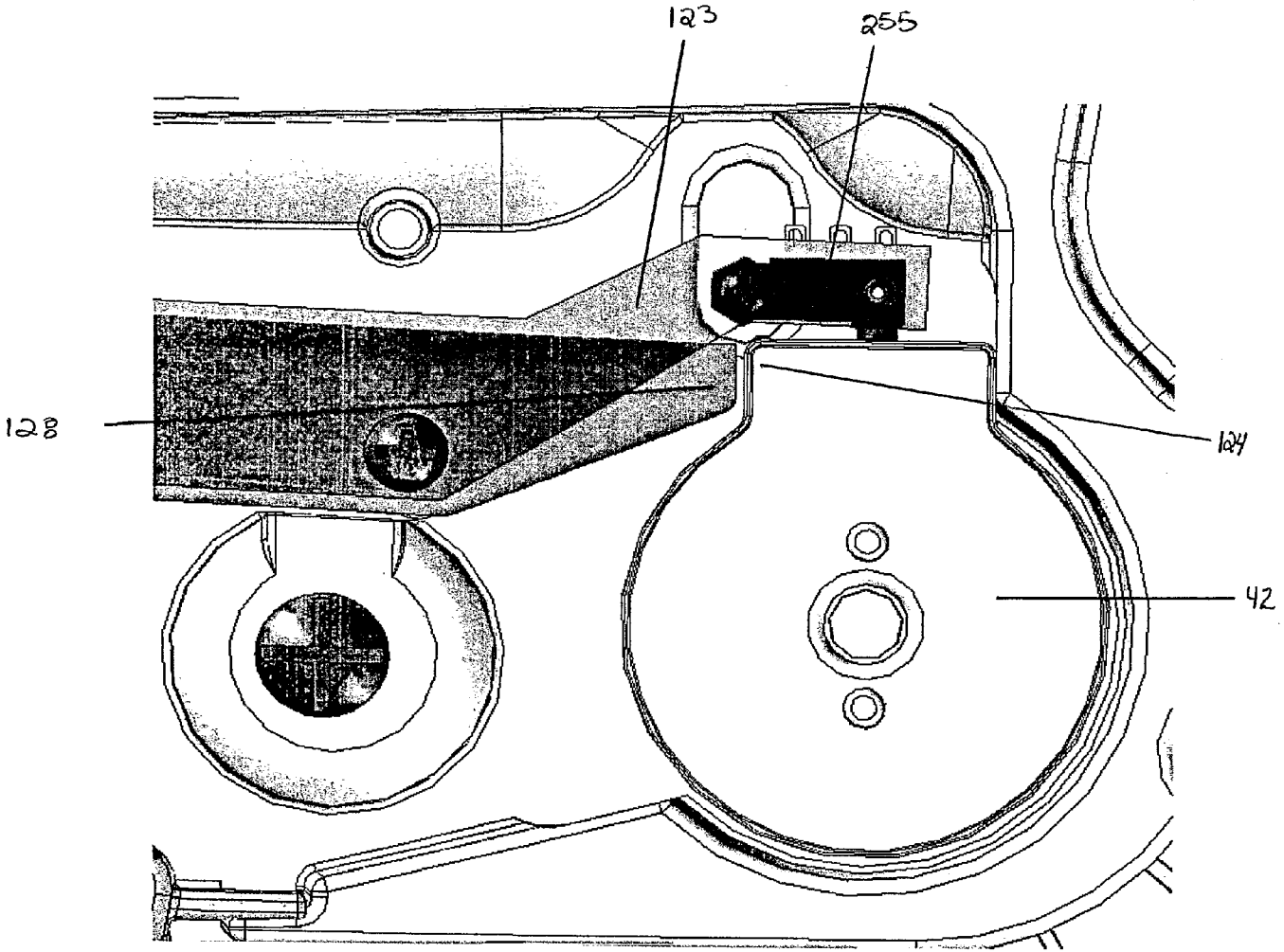
FIG. 14*b* is perspective view of the locking mechanism and detector mechanism of the siderail apparatus in a fully deployed position, according to one embodiment of the present invention.
Figure 14C:
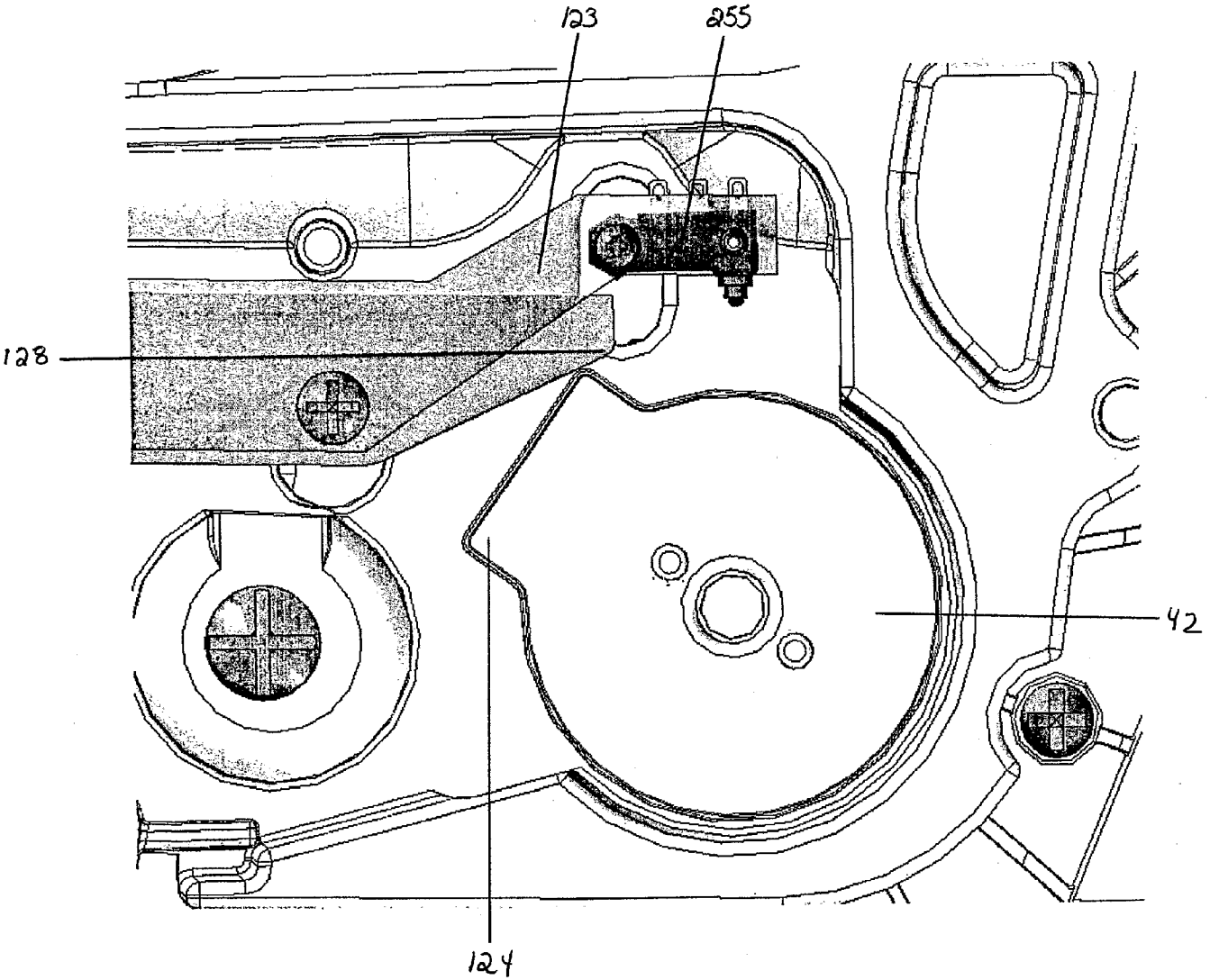
FIG. 14*c* is perspective view of the locking mechanism and detector mechanism of the siderail apparatus in a partially deployed position, according to one embodiment of the present invention.
Figure 14D:
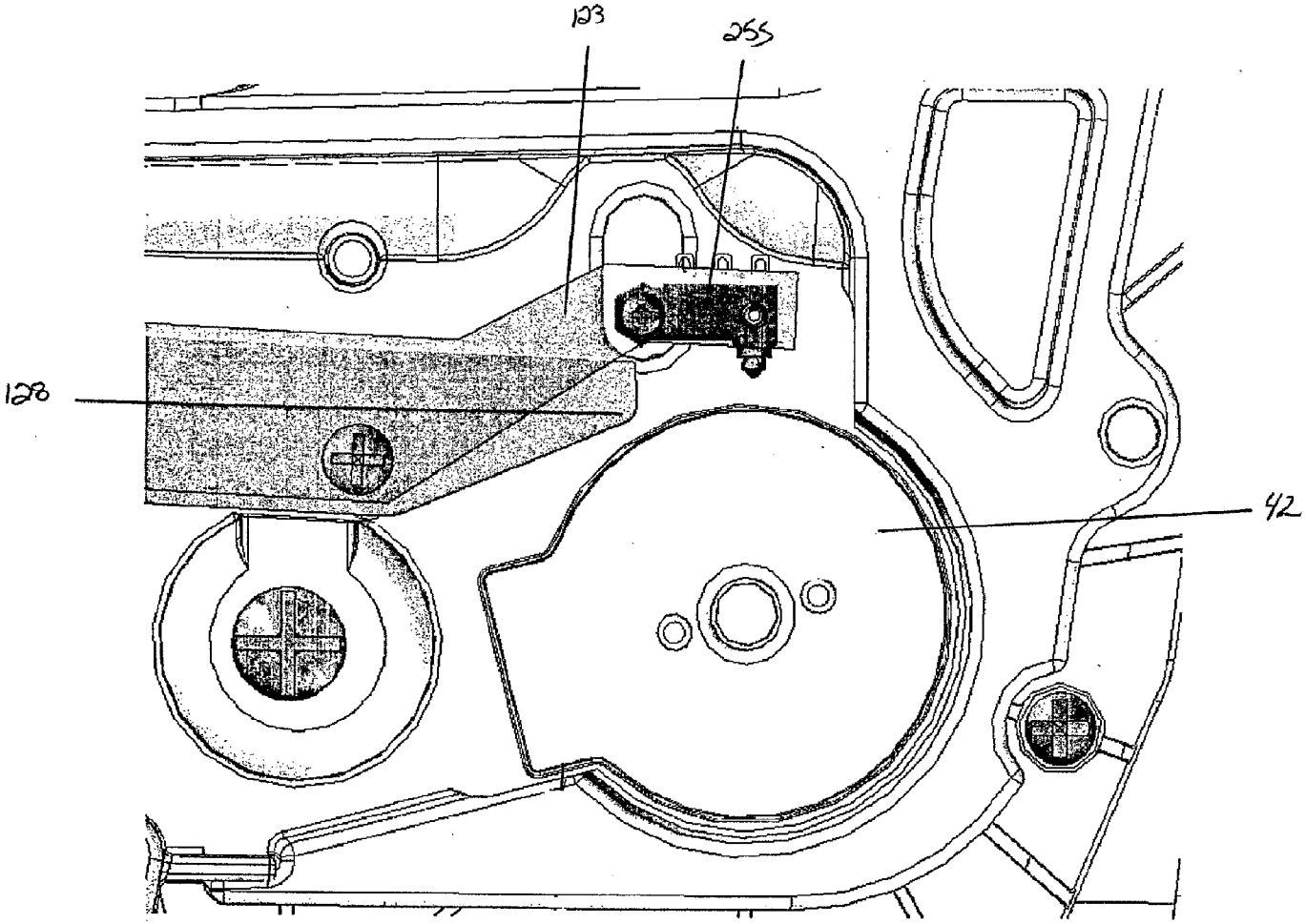
FIG. 14*d* is perspective view of the locking mechanism and detector mechanism of the siderail apparatus in a fully stowed position, according to one embodiment of the present invention.
Figure 15A:
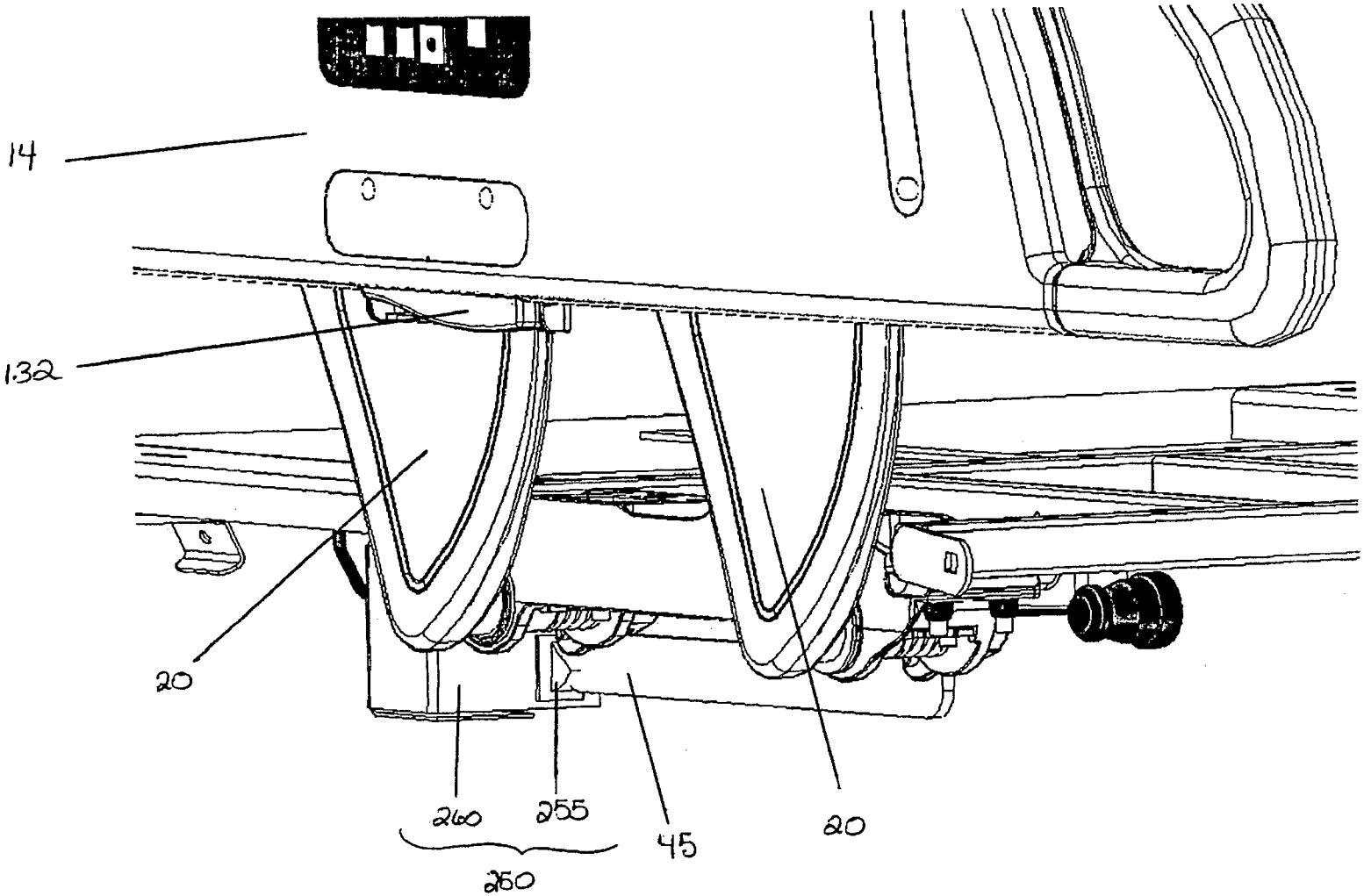
FIG. 15*a* is a perspective view of a siderail apparatus according to one embodiment of the present invention in a fully deployed position showing the detector mechanism.
Figure 15B:
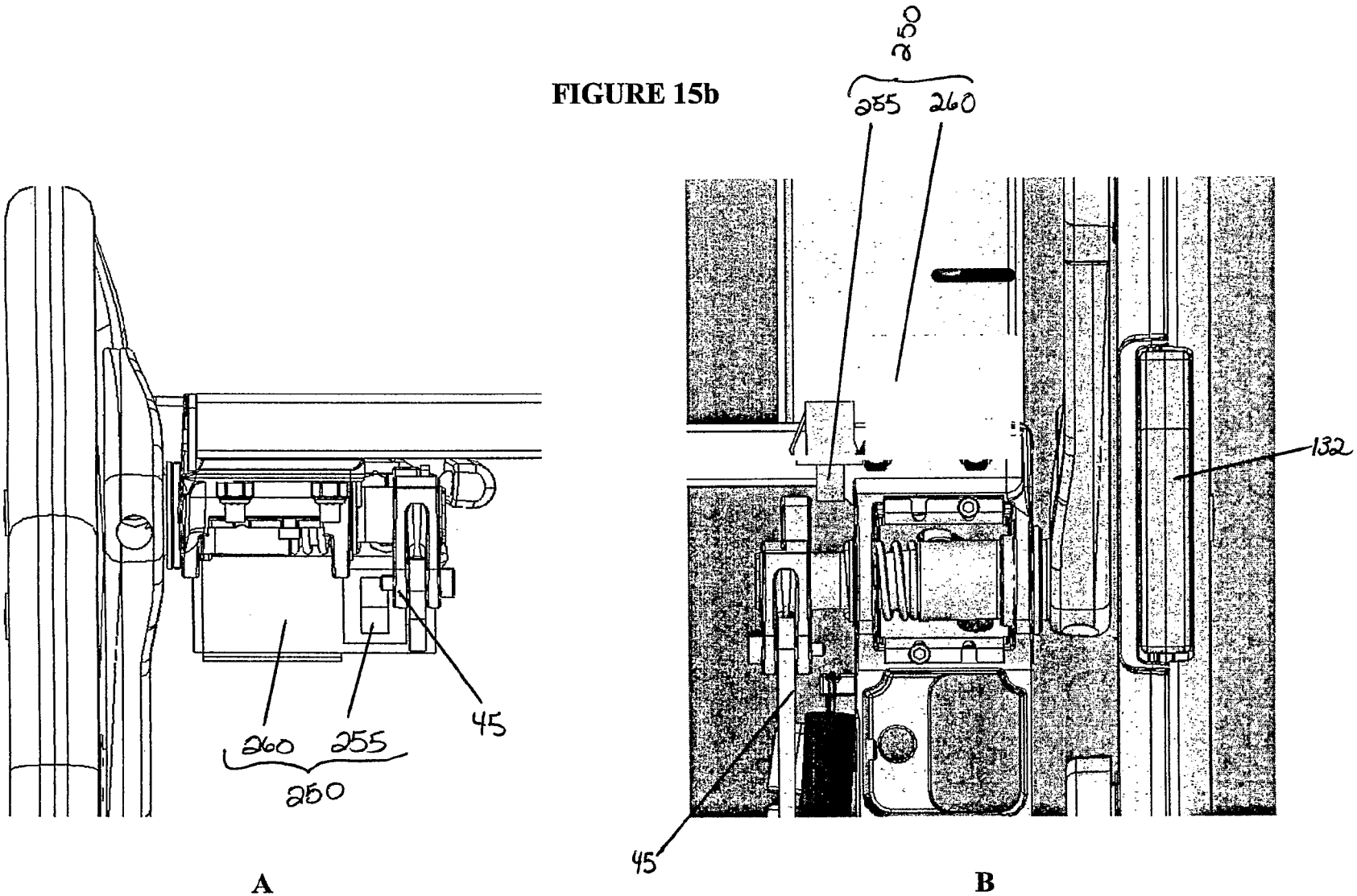
FIG. 15*b* (A) is a rear view of a siderail apparatus according to one embodiment of the present invention in a fully stowed position showing the detector mechanism (B) is a top view of an embodiment according to the present invention in a fully stowed position showing the detector mechanism.
Figure 15C:
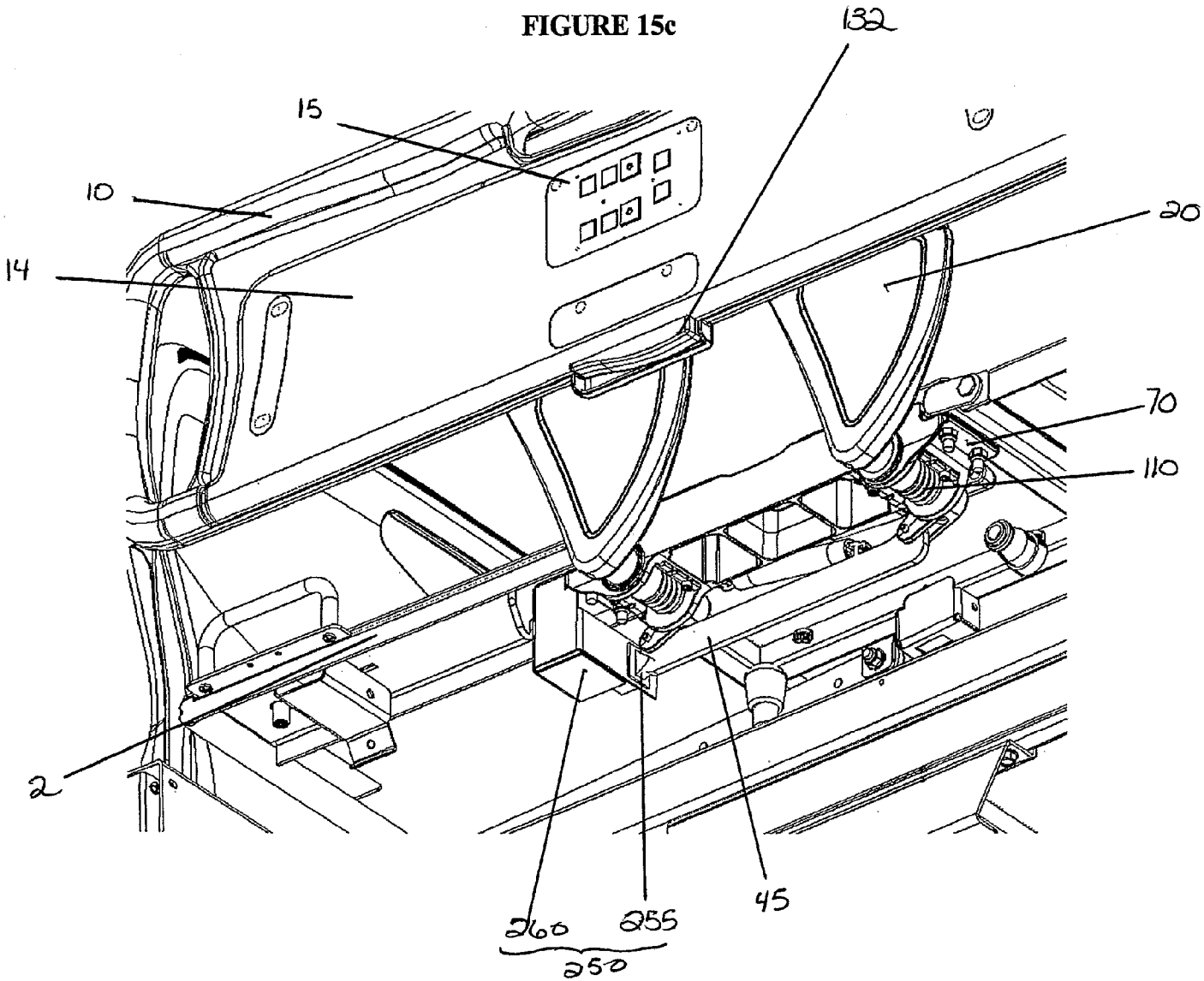
FIG. 15*c* is a perspective view of a siderail apparatus according to one embodiment of the present invention in a fully deployed position showing the detector mechanism coupled to the head section of the frame system of a patient support apparatus.
Figure 15D:
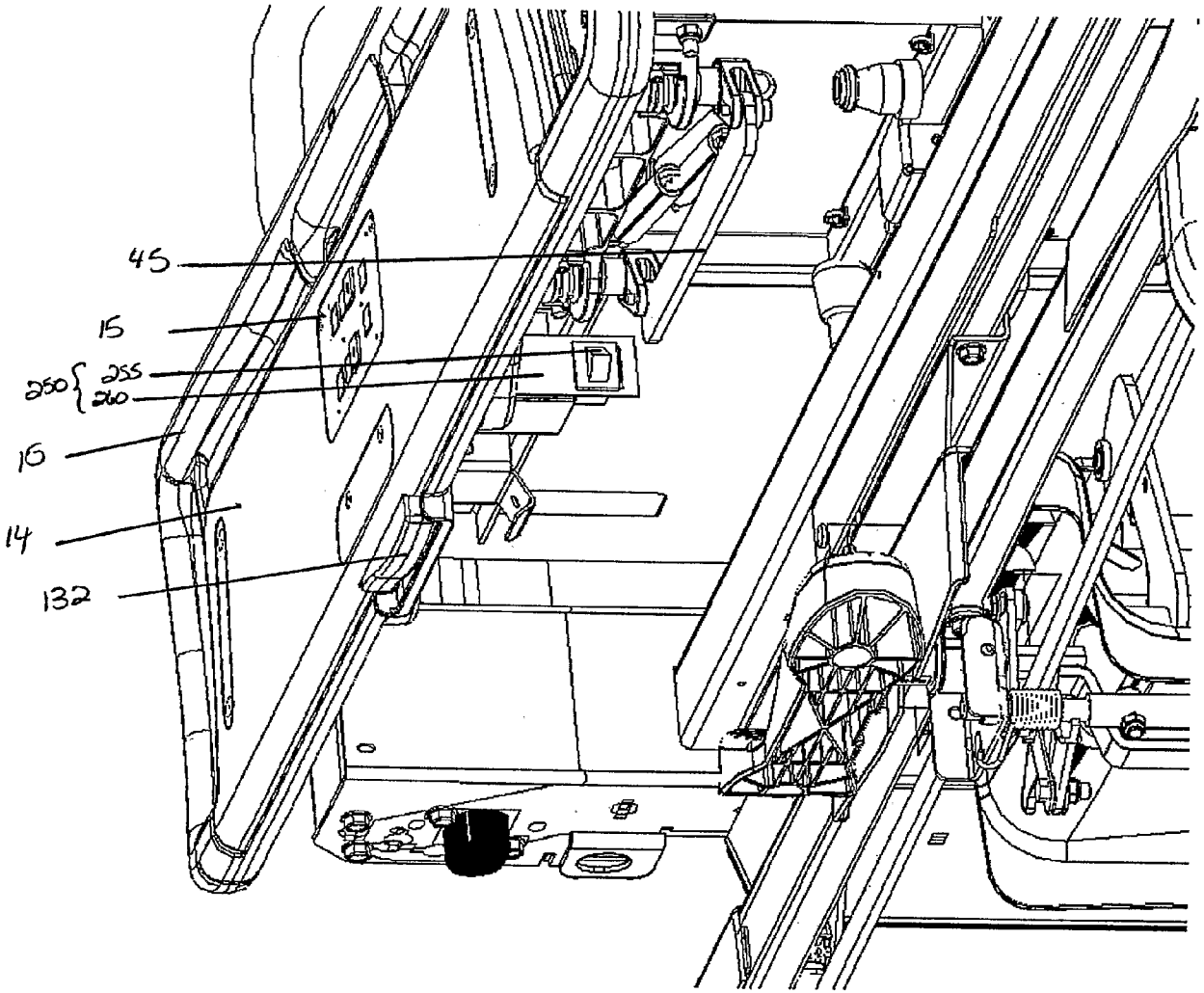
FIG. 15*d* is a perspective view of a siderail apparatus according to one embodiment of the present invention in a fully stowed position showing the detector mechanism coupled to the head section of the frame system of a patient support apparatus.
Figure 15E:
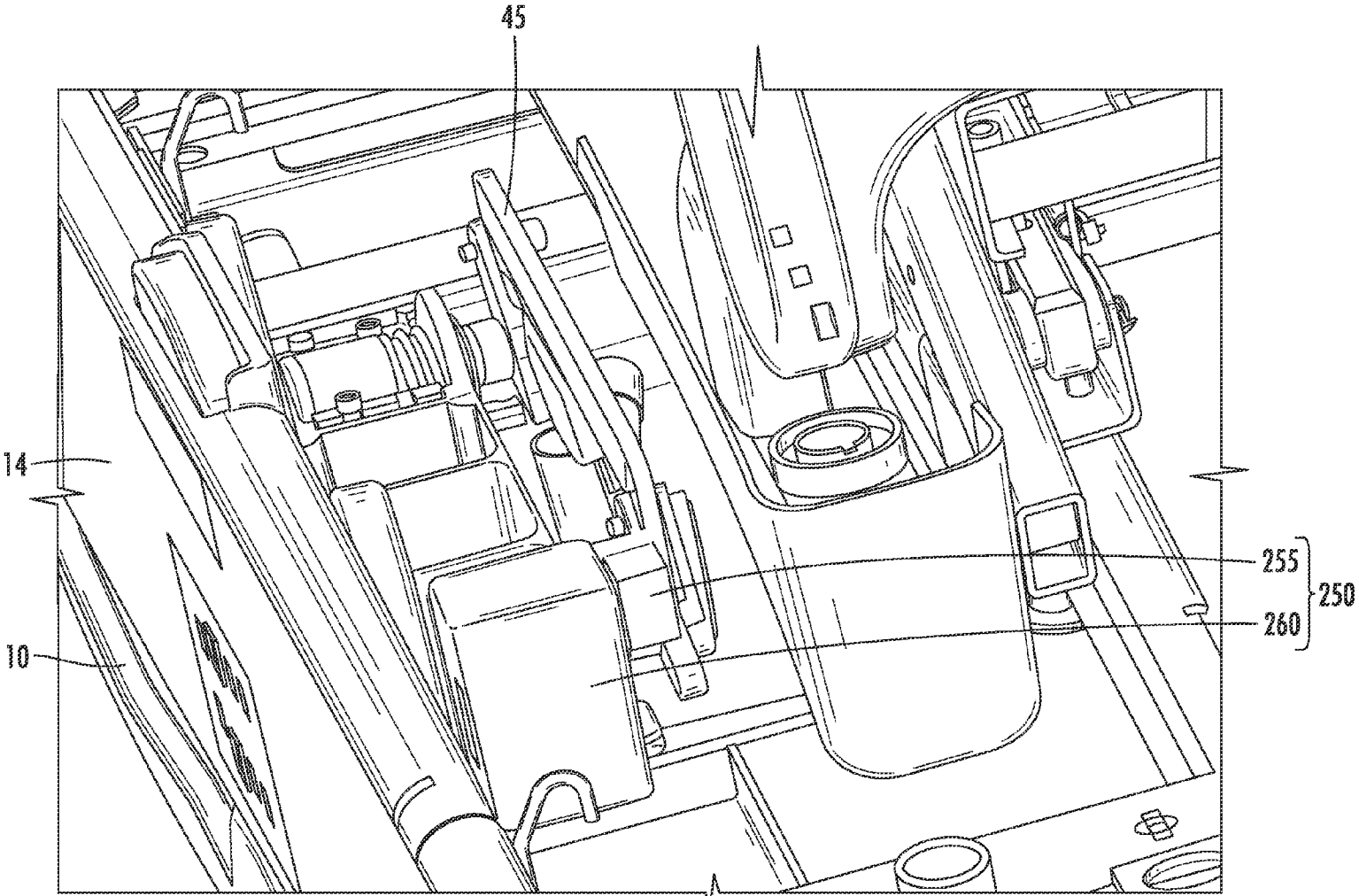
FIG. 15*e* is a partial perspective view of a siderail apparatus according to one embodiment of the present invention in a fully stowed position showing the detector mechanism coupled to the head section of the frame system of a patient support apparatus.
Figure 15F:
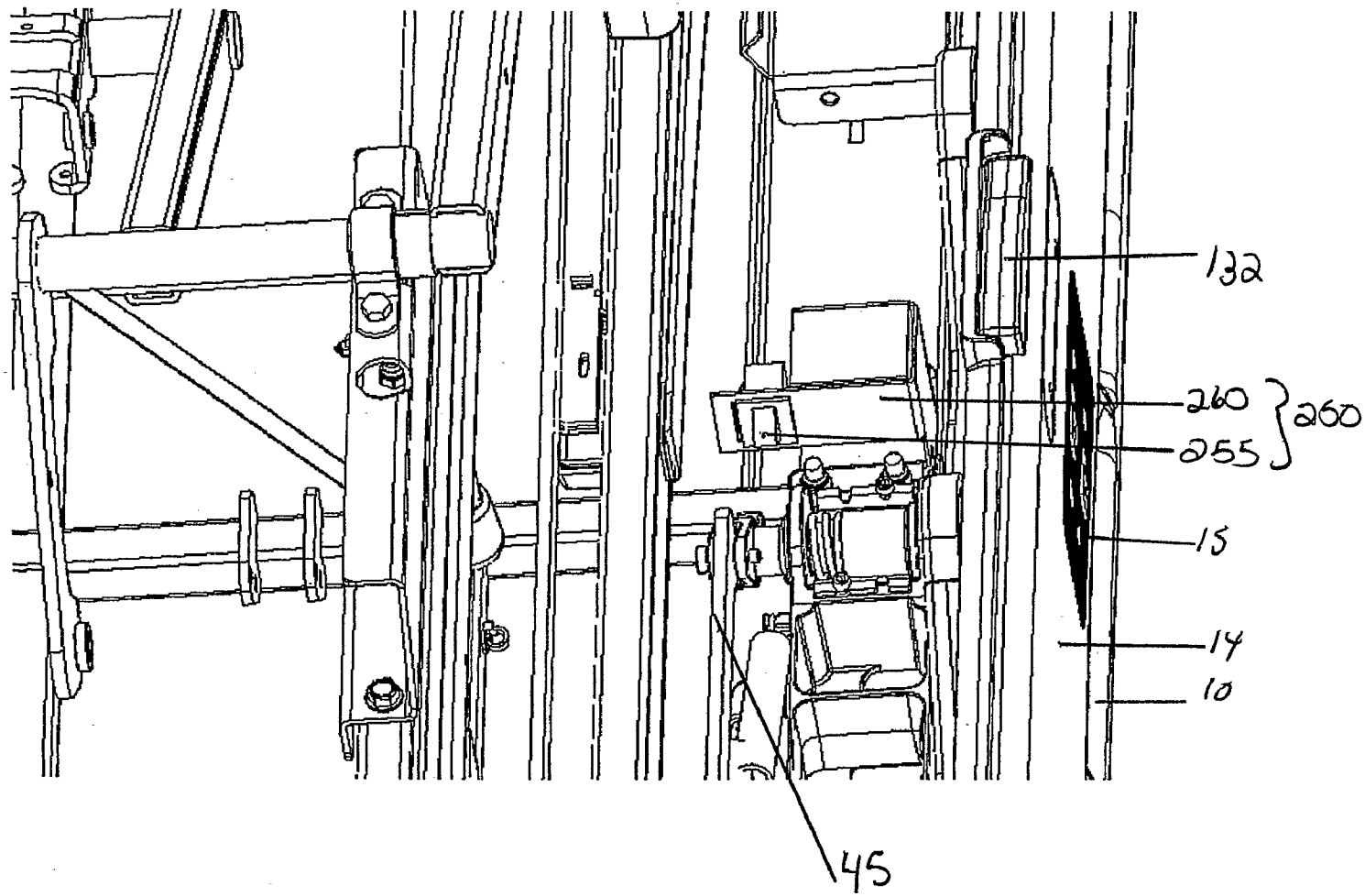
FIG. 15*f* is a perspective view of a siderail apparatus according to one embodiment of the present invention in a fully deployed position showing the detector mechanism coupled to the head section of the frame system of a patient support apparatus.

FIGS. 14*b*, 14*c* and 14*d* illustrate the position of the sensor and the locking cog 124 of the pivot shaft 42 during the transitional movement of the siderail 9 from a fully deployed position and a fully stowed position.

FIG. 14*b* illustrates the sensor resting the pivot shaft 42 orientated upwards and the locking tooth 128 engaged with the locking cog 124 of the pivot shaft 42. In this position the siderail 9 is locked in a fully deployed position and the sensor 255 generates an output signal indicating that the siderail 9 in a fully deployed position.

FIG. 14*c* illustrates position of the sensor, the pivot shaft 42 and the locking tooth 128 when the siderail 9 is in a partially deployed position. The engagement of the lock release mechanism 132 raises the locking arm 122 disengaging the locking tooth 128 from the locking cog of the pivot shaft 42. The released locking cog 124 then starts a transverse counter-clockwise movement. In this position, the sensor 255 is no longer resting on the locking cog 124 of the pivot shaft 42 generating an output signal which indicates that the siderail 9 is not in the fully deployed position.

FIG. 14*d* illustrates the position of the sensor 255, the locking cog 124 of the pivot shaft 42 and the locking tooth 128 at the end of transitional movement of the siderail 9 when the siderail 9 is in a fully stowed position. The pivot shaft 42 continued its transverse counter-clockwise movement until the locking cog 124 engages a notch in the siderail body. In this position, the sensor 255 is no longer resting on the locking cog 124 of the pivot shaft 42 generating an output signal which indicates that the siderail 9 is not in the fully deployed position.

In an embodiment of the present invention (not shown), the sensor 255 is coupled to the pivot shaft 42. A sensor, such as a potentiometer, is used to measure the rotational angle of the pivot shaft 42 about the axis of the upper pivot 30. The detecting mechanism 260 is configured generates an output signal indicating the angle of the of the pivot shaft 42 about the axis of the upper pivot 30. The output signal is sent to the processor 260. The processor 260 is configured to determine if the angle corresponds the siderail body 14 in a fully deployed position (for example a locked position) or a partially deployed, partially stowed or fully stowed position (for example unlocked 115 positions). The processor 260 then communicates the relative position of the siderail body 14 to the siderail control panel 15 or a display module 265.

In an embodiment of the present invention, the detector mechanism 250 is coupled to the patient support apparatus in proximity to the siderail configured to detect the relative position of the siderail body. The sensor apparatus 250 comprises a sensor 255 and a processor 260. The type of sensors sensor 255 that may be used could be, for example, a proximity sensor, a photoelectric sensor, a limit switches, an integrated circuit sensors, Piezo sensitive devices, an angular sensor, a potentiometer, a contact switch, a capacitor, a magneto resistive element, an optical sensor, a camera sensor, a radar sensor, an ultrasonic sensor, a magnetic sensor, a Temposonic™ sensor. The sensor is configured to detect the siderail 9 is in a fully deployed position (locked position) or a partially deployed, partially stowed or fully stowed position (unlocked positions). The sensor generates an output signal communicated to a processor 260 which then communicates to a display module 265 (not shown). The display module indicates the relative position of the siderail 9.

FIGS. 15*a* to 15*f* depict a detector mechanism 250 coupled to the head section of the frame system proximate to the distal end of the synchronizing member 45 according to an embodiment of the present invention. The sensor apparatus 250 is coupled to a frame member of the patient support apparatus, proximate to the distal end of the synchronizing member 45. The sensor 255 faces the synchronizing member 45 at a predetermined relative height. In the depicted embodiment, the sensor is a limit switch.

When the siderail 9 is in a fully deployed position, the synchronizing member 45 is fully extended such that its distal end comes in contact with the limit switch the sensor 255 generates an output signal indicating that the siderail 9 is in a fully deployed position. The output signal is communicated to a processor 260 which then communicates to a display module 265. The display module indicates the relative position of the siderail 9.

When the siderail 9 is in a partially deployed, partially stowed or fully stowed position, the synchronizing member 45 extended away from the limit switch. An output signal indicating that the siderail 9 is not in a fully deployed position is communicated to a processor 260 which then communicates to a display module 265. The display module indicates the relative position of the siderail 9.

FIGS. 16*a* to 16*e* depict a sensor apparatus 250 coupled to the foot section of the frame system proximate to the distal end of the synchronizing member 45 according to an embodiment of the present invention. The sensor apparatus 250 is coupled to the frame member of the patient support apparatus, proximate to the distal end of the synchronizing member 45. The sensor 255 faces the synchronizing member 45 at a relative height. In the depicted embodiment, the sensor is a limit switch.

When the siderail 9 is in a fully deployed position, the synchronizing member 45 is fully extended such that its distal end comes in contact with the limit switch the sensor 255 generates an output signal indicating that the siderail 9 is in a fully deployed position. The output signal is communicated to a processor 260 which then communicates to a display module 265. The display module indicates the relative position of the siderail 9.

When the siderail 9 is in a partially deployed, partially stowed or fully stowed position, the synchronizing member 45 extended away from the limit switch. An output signal indicating that the siderail 9 is not in a fully deployed position is communicated to a processor 260, which then communicates to a display module 265. The display module 265 indicates the relative position of the siderail 9.

In one embodiment of the present invention, when the processor receives a signal indicating that a siderail 9 is not in a fully deployed position, the processor can disable certain therapies, for example, rotational therapy and articulation of a section of the patient support apparatus.

Siderail Protective Sheath

A protective sheath surround and adhere to the surfaces of the siderail or any of the components of the siderail apparatus, such as the siderail body, the siderail cover and the support arms. The protective sheath protects against the entry of contaminants, dust, liquids, moisture, bacteria, germs, viruses and the like into the sheathed component of the siderail apparatus and facilitates cleaning by providing a smooth wipable surface. The protective sheath is made of a resilient flexible membrane and can be transparent or translucent so as to enable the user or caregiver to view and access the display panel on the siderail. It may however be opaque or tinted to enhance the visual appeal and aesthetics of any of the components of the siderail apparatus. Apertures for the upper pivots and/or an opening to slip the protective sheath onto the protected component of the siderail apparatus are provided. The protective sheath extends inwardly beyond the lower edges of component being protected. The protective sheath can also be made of a heat shrink wrap material fitted and secured over the siderail apparatus or any of its components.

Figure 27:
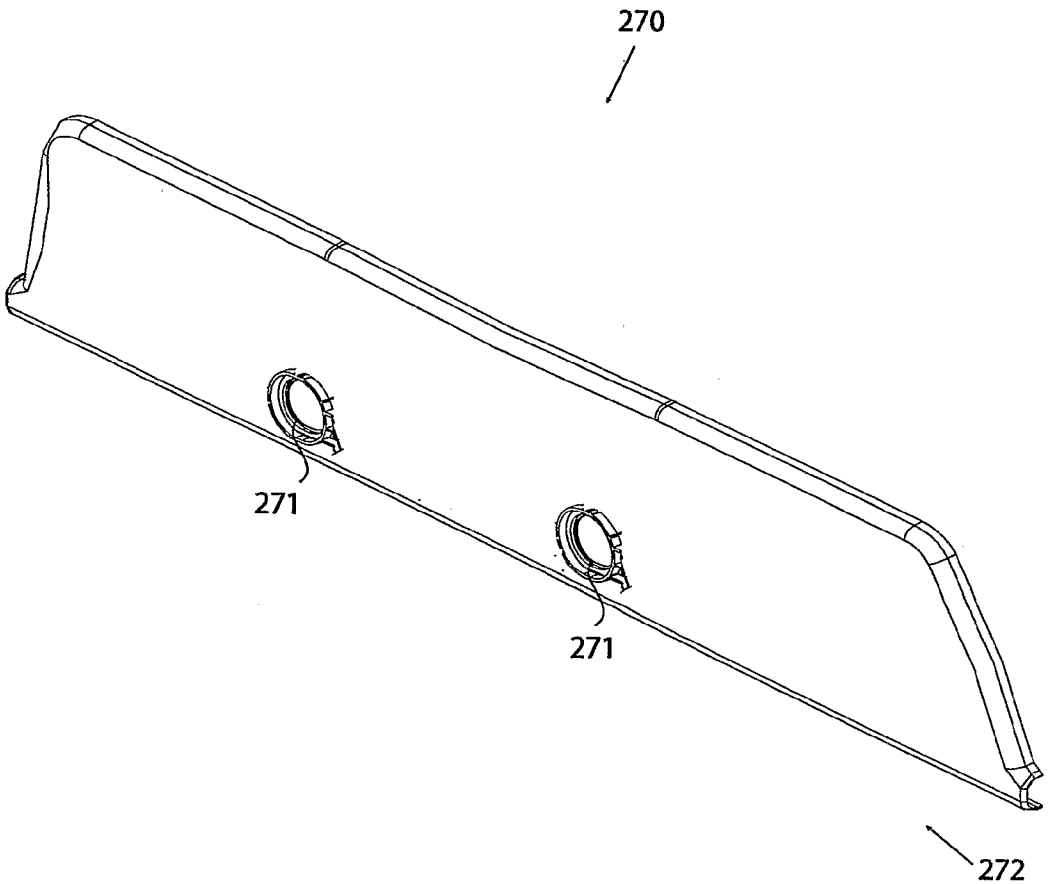
FIG. 27 is a perspective view of a protective sheath for the siderail body according to one embodiment of the present invention.

In an embodiment of the present invention, the siderail body 14 includes a protective sheath 270 comprising a resilient flexible membrane such as polyurethane, plastic or rubber material, formed to surround and adhere to the surfaces of the siderail body 14 (see for example FIG. 27). The membrane may be transparent or translucent so as to enable the user or caregiver to view and access the control display panel on the siderail body 14 or otherwise the sheath 270 may be shaped to provide a cut out area through which the control display panel may be accessed. The membrane may however be opaque or tinted to enhance the visual appeal and aesthetics of the siderail. The protective sheath 270 is formed with apertures 271 for the upper pivots 30 to operatively protrude therethrough and one or more openings 272 in order to slip onto the siderail body 14. The opening 272 is formed so that the protective sheath 270 extends inwardly beyond the lower edges of siderail body 14.

The entry of contaminants in the moveable siderail apparatus 5 is undesirable since it may effect internal operations resulting in malfunctions and expenses to replacing components of the moveable siderail apparatus. The protective sheath 270 protects the entry of contaminants, dust, liquids, moisture and the like into the moveable siderail apparatus and facilitates cleaning of the moveable siderail apparatus by providing a smooth wipable surface. This latter feature further assists in minimizing the spread of bacteria, germs, viruses and other biohazard contaminants.

Figure 28:
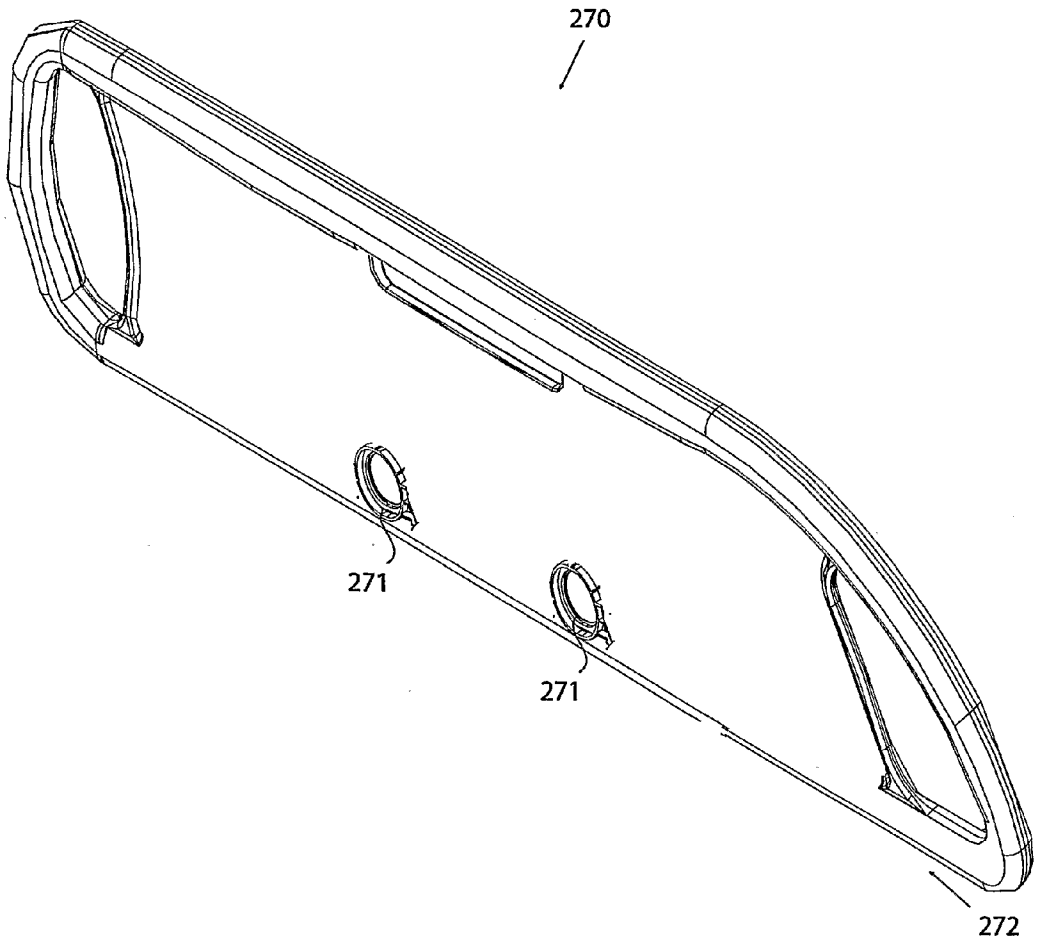
FIG. 28 is a perspective view of a protective sheath for the siderail according to one embodiment of the present invention.

In an embodiment of the present invention, the siderail 9 includes a protective sheath 270 comprising a resilient flexible membrane such as polyurethane, plastic or rubber material, formed to surround and adhere to the surfaces of the siderail 9 (see for example FIG. 28). The membrane is preferably transparent or translucent so as to enable the user or caregiver to view and access the display panel on the siderail body 14. The membrane may however be opaque or tinted to enhance the visual appeal and aesthetics of the siderail body. The protective sheath 270 is formed with apertures 271 for the upper pivots 30 to operatively protrude therethrough and one or more openings 272 in order to slip onto the siderail 9. The opening 272 is formed so that the protective sheath 270 extends inwardly beyond the lower edges of siderail 9. The protective sheath 270 protects the siderail 9 from dust, grit, liquids, moisture, bacteria, germs, viruses and other biohazard contaminants.

In one embodiment of the present invention, the protective sheath 270 is formed of a high strength silicon, for example 595HC type by Dow Corning Inc. This material is a clear plastic which will stretch up to 300% and is tear resistant. The protective sheath 270 may be constructed by various methods such as injection and compression molding.

In an alternative embodiment of the present invention, a protective sheath 270 comprising a resilient flexible membrane such as polyurethane, plastic or rubber material, formed to surround and adhere to the surfaces of the siderail cover 10 and the support arms 20 is provided.

In an embodiment of the present invention, the siderail apparatus 5 includes a protective sheath 270 comprised of a heat shrink wrap material 275 (not shown) fitted and secured over the siderail apparatus 5. The heat shrink material 275 can cover the entire moveable siderail apparatus or any individual component, for example, the siderail body 14, the siderail cover 10 and the support arms 20. The protective sheath 270 protects the siderail body 14 from dust, grit, liquids, moisture and the like.

Relative Positioning of Siderail Apparatus

The siderail apparatus 5 or apparatuses according to the present invention positioned on a first side of the patient support apparatus can be designed to operate in a mirror fashion to the siderail apparatus 5 or apparatuses located on the other side of the patient support apparatus, where the siderail apparatus 5 on one side of the lying surface would operate in the opposite rotational direction (clock-wise/counter clock-wise) to the corresponding siderail apparatus 5 on the other side of the patient support apparatus and where the longitudinal movement of the siderail bodies 10 along the length of the patient support apparatus would be in the same direction. Alternatively, a patient support apparatus can have other configurations such as one siderail apparatus 5 on one side and two siderail apparatuses 5 on the other. When a patient support apparatus comprises two siderail apparatuses 5 on a single side thereof, the relative rotational movement of these two siderail apparatuses 5 would be opposite in order to avoid impact therebetween, for example when only one of the two siderail apparatuses 5 is moved between a raised and lowered position and vice versa. A single patient support apparatus can have siderail apparatuses 5 of different shapes and sizes.

The embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A movable siderail apparatus for use with a patient support apparatus, the siderail apparatus comprising:

a siderail having two or more upper pivots in a longitudinally spaced apart relationship;

a cross-member having two or more lower pivots in a longitudinally spaced apart relationship, the cross-member being coupled to an intermediate frame or deck support of the patient support apparatus;

two or more support arms, a first end of each support arm pivotally connected to one of the two or more upper pivots of the siderail, a second end of each support arm pivotally connected to one of the two or more lower pivots of the cross-member in a longitudinally spaced apart relationship, wherein the siderail is movable through rotational movement between a raised deployed position and a lowered stowed position and wherein the support arms are configured such that the angles defined between at least one side edge of each support arm and a lower edge of the siderail are substantially obtuse when the siderail is moved between its deployed and stowed positions.

2. The movable siderail apparatus for use with a patient support apparatus according to claim 1, wherein each of the pivots includes a pivot shaft, the apparatus further comprising a locking mechanism, wherein the locking mechanism comprises a locking arm pivotally mounted to the siderail at a first end, the locking arm having a locking tooth at a second end, and a locking cog mounted on one of the pivot shafts and configured to engage the locking tooth when the siderail is in the deployed position.

3. The movable siderail apparatus for use with a patient support apparatus according to claim 2 wherein the locking tooth is configured to engage the locking cog when the siderail is in the stowed position or in an intermediate position.

4. The movable siderail apparatus for use with a patient support apparatus according to claim 2, wherein the locking arm is biased by a lock spring.

5. The movable siderail apparatus for use with a patient support apparatus according to claim 4, further comprising a lock release mechanism for shifting the locking arm against the bias of the lock spring and disengaging the locking tooth from the locking cog.

6. The movable siderail apparatus for use with a patient support apparatus according to claim 1 further comprising a siderail position detector mechanism, the siderail position detector mechanism including one or more sensors and a processor.

7. The movable siderail apparatus for use with a patient support apparatus according to claim 6, further comprising a display module, the siderail position detector mechanism generating a signal indicative of the position of the siderail and communicating siderail position information to the display module, and the display module for displaying the position information of the siderail based on the communication from the siderail position detector mechanism.

8. The movable siderail apparatus for use with a patient support apparatus according to claim 1, further comprising a damper mechanism.

9. The movable siderail apparatus for use with a patient support apparatus according to claim 1, wherein the siderail comprises a siderail body, a siderail cover, and a protective sheath.

10. A movable siderail apparatus for use with a patient support apparatus, the siderail apparatus comprising:

a siderail having two or more upper pivots in a longitudinally spaced apart relationship;

a cross-member having two or more lower pivots in a longitudinally spaced apart relationship, the cross-member being coupled to an intermediate frame or deck support of the patient support apparatus;

a guiding mechanism operatively connected to the cross-member and the two or more lower pivots; and two or more support arms, a first end of each support arm pivotally connected to one of the two or more upper pivots of the siderail, a second end of each support arm pivotally connected to one of the two or more lower pivots;

wherein the siderail is movable between a deployed position and a stowed position through rotational movement in a plane substantially vertical and substantially parallel to the longitudinal length of the patient support apparatus and wherein the guiding mechanism provides a means for lateral movement of the siderail towards and away from the patient support apparatus during rotational movement of the siderail.

11. The movable siderail apparatus for use with a patient support apparatus according to claim 10, wherein each of the lower pivots includes a pivot shaft, the guiding mechanism comprising a protrusion on one of the pivot shafts of the lower pivots and a guiding groove on the cross-member, the protrusion extending into the groove and guiding lateral movement of the siderail when the pivot shafts rotate.

12. The movable siderail apparatus for use with a patient support apparatus according to claim 11, wherein each of the upper pivots has a pivot shaft, the apparatus further comprising a locking mechanism operatively connected to the siderail, the locking mechanism including a locking arm with a locking tooth and a locking cog mounted on one of the pivot shafts configured to engage the locking tooth when the siderail is in the deployed position.

13. The movable siderail apparatus for use with a patient support apparatus according to claim 11, wherein the guiding groove includes an arcuate portion.

14. The movable siderail apparatus for use with a patient support apparatus according to claim 11, further comprising a siderail position detector mechanism, the siderail position detector including at least one sensor and a processor.

15. The movable siderail apparatus for use with a patient support apparatus according to claim 14, wherein the pivot shafts of the lower pivots are coupled to a member, the sensor detecting the position of the member to thereby detect the position of the siderail.

16. The movable siderail apparatus for use with a patient support apparatus according to claim 10, wherein the siderail is movable between a deployed position and a stowed position through rotational movement about the respective pivots, wherein angles defined between a side of each support arm and a lower edge of the siderail are substantially obtuse during rotational movement of the siderail.

17. The movable siderail apparatus for use with a patient support apparatus according to claim 16, wherein each of the support arms includes a pair of side edges, when each support arm rotates one of the side edges moves in an arcuate path and another of the side edges moves in a radial path.

18. The movable siderail apparatus for use with a patient support apparatus according to claim 16, wherein each of the support arms comprises a pair of side edges, one of the side edges comprising a curved side edge.

19. The movable siderail apparatus for use with a patient support apparatus according to claim 10, wherein each of the lower pivots includes a pivot shaft, the apparatus further comprising a damper mechanism, the damper mechanism being coupled to the pivot shafts of the lower pivots.

20. The movable siderail apparatus for use with a patient support apparatus according to claim 19, further comprising a member coupled to the pivot shafts of the lower pivots, the damper mechanism comprising a spring and a dampener, the spring being coupled to the member and the cross-member, and the dampener being coupled to the cross-member and one of the pivot shafts wherein the spring and the dampener dampen the movement of the siderail from the deployed position to the stowed position.

21. The movable siderail apparatus for use with a patient support apparatus according to claim 20, wherein the dampener has a stiffness and wherein the stiffness is adjustable to thereby adjust the damping coefficient of the damper mechanism.

* * * * *

UNITED STATES PATENT AND TRADEMARK OFFICE

CERTIFICATE OF CORRECTION

PATENT NO. : 7,784,125 B2
APPLICATION NO. : 12/063970
DATED : August 31, 2010
INVENTOR(S) : Marco Morin et al.

It is certified that error appears in the above-identified patent and that said Letters Patent is hereby corrected as shown below:

Column 20
Line 49, delete "115" after --unlocked--

Signed and Sealed this

Sixteenth Day of November, 2010

David J. Kappos

David J. Kappos
*Director of the United States Patent and Trademark Office*